US009170556B2

(12) United States Patent
Karashima et al.

(10) Patent No.: US 9,170,556 B2
(45) Date of Patent: Oct. 27, 2015

(54) CLEANING BLADE, METHOD FOR MANUFACTURING CLEANING BLADE, PROCESS CARTRIDGE, AND ELECTROPHOTOGRAPHIC APPARATUS

(71) Applicant: CANON KABUSHIKI KAISHA, Tokyo (JP)

(72) Inventors: Kenji Karashima, Tokyo (JP); Masaya Kawada, Yokohama (JP); Tomohiro Tanoue, Yokohama (JP); Masahiro Watabe, Yokohama (JP); Shingo Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/263,846

(22) Filed: Apr. 28, 2014

(65) Prior Publication Data

US 2014/0321880 A1 Oct. 30, 2014

(30) Foreign Application Priority Data

Apr. 30, 2013 (JP) ..... 2013-096019
Apr. 11, 2014 (JP) ..... 2014-082052

(51) Int. Cl.
*G03G 21/00* (2006.01)
*G03G 21/18* (2006.01)
*G03G 15/16* (2006.01)

(52) U.S. Cl.
CPC ..... *G03G 21/0017* (2013.01); *G03G 15/161* (2013.01); *G03G 21/1814* (2013.01)

(58) Field of Classification Search
CPC ..... G03G 5/071; G03G 5/14791; G03G 21/0029; G03G 13/08; G03G 21/0017; G03G 5/0614; G03G 5/14734; G03G 5/14786; G03G 5/14795; G03G 9/0819; G03G 9/0827; G03G 15/161; G03G 15/1615; G03G 15/162
USPC ..... 399/350, 159, 111, 101, 302, 353
See application file for complete search history.

(56) References Cited

U.S. PATENT DOCUMENTS 5,168,309 A 12/1992 Adachi et al.
5,438,400 A * 8/1995 Kuribayashi et al. ..... 399/350
6,703,472 B2 3/2004 Miura et al.

(Continued)

FOREIGN PATENT DOCUMENTS

JP 2001-075451 A 3/2001
JP 3239607 B2 12/2001
JP 2008-009400 A 1/2008
JP 2008-250311 A 10/2008
JP 2008-268670 A 11/2008

(Continued)

*Primary Examiner* — Roy Y Yi
(74) *Attorney, Agent, or Firm* — Canon U.S.A. Inc., IP Division

(57) ABSTRACT

A urethane rubber cleaning blade, wherein a surface of a contact portion of the cleaning blade that comes into contact with a member to be cleaned has a Young's modulus ($Y_0$) of 10 mgf/μm$^2$ or more and 400 mgf/μm$^2$ or less, the ratio ($Y_{50}/Y_0$) of the Young's modulus ($Y_{50}$) of an internal portion of the cleaning blade 50 μm spaced apart from the surface of the contact portion to the Young's modulus ($Y_0$) is 0.5 or less, and the average rate of change in Young's modulus from the surface to an internal portion of the cleaning blade 20 μm spaced apart from the surface is greater than or equal to the average rate of change in Young's modulus from the internal portion of the cleaning blade 20 μm spaced apart from the surface to an internal portion of the cleaning blade 50 μm spaced apart from the surface.

20 Claims, 18 Drawing Sheets

(56) References Cited

U.S. PATENT DOCUMENTS

| | | | | |
|---|---|---|---|---|
| 2009/0003905 | A1 | 1/2009 | Ueno | |
| 2011/0052288 | A1* | 3/2011 | Koido | 399/351 |
| 2011/0236095 | A1 | 9/2011 | Aoshima | |

FOREIGN PATENT DOCUMENTS

| | | | |
|---|---|---|---|
| JP | 2009-025451 | A | 2/2009 |
| JP | 2012-150203 | A | 8/2012 |
| WO | 2011/125824 | A1 | 10/2011 |

* cited by examiner $$\theta_a = \tan^{-1}\left(\frac{h_1 + h_2 + h_3 + \cdots + h_n}{L}\right)$$

CLEANING BLADE, METHOD FOR MANUFACTURING CLEANING BLADE, PROCESS CARTRIDGE, AND ELECTROPHOTOGRAPHIC APPARATUS

BACKGROUND OF THE INVENTION

1. Field of the Invention

The present invention relates to a cleaning blade, a method for manufacturing the cleaning blade, and a process cartridge and an electrophotographic apparatus each including the cleaning blade.

2. Description of the Related Art

In general, even after a toner image formed on a surface (outer peripheral surface) of an electrophotographic photosensitive member (hereinafter also referred to simply as a "photosensitive member") is transferred to a transfer medium or an intermediate transfer member or even after the toner image is further transferred from the intermediate transfer member to a transfer medium, a portion of toner tends to remain on the photosensitive member and/or the intermediate transfer member. Thus, residual toner on the photosensitive member or the intermediate transfer member must be removed, for example, with a cleaning blade. An existing cleaning blade may be of a plate-like shape and may have a thickness of 1 mm or more and 3 mm or less. The longitudinal length of a face of the existing cleaning blade opposite a member to be cleaned (such as a photosensitive member or an intermediate transfer member) may be greater than the thickness.

A cleaning blade may be fixed to a metallic holder in an electrophotographic apparatus such that an edge (front ridgeline) of the cleaning blade comes into contact with a member to be cleaned.

Urethane rubber is commonly used in cleaning blades because of its high wear resistance and resistance to permanent deformation.

One known toner that has been developed to meet the recent demand for high image quality has a small particle size and a high degree of sphericity (close to spherical). This toner having a small particle size and a high degree of sphericity advantageously has relatively high transfer efficiency and can meet the demand for high image quality.

However, it is difficult to properly remove such a toner having a small particle size and a high degree of sphericity with a cleaning blade from the surface of a member to be cleaned, thus often resulting in faulty cleaning. This is because a toner having a small particle size and a high degree of sphericity more easily slips between the cleaning blade and the member to be cleaned than other toners.

It is effective to increase the contact pressure and reduce the gap between a cleaning blade and a member to be cleaned to prevent the passing of toner.

However, a higher contact pressure between a cleaning blade and a member to be cleaned tends to result in a higher friction force between the cleaning blade and the member to be cleaned. A higher friction force between the cleaning blade and the member to be cleaned increases the likelihood that the cleaning blade is drawn in the movement direction of the surface of the member to be cleaned and the edge of the cleaning blade catches on the surface of the member to be cleaned (turning over). The cleaning blade may make an abnormal noise when the cleaning blade returns to its original position against the drawing force. Continuous cleaning with a cleaning blade having a turned-over edge tends to cause local wear in the vicinity of the edge of the cleaning blade (several to several tens of micrometers separated from the edge). Further continuous cleaning increases the local wear, and consequently toner cannot be properly removed.

From the perspective of extended-life of a cleaning blade and a member to be cleaned and energy conservation, it is necessary to reduce the rotation torque of the member to be cleaned during cleaning (torque reduction). For torque reduction, it is effective to reduce the friction on the surface of a portion of a cleaning blade in contact with a member to be cleaned.

Regarding torque reduction, Japanese Patent Laid-Open No. 2008-268670 discloses a technique for including fine particles having an average particle diameter of 3 μm or less in a surface layer of a urethane rubber (urethane elastomer) cleaning blade that comes into contact with a member to be cleaned.

Japanese Patent Laid-Open No. 2012-150203 discloses a technique for providing a contact portion of a cleaning blade that comes into contact with a member to be cleaned with a surface layer having higher hardness than a base layer of the cleaning blade.

Japanese Patent Laid-Open No. 2009-025451 discloses a technique for continuously increasing the nitrogen concentration of a contact portion of a cleaning blade that comes into contact with a member to be cleaned from the interior to the surface of the contact portion.

Japanese Patent Laid-Open No. 2001-075451 discloses a technique for increasing the isocyanurate group concentration on the surface of an edge of a urethane rubber (urethane elastomer) cleaning blade as compared with the isocyanurate group concentration of the interior of the edge.

However, studies of the present inventors showed that these techniques of the related art have the following problems.

In such a two-layer cleaning blade having a surface layer and a base layer as described in Japanese Patent Laid-Open Nos. 2008-268670 and 2012-150203, the surface layer and the base layer behave differently when the cleaning blade is in contact with a member to be cleaned. Thus, the surface layer sometimes peeled off or chipped because of concavities and convexities (typically 1 μm or more and 2 μm or less) or foreign substances (including toner) on the surface of a member to be cleaned. In the technique described in Japanese Patent Laid-Open No. 2008-268670, it is difficult to uniformly disperse the fine particles in the surface layer. Non-uniform dispersion of the fine particles sometimes caused variations in characteristics in a contact portion, local chipping, or faulty cleaning.

The technique described in Japanese Patent Laid-Open No. 2009-025451 increases the cross-linking concentration on the surface of a contact portion of a urethane rubber (urethane elastomer) cleaning blade that comes into contact with a member to be cleaned to form a hard segment. However, the technique sometimes insufficiently reduced the torque.

The technique described in Japanese Patent Laid-Open No. 2001-075451 involves applying a liquid mixture of an isocyanate compound and an isocyanurating catalyst to an inner surface of a die to increase the isocyanurate group concentration on the surface of a urethane rubber (urethane elastomer) cleaning blade. An increase in the isocyanurate group concentration to achieve substantially constant hardness and a sufficient torque reduction in the vicinity of the surface of the cleaning blade sometimes resulted in poor adaptability to concavities and convexities or foreign substances on the surface of a member to be cleaned. Poor adaptability to concavities and convexities or foreign substances on the surface of a member to be cleaned tends to result in the passing of toner.

In these techniques of the related art, a cleaning blade often has insufficient adaptability to toner particles or particles having the size of toner particles between the cleaning blade and a member to be cleaned. More specifically, a contact portion of a cleaning blade that comes into contact with a member to be cleaned sometimes changed its shape at a very large curvature radius on a particle between the cleaning blade and the member to be cleaned. Thus, toner particles around the particle sometimes passed between the cleaning blade and the member to be cleaned.

SUMMARY OF THE INVENTION

The present invention provides a cleaning blade that causes reduced friction with a member to be cleaned and has good adaptability to concavities and convexities or foreign substances on the surface of the member to be cleaned. The present invention also provides a method for manufacturing the cleaning blade. The present invention also provides a process cartridge and an electrophotographic apparatus each including such a cleaning blade.

The present invention provides a urethane rubber cleaning blade configured to come into contact with a member to be cleaned and clean a surface of the member to be cleaned, wherein a surface of a contact portion of the cleaning blade that comes into contact with the member to be cleaned has a Young's modulus ($Y_0$) of 10 mgf/μm$^2$ or more and 400 mgf/μm$^2$ or less, the ratio ($Y_{50}/Y_0$) of the Young's modulus ($Y_{50}$) of an internal portion of the cleaning blade 50 μm spaced apart from the surface of the contact portion to the Young's modulus ($Y_0$) is 0.5 or less, and the average rate of change in Young's modulus [$\{(Y_0-Y_{20})/Y_0\}/(20-0)$] from the surface of the contact portion to an internal portion of the cleaning blade 20 μm spaced apart from the surface of the contact portion is greater than or equal to the average rate of change in Young's modulus [$\{(Y_{20}-Y_{50})/Y_0\}/(50-20)$] from the internal portion of the cleaning blade 20 μm spaced apart from the surface of the contact portion to the internal portion of the cleaning blade 50 μm spaced apart from the surface of the contact portion, wherein $Y_0$ denotes the Young's modulus of the surface of the contact portion, and $Y_{20}$ and $Y_{50}$ denote the Young's modulus of the internal portion of the cleaning blade 20 and 50 μm spaced apart from the surface of the contact portion, respectively.

The present invention also provides a process cartridge detachably attached to a main body of an electrophotographic apparatus, the process cartridge being configured to integrally support the cleaning blade and an electrophotographic photosensitive member, which is a member to be cleaned with the cleaning blade.

The present invention also provides an electrophotographic apparatus that includes the cleaning blade and an electrophotographic photosensitive member and/or an intermediate transfer member, which is a member to be cleaned with the cleaning blade.

The present invention also provides a method for manufacturing the cleaning blade, wherein the urethane rubber is a polyester urethane rubber. The method includes (a) mixing a polyisocyanate, an aliphatic polyester polyol, and a urethane-forming catalyst to produce a mixture, the number of moles of the aliphatic polyester polyol being 30% or more and 40% or less of the number of moles of the polyisocyanate, (b) applying an isocyanurating catalyst to an inner surface of a die, and (c) charging the mixture produced in (a) into the die coated with the isocyanurating catalyst in (b) and heating the die.

The present invention provides a cleaning blade that causes reduced friction with a member to be cleaned and has good adaptability to concavities and convexities or foreign substances on the surface of the member to be cleaned. The present invention also provides a method for manufacturing the cleaning blade. The present invention also provides a process cartridge and an electrophotographic apparatus each including the cleaning blade.

Further features of the present invention will become apparent from the following description of exemplary embodiments with reference to the attached drawings.

BRIEF DESCRIPTION OF THE DRAWINGS

FIG. 11 is a schematic view illustrating a method for calculating an average inclination angle θa.

DESCRIPTION OF THE EMBODIMENTS

Figure 1A:
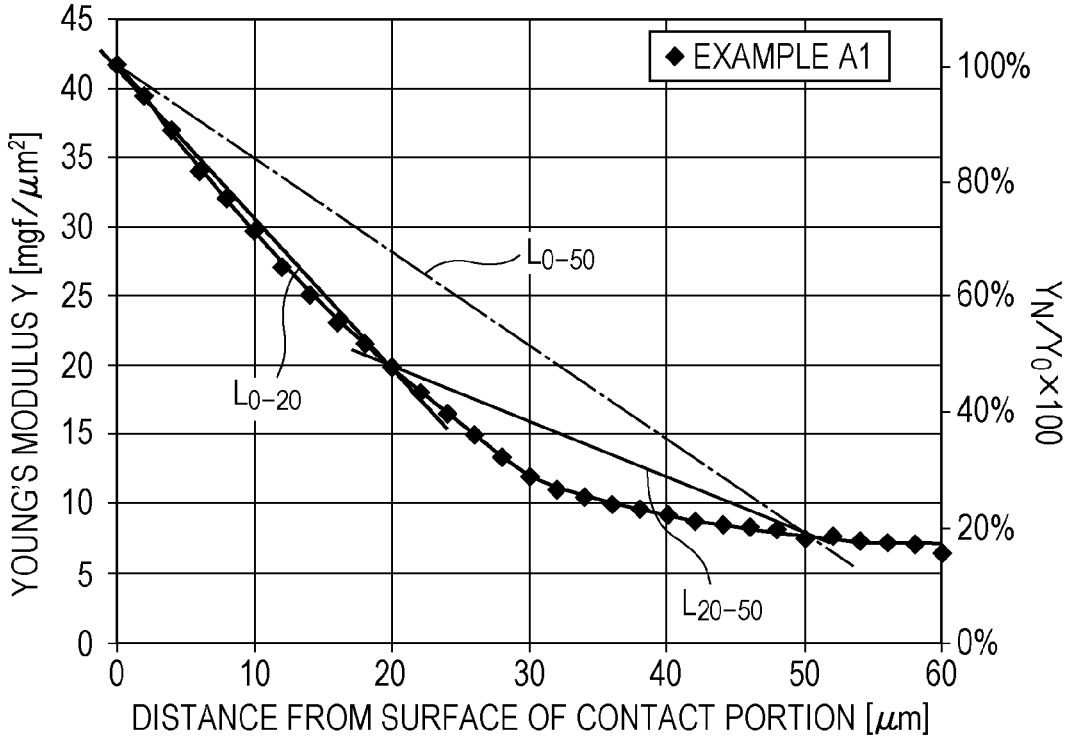
FIGS. 1A and 1B are graphs showing the results for Example A1.

As a result of extensive studies, the present inventors found that a cleaning blade that has a low-friction surface at a contact portion thereof that comes into contact with a member to be cleaned (hereinafter also referred to as a "contact portion of a cleaning blade" or simply as a "contact portion") and good adaptability to concavities and convexities or foreign substances on the surface of the member to be cleaned (hereinafter also referred to simply as "adaptability to concavities and convexities or foreign substances") and rarely chips at an edge thereof can be manufactured by appropriately controlling the Young's moduli of the surface and interior of the contact portion.

More specifically, the Young's modulus ($Y_0$) of the surface of the contact portion of the cleaning blade may be 10 mgf/$\mu m^2$ or more to reduce the friction on the surface of the contact portion of the cleaning blade. The contact portion of the cleaning blade becomes resistant to deformation.

A plausible reason for the reduced friction on the surface of the contact portion of the cleaning blade is probably a decrease in the number of microscopic contact points (real contact area) involved in friction between the cleaning blade and a member to be cleaned. The reduced friction on the surface of the contact portion of the cleaning blade and the increased resistance to deformation of the contact portion of the cleaning blade prevent (an edge of) the cleaning blade from being turned over. The reduced friction on the surface of the contact portion of the cleaning blade and the increased resistance to deformation of the contact portion of the cleaning blade also make it easier to maintain a high cleaning angle β described below. They also stabilize the width of the contact portion of the cleaning blade. This can prevent the cleaning blade from chattering or making an abnormal noise.

The Young's modulus of a contact portion of a urethane rubber cleaning blade can be effectively increased by controlling the molecular structure of the urethane rubber at the contact portion.

Urethane rubber can be synthesized using a polyisocyanate, a polyol, a chain extender (for example, a polyfunctional polyol), and a urethane rubber synthesis catalyst.

In the synthesis of a polyester urethane rubber, the polyol may be a polyester polyol. In the synthesis of an aliphatic polyester urethane rubber, the polyol may be an aliphatic polyester polyol.

More specifically, the Young's modulus of a contact portion of a urethane rubber cleaning blade can be increased by altering the degree of cross-linkage of the urethane rubber or controlling the molecular weight of a raw material of the urethane rubber. In one suitable method, the Young's modulus of a contact portion of a urethane rubber cleaning blade can be increased by increasing the isocyanurate group concentration of the urethane rubber. The isocyanurate group of the urethane rubber can be derived from a polyisocyanate, which is a raw material of the urethane rubber.

A cleaning blade according to an embodiment of the present invention may be a cleaning blade made of a urethane rubber having an isocyanurate group. It is easy to control the Young's modulus of the surface of a contact portion of a cleaning blade made of a urethane rubber having an isocyanurate group. The Young's modulus of the surface of a contact portion of such a cleaning blade can be increased by increasing the isocyanurate group content of the surface (and the vicinity thereof) of the urethane rubber at the contact portion. More specifically, in the case of a polyester urethane rubber, the IR spectrum of the surface of the polyester urethane rubber at a contact portion is measured using a μATR method. The ratio ($I_{SI}/I_{SE}$) of the C—N peak intensity ($I_{SI}$) derived from an isocyanurate group to the C═O peak intensity ($I_{SE}$) derived from an ester group in the polyester urethane rubber may be 0.50 or more. The C—N peak appears at 1411 $cm^{-1}$, and the C═O peak appears at 1726 $cm^{-1}$. The ratio ($I_{SI}/I_{SE}$) is based on the C═O peak intensity derived from an ester group, which is not affected by the amount of isocyanurate group. The amount of isocyanurate group can be qualitatively determined from the ratio ($I_{SI}/I_{SE}$) by comparing the C—N peak intensity derived from the isocyanurate group with the reference.

Figure 4A:
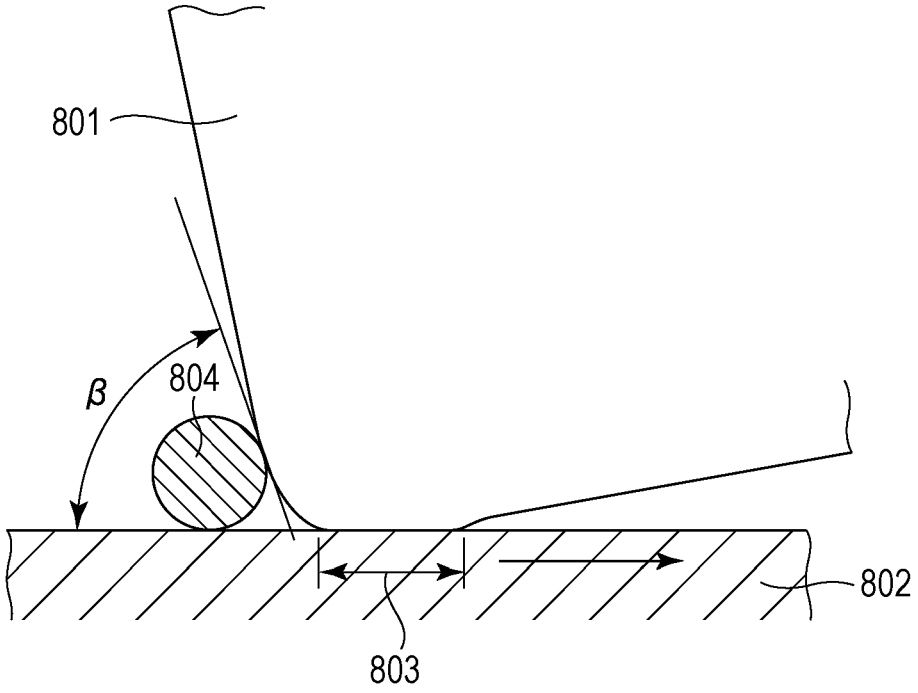
FIGS. 4A and 4B are schematic views of a contact portion between a cleaning blade and a member to be cleaned and the vicinity thereof.
Figure 4B:
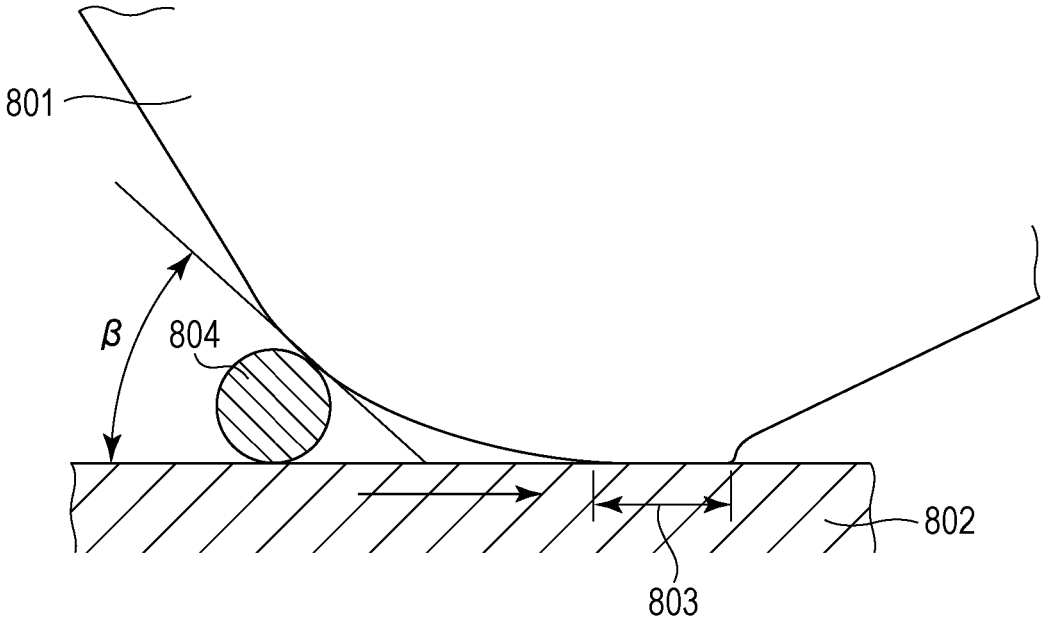

FIGS. 4A and 4B are schematic views of a contact portion between a cleaning blade and a member to be cleaned and the vicinity thereof.

A contact portion 803 of a cleaning blade 801 is in contact with a member to be cleaned 802 at a predetermined contact pressure at a cleaning angle β. The prevention of a toner particle from moving into a wedge-shaped portion behind the contact portion 803 depends on the contact pressure and the cleaning angle β. A higher cleaning angle β results in the blockage of the toner particle at a lower contact pressure. The cleaning angle β is higher and the toner particle is more strongly blocked in FIG. 4A than in FIG. 4B.

As illustrated in FIGS. 4A and 4B, the load applied to the cleaning blade 801 in the movement direction of the surface of the member to be cleaned 802 (in the direction of an arrow in FIGS. 4A and 4B) acts as a load that causes the contact portion of the cleaning blade to be deformed.

Figure 5A:
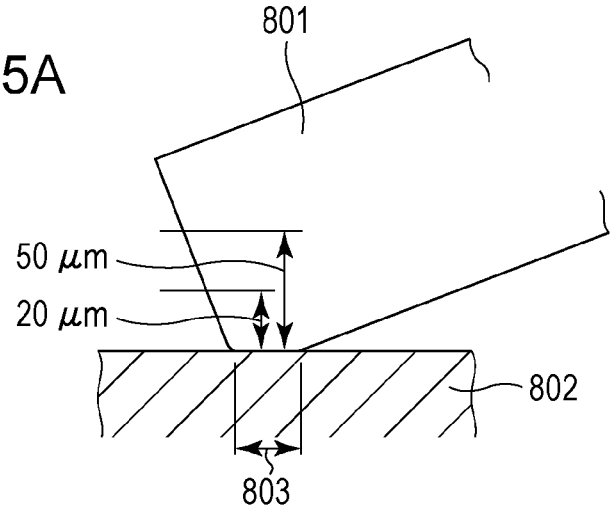
FIGS. 5A to 5C are schematic views of a cleaning blade in contact with a member to be cleaned.
Figure 5B:
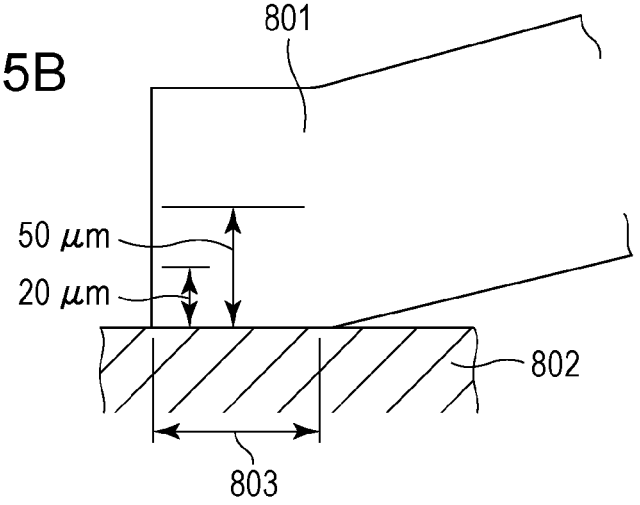
Figure 5C:
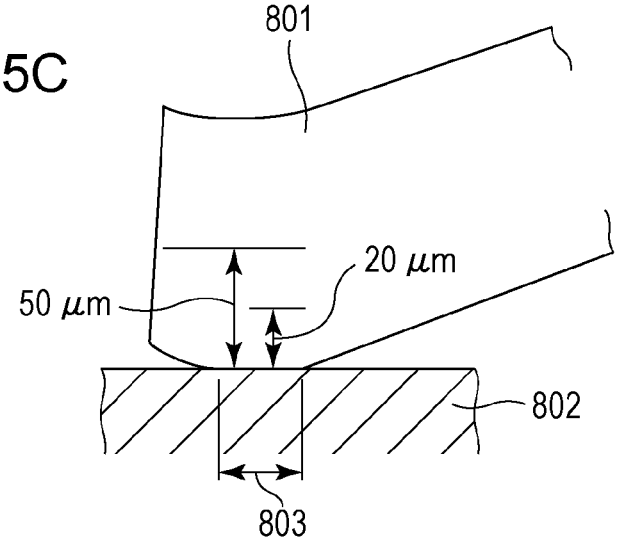

FIGS. 5A to 5C are schematic views of a cleaning blade in contact with a member to be cleaned.

When a cleaning blade 801 comes into contact with a member to be cleaned 802, an edge of the cleaning blade 801 may come into contact with the member to be cleaned 802, as illustrated in FIG. 5A. Alternatively, as illustrated in FIG. 5C, an edge of the cleaning blade 801 may float in the air, and a face of the cleaning blade 801 opposite the member to be cleaned 802 may come into contact with the member to be cleaned 802. Alternatively, as illustrated in FIG. 5B, there may be an intermediate state between the states illustrated in FIGS. 5A and 5C. In the present invention, in any of these states, a portion of the cleaning blade in contact with the member to be cleaned is referred to as a contact portion.

The surface condition of the contact portion in the longitudinal direction of the cleaning blade or in the movement direction of the surface of the member to be cleaned is not necessarily even because of concavities and convexities or a locally formed image on the surface of the member to be cleaned. For example, when a toner particle 804 is disposed between the contact portion 803 and the member to be cleaned 802 for some reason, the cleaning blade 801 changes its shape and holds the toner particle 804 with the elasticity of the cleaning blade 801. The surface of the cleaning blade 801 tends to follow the shape of the toner particle 804. When the toner particle 804 is disposed between the contact portion 803 of the cleaning blade 801 and the member to be cleaned 802, force is exerted in a direction so as to push the cleaning blade 801 up and in the movement direction of the surface of the member to be cleaned 802 (in the direction of the arrow in FIGS. 4A and 4B).

Figure 6A:
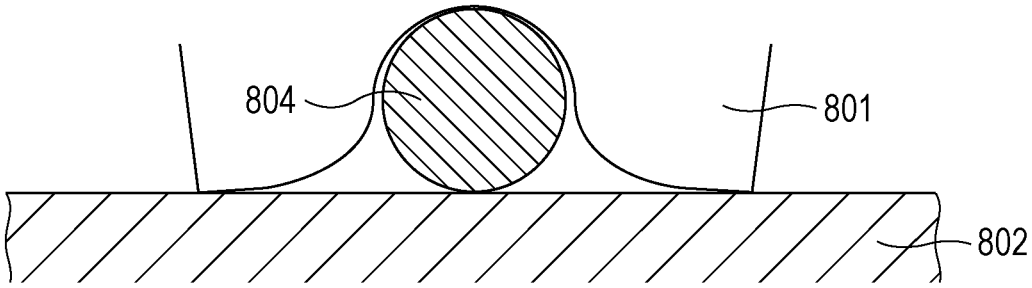
FIGS. 6A and 6B are schematic views of a change in the shape of a cleaning blade when a toner particle is disposed between the cleaning blade and a member to be cleaned.
Figure 6B:
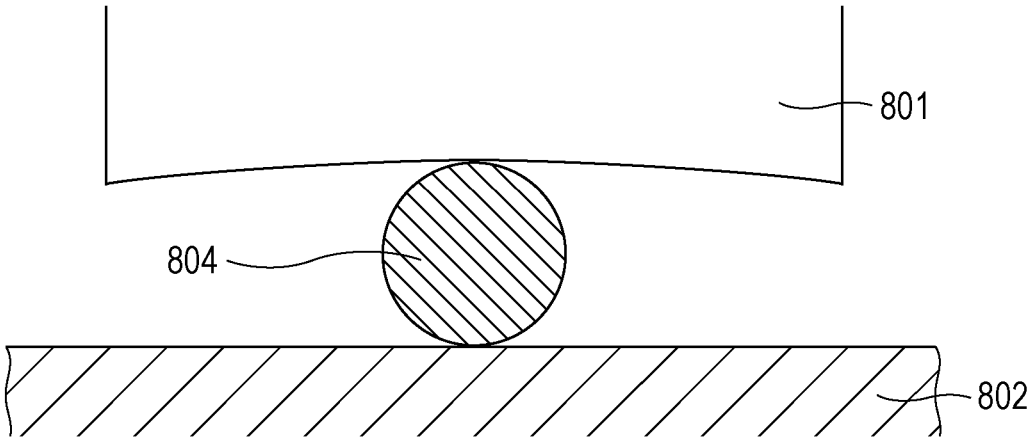

FIGS. 6A and 6B are schematic views of a change in the shape of a cleaning blade when a toner particle (one of foreign substances) is disposed between the cleaning blade and a member to be cleaned. FIGS. 6A and 6B are left side views of FIGS. 4A and 4B.

When the surface of the cleaning blade 801 has a low Young's modulus, the cleaning blade 801 can easily follow the shape of the toner particle 804, as illustrated in FIG. 6A. When the surface of the cleaning blade 801 has an excessively high Young's modulus, it is difficult for the cleaning blade 801 to follow the shape of the toner particle 804. When it is difficult for the cleaning blade 801 to follow the shape of the toner particle 804, not only a portion of the surface of the cleaning blade 801 opposite the toner particle 804 but also a portion of the surface of the cleaning blade 801 opposite the surroundings of the toner particle 804 are pushed up, thereby causing a deformation having a large curvature radius, as illustrated in FIG. 6B. The deformation having a large curvature radius as illustrated in FIG. 6B causes toner particles to pass through an empty space around the toner particle 804. Thus, the Young's modulus ($Y_0$) of the surface of a contact portion of a cleaning blade according to an embodiment of the present invention is 400 mgf/μm$^2$ or less, preferably 344 mgf/μm$^2$ or less, more preferably 250 mgf/μm$^2$ or less.

A cleaning blade according to an embodiment of the present invention is made of a urethane rubber having an isocyanurate group, as described above. In order to reduce the Young's modulus ($Y_0$) of the surface of a contact portion of a urethane rubber cleaning blade to some extent (400 mgf/μm$^2$ or less), the isocyanurate group content of the surface (and the vicinity thereof) of the urethane rubber at the contact portion may be reduced to some extent. More specifically, the ratio ($I_{SI}/I_{SE}$) may be 1.55 or less. In order to reduce the Young's modulus ($Y_0$) to 344 mgf/μm$^2$ or less, the ratio ($I_{SI}/I_{SE}$) may be 1.35 or less. In order to reduce the Young's modulus ($Y_0$) to 250 mgf/μm$^2$ or less, the ratio ($I_{SI}/I_{SE}$) may be 1.20 or less.

Thus, the Young's modulus ($Y_0$) of the surface of a contact portion of a cleaning blade according to an embodiment of the present invention is 10 mgf/μm$^2$ or more and 400 mgf/μm$^2$ or less, preferably 10 mgf/μm$^2$ or more and 344 mgf/μm$^2$ or less, more preferably 10 mgf/μm$^2$ or more and 250 mgf/μm$^2$ or less. In order to achieve the Young's modulus ($Y_0$) of the surface of a contact portion of a cleaning blade in the range of 10 mgf/μm$^2$ or more and 400 mgf/μm$^2$ or less, the ratio ($I_{SI}/I_{SE}$) may be 0.50 or more and 1.55 or less. In order to achieve the Young's modulus ($Y_0$) of 10 mgf/μm$^2$ or more and 344 mgf/μm$^2$ or less, the ratio ($I_{SI}/I_{SE}$) may be 0.50 or more and 1.35 or less. In order to achieve the Young's modulus ($Y_0$) of 10 mgf/μm$^2$ or more and 250 mgf/μm$^2$ or less, the ratio ($I_{SI}/I_{SE}$) may be 0.50 or more and 1.20 or less.

The surface of a contact portion of a cleaning blade according to an embodiment of the present invention has a moderately high Young's modulus (10 mgf/μm$^2$ or more and 400 mgf/μm$^2$ or less), and the Young's modulus decreases from the surface of the contact portion to the interior of the cleaning blade. More specifically, the ratio ($Y_{50}/Y_0$) of the Young's modulus ($Y_{50}$) of an internal portion of the cleaning blade 50 μm spaced apart from the surface of the contact portion of the cleaning blade to the Young's modulus ($Y_0$) is 0.5 or less (preferably 0.2 or less). Even when the Young's modulus of the surface of the contact portion increases to some extent, such a cleaning blade has good adaptability to concavities and convexities or foreign substances. When the ratio ($Y_{50}/Y_0$) is 0.5 or less (preferably 0.2 or less), the cleaning blade can easily maintain a high cleaning angle β and satisfactorily block toner.

When a cleaning blade has a Young's modulus ($Y_0$) of 10 mgf/μm$^2$ or more and 400 mgf/μm$^2$ or less and a ratio ($Y_{50}/Y_0$) of 0.5 or less, the Young's modulus markedly decreases from the surface of a contact portion of the cleaning blade to the interior of the cleaning blade.

Studies of the present inventors showed that the chipping of a cleaning blade tends to occur at a point of stress concentration in the cleaning blade. The present inventors also found that stress concentration tends to occur at an interface between layers in a cleaning blade composed of a plurality of layers having different Young's moduli or at a point at which the Young's modulus changes markedly.

As described above, the Young's modulus of a cleaning blade according to an embodiment of the present invention decreases markedly from the surface of a contact portion to the interior of the cleaning blade and decreases particularly markedly in the vicinity of the surface of the contact portion. More specifically, the average rate of change in Young's modulus from the surface of a contact portion to an internal portion of a cleaning blade 20 μm spaced apart from the surface is greater than or equal to the average rate of change in Young's modulus from an internal portion of the cleaning blade 20 μm spaced apart from the surface to an internal portion of the cleaning blade 50 μm spaced apart from the surface. The average rate of change in Young's modulus from the surface of a contact portion to an internal portion of a cleaning blade 20 μm spaced apart from the surface is calculated from $[\{(Y_0-Y_{20})/Y_0\}/(20-0)]$, wherein $Y_{20}$ denotes the Young's modulus of the internal portion of the cleaning blade 20 μm spaced apart from the surface of the contact portion of the cleaning blade. The average rate of change in Young's modulus from an internal portion of a cleaning blade 20 μm spaced apart from the surface to an internal portion of the cleaning blade 50 μm spaced apart from the surface is calculated from $[\{(Y_{20}-Y_{50})/Y_0\}/(50-20)]$. Such a structure can prevent the chipping of a cleaning blade even when the Young's modulus decreases markedly from the surface of a contact portion to the interior (an internal portion 50 μm spaced apart from the surface of the contact portion). Such a structure also has good adaptability to concavities and convexities or foreign substances on the surface of a member to be cleaned. This is probably because deformation stress is dispersed by markedly decreasing the Young's modulus in the vicinity of the surface under high deformation stress and gradually decreasing the Young's modulus in the interior.

The average rate of change in Young's modulus from the surface of a contact portion to an internal portion 20 μm spaced apart from the surface $[\{(Y_0-Y_{20})/Y_0\}/(20-0)]$ is hereinafter also referred to as "$Y\Delta_{0-20}$". The average rate of change in Young's modulus from an internal portion 20 μm spaced apart from the surface to an internal portion 50 μm spaced apart from the surface $[\{(Y_{20}-Y_{50})/Y_0\}/(50-20)]$ is hereinafter also referred to as "$\Delta Y_{20-50}$". Thus, a cleaning blade according to an embodiment of the present invention satisfies $\Delta Y_{0-20} \geq \Delta Y_{20-50}$.

As described above, in a cleaning blade according to an embodiment of the present invention, the ratio ($Y_{50}/Y_0$) of Young's modulus ($Y_{50}$) to Young's modulus ($Y_0$) is 0.5 or less. The ratio ($Y_{20}/Y_0$) of Young's modulus ($Y_{20}$) to Young's modulus ($Y_0$) may be 0.5 or less. Such a cleaning blade has good adaptability to concavities and convexities or foreign substances on the surface of a member to be cleaned.

On a plane defined by a horizontal axis representing the distance from a surface of a contact portion of a cleaning blade (the surface of the contact portion is taken as the distance of 0 μm) and a vertical axis representing Young's modulus, the Young's modulus ($Y_N$) ($0<N<50$ [μm]) at a position between the surface of the contact portion and an internal portion of the cleaning blade 50 μm spaced apart from the surface (a position N [μm] spaced apart from the surface of the contact portion) may be lower than a straight line between the Young's modulus ($Y_0$) and the Young's modulus ($Y_{50}$). This means that a change in Young's modulus from the surface of the contact portion to the interior of the cleaning blade forms a convex downward curve. Such a cleaning blade has good adaptability to concavities and convexities or foreign substances on the surface of a member to be cleaned.

Figure 7A:
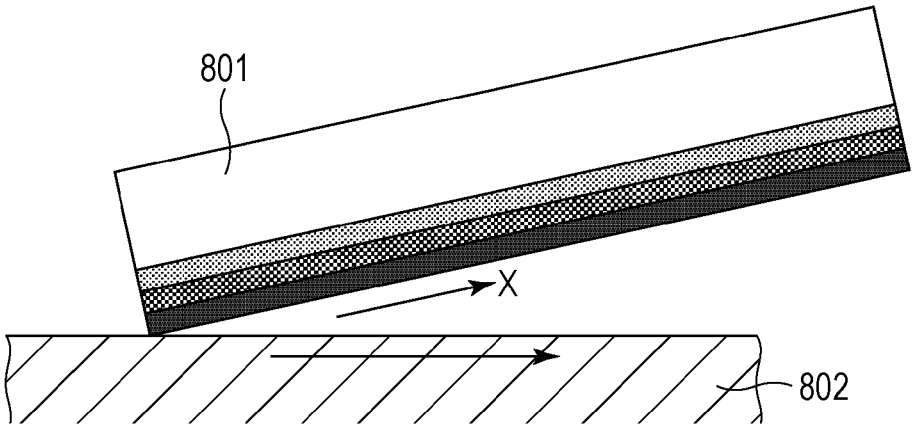
FIG. 7A is a schematic view of a cleaning blade in which differences in Young's modulus are shown by shading.
Figure 7B:
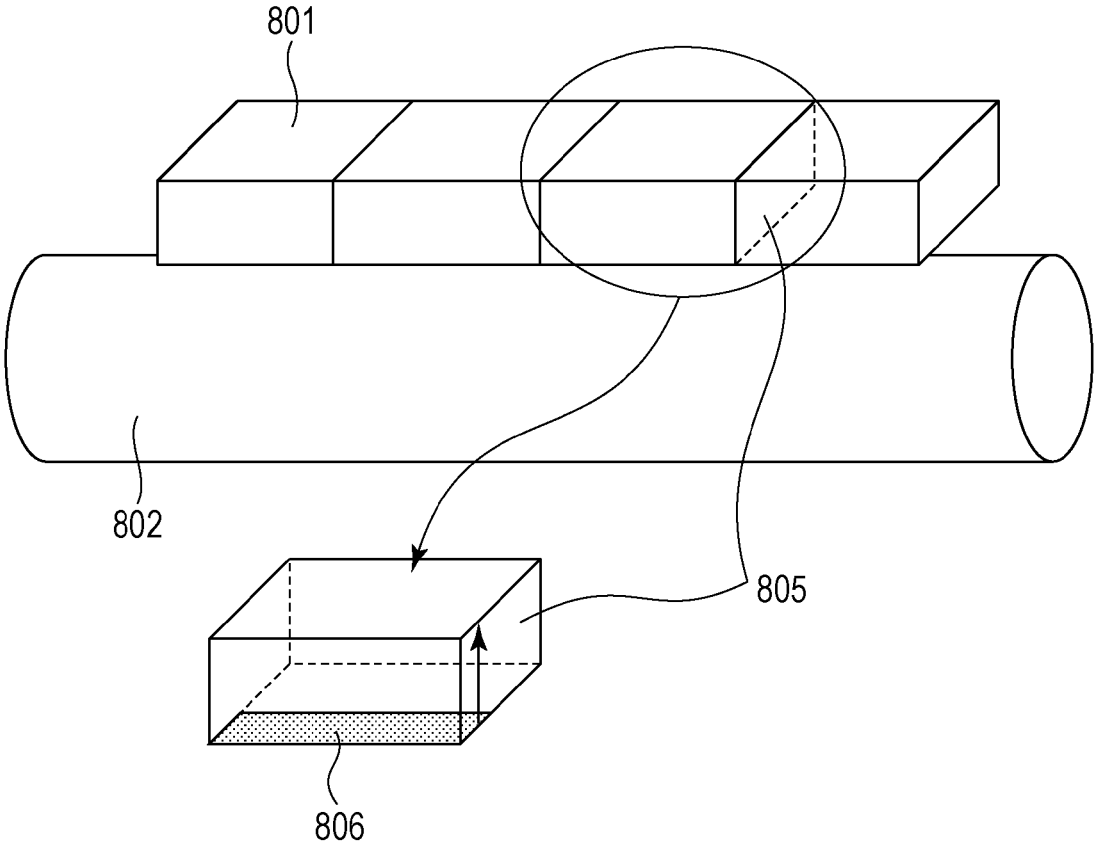
FIG. 7B is a schematic view of a portion where the Young's modulus of a cleaning blade is measured.

FIG. 7A is a schematic view of a cleaning blade in which differences in Young's modulus are shown by shading. FIG. 7B is a schematic view of a portion where the Young's modulus of a cleaning blade is measured. A load that causes a contact portion of a cleaning blade to be deformed becomes a stress in a direction along a face of the cleaning blade opposite a member to be cleaned (a direction of an arrow X in FIG. 7A). In FIG. 7A, a deeper color indicates a higher Young's modulus. Although the Young's modulus changes stepwise in FIG. 7A for convenience of explanation, the Young's modulus of a cleaning blade may change continuously.

The Young's modulus of cleaning blade may change continuously rather than stepwise. A continuous change means the absence of an interface between portions having different Young's moduli that is responsible for peeling or chipping.

In a cleaning blade according to an embodiment of the present invention, a surface region of the cleaning blade deals with local (microscopic) deformation in the vicinity of the surface of a contact portion of the cleaning blade, such as adaptability to concavities and convexities or foreign substances on the surface of a member to be cleaned or the prevention of chipping in an edge of the cleaning blade. The term "surface region" of a cleaning blade, as used herein, refers to a region in which the Young's modulus of the cleaning blade decreases from the surface of a contact portion to the interior of the cleaning blade. On the other hand, an internal region of a cleaning blade may deal with the overall (macroscopic) characteristics, such as overall bending or variations in characteristics due to variations in temperature, of the cleaning blade.

The term "internal region", as used herein, refers to a region within the surface region. The surface region of a cleaning blade may have a thickness of not more than half the thickness of the cleaning blade.

The width of a contact portion or a nip portion between a cleaning blade and a member to be cleaned generally ranges from several tens to a hundred micrometers. Thus, the surface region may be 2 mm or more from an edge of a cleaning blade.

A cleaning blade may be supported by bonding the cleaning blade to a supporting member or placing the cleaning blade between a plurality of supporting members. Alternatively, a cleaning blade may be supported by forming the cleaning blade at the tip of a supporting member (part of the cleaning blade serves as a supporting portion).

A cleaning blade according to an embodiment of the present invention is a urethane rubber cleaning blade, as described above. Among urethane rubbers, a polyester urethane rubber, particularly an aliphatic polyester urethane rubber, has a high mechanical strength, such as wear resistance, and high resistance to permanent deformation due to contact pressure (creep resistance).

The Young's modulus of a contact portion of a urethane rubber cleaning blade can be effectively controlled as described above by controlling the molecular structure of the urethane rubber.

A urethane rubber can be synthesized using a polyisocyanate, a high-molecular-weight polyol, a chain extender (for example, a polyfunctional low-molecular-weight polyol), and a urethane rubber synthesis catalyst. The polyol may be a polyester polyol in the synthesis of a polyester urethane rubber or an aliphatic polyester polyol in the synthesis of an aliphatic polyester urethane rubber.

More specifically, the Young's modulus of a contact portion of a urethane rubber cleaning blade can be controlled as described above by altering the degree of cross-linkage of the urethane rubber or controlling the molecular weight of a raw material of the urethane rubber. In particular, the isocyanurate group concentration derived from a polyisocyanate, which is a raw material of the urethane rubber, may be increased from the interior to the surface of the urethane rubber in order to improve the precision with which the Young's modulus is controlled.

A urethane rubber having an isocyanurate group (isocyanurate bond) can more easily maintain a high cleaning angle β than a urethane rubber having no isocyanurate group even when these urethane rubbers have substantially the same hardness (for example, international rubber hardness degrees).

Examples of the polyisocyanate include 4,4'-diphenylmethane diisocyanate (MDI, 4,4'-MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide-modified MDI, and polymethylene polyphenyl isocyanate (PAPI). The polyisocyanate may be 4,4'-diphenylmethane diisocyanate.

Examples of the high-molecular-weight polyol (aliphatic polyester polyol) include ethylene butylene adipate polyester polyols, butylene adipate polyester polyols, hexylene adipate polyester polyols, and lactone polyester polyols. These polyols may be used alone or in combination. Butylene adipate polyester polyols and hexylene adipate polyester polyols have high crystallinity. A higher crystallinity of an aliphatic polyester polyol results in a higher hardness of the resulting polyester urethane rubber (polyester urethane rubber cleaning blade) and higher endurance of the cleaning blade.

The high-molecular-weight polyol preferably has a number-average molecular weight of 1500 or more and 4000 or less, more preferably 2000 or more and 3500 or less. A higher number-average molecular weight of the polyol results in a higher hardness, elastic coefficient, and tensile strength of the resulting urethane rubber (urethane rubber cleaning blade). A lower number-average molecular weight of the polyol results in a lower viscosity and higher handleability.

The chain extender (a polyfunctional low-molecular-weight polyol) may be a glycol. Examples of the glycol include ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylylene glycol (terephthalyl alcohol), and triethylene glycol. The chain extender other than glycols may be a trivalent or higher valent polyhydric alcohol. Examples of the trivalent or higher valent polyhydric alcohol include trimethylolpropane, glycerin, pentaerythritol, and sorbitol. These glycols and polyhydric alcohols may be used alone or in combination.

The urethane rubber synthesis catalyst is broadly divided into a urethane-forming catalyst (reaction promoting catalyst) for promoting rubberizing (resinification) or foaming and an isocyanurating catalyst (isocyanate trimerization catalyst). These catalysts may be used alone or in combination.

Examples of the urethane-forming catalyst include tin catalysts, such as dibutyltin dilaurate and stannous octoate, and amine catalysts, such as triethylenediamine, tetramethylguanidine, pentamethyldiethylenetriamine, dimethylimidazole, tetramethylpropanediamine, and N,N,N'-trimethylaminoethylethanolamine. These urethane-forming catalysts may be used alone or in combination. Triethylenediamine has high reactivity.

Examples of the isocyanurating catalyst include metal oxides such as $Li_2O$ and $(Bu_2Sn)_2O$; hydride compounds such as $NaBH_4$; alkoxide compounds such as $NaOCH_2$, KO-(t-Bu), and borates; amine compounds such as $N(C_2H_5)_2$, $N(CH_2)_2CH_2C_2H_5$, and $N_2C_6H_{12}$; alkaline carboxylate salt compounds such as $HCO_2Na$, $CO_2Na_2$, $PhCO_2Na$/DMF, $CH_2CO_2K$, $(CH_2CO)_2Ca$, alkaline soaps, and naphthenic acid salts; alkali formate salt compounds; and quaternary ammonium salt compounds such as $((R^1)_3—NR^2OH)—OOCR^3$. Examples of a combined catalyst include a combination catalyst, such as amine/epoxide, amine/carboxylic acid, and amine/alkylene imide. In the present invention, these isocyanurating catalysts may be used as a mixture.

N,N,N'-trimethylaminoethylethanolamine serves as both a urethane-forming catalyst and an isocyanurating catalyst.

If necessary, an additive agent, such as a pigment, a plasticizer, a waterproofing agent, an antioxidant, an ultraviolet absorber, or a light stabilizer, may also be used.

The present inventors found that the isocyanurate group distribution can be controlled as described above by synthesizing a urethane rubber as described below. That is, a urethane rubber is synthesized by using an aliphatic polyester polyol as a polyol, applying an isocyanurating catalyst to an inner surface of a die, and charging the die with raw materials containing a polyisocyanate and the aliphatic polyester polyol at a particular ratio.

The isocyanurating catalyst applied to the inner surface of the die promotes the isocyanuration of part of the raw materials in contact with the inner surface of the die. Thus, an excessive amount of polyisocyanate relative to the amount of aliphatic polyester polyol may be used. A urethane rubber having an isocyanurate group distribution controlled as described above is synthesized by the action of the isocyanurating catalyst applied to the inner surface of the die and the die temperature on the excessive amount of polyisocyanate.

The number of moles of the aliphatic polyester polyol may be 30% or more and 40% or less of the number of moles of the polyisocyanate. A smaller number of moles of the aliphatic polyester polyol results in a greater effect of the excessive amount of polyisocyanate and facilitates the control of the Young's modulus ($Y_0$) of the surface of a contact portion of a cleaning blade in the range of 10 mgf/$\mu m^2$ or more. On the other hand, suppressing the excessive amount of polyisocyanate to some extent facilitates the control of the Young's modulus ($Y_0$) of the surface of a contact portion of a cleaning blade in the range of 400 mgf/$\mu^2$ or less.

The die temperature is preferably 80° C. or more and 150° C. or less, more preferably 100° C. or more and 130° C. or less. When the raw materials in the die are allowed to react to synthesize a urethane rubber, the die temperature may be increased to increase the reaction rate. However, a higher die temperature tends to result in a smaller difference in Young's modulus between the surface and the interior of a contact portion.

In addition to the method described above, a cleaning blade may also be manufactured by charging a drum-shaped die with a liquid and forming the cleaning blade under centrifugal force (a centrifugation method) or by charging a belt or groove die with a liquid and forming the cleaning blade (a cast press method).

In order to reduce friction, a cleaning blade according to an embodiment of the present invention may have concavities and convexities such that the average inclination angle θa on the surface of a contact portion of the cleaning blade (hereinafter also referred to as a "surface C") is 1 degree or more. When the average inclination angle θa on the surface C of a cleaning blade is 1 degree or more, this results in a small real contact area between the cleaning blade and a member to be cleaned and low friction.

When a cleaning blade has concavities and convexities having an average inclination angle θa of 1 degree or more on the surface C thereof, it is necessary to prevent the cleaning objective toner from passing through the concavities and convexities. To this end, the 10-point roughness average Rz on the surface C of a cleaning blade may be 10 μm or less.

An average inclination angle θa of 1 degree or more on the surface C of a cleaning blade may be achieved by forming concavities and convexities on a surface of a die corresponding to the surface C such that the average inclination angle θa on the surface C is 1 degree or more and transferring the shape of the concavities and convexities to the surface C. The concavities and convexities on the surface of the die may be formed by etching, abrasive blasting, shot peening, laser processing, electrical discharge machining, microimprint, or nanoimprint.

A cleaning blade according to an embodiment of the present invention may be used in a "counter" form. In the "counter" form, the cleaning blade is arranged in the counter direction with respect to the rotation direction of a member to be cleaned (the movement direction of the surface of the member to be cleaned) during the image-forming period. A cleaning blade according to an embodiment of the present invention may also be used in a "with" form. In the "with" form, the cleaning blade is arranged in the "with" direction with respect to the rotation direction of a member to be cleaned (the movement direction of the surface of the member to be cleaned) during the image-forming period. In the "with" form, it is easy to maintain an appropriate wedge shape and contact pressure between the surface of a member to be cleaned and the tip of a cleaning blade. An appropriate wedge shape and contact pressure result in good adaptability to concavities and convexities or foreign substances, high cleaning performance, and a low rotation torque of a member to be cleaned.

The "counter" form and the "with" form will be described below.

Cleaning in "Counter" Form

Figure 12A:
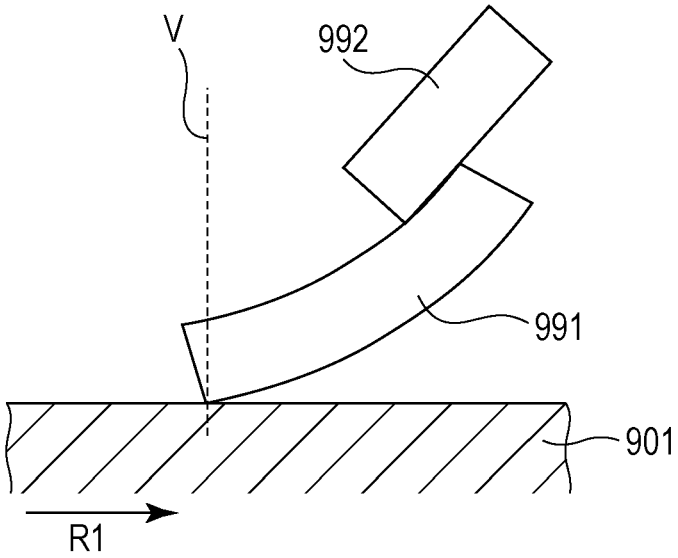
FIGS. 12A and 12B are schematic views of the contact state of a cleaning blade in a "counter" form and a "with" form, respectively.
Figure 12B:
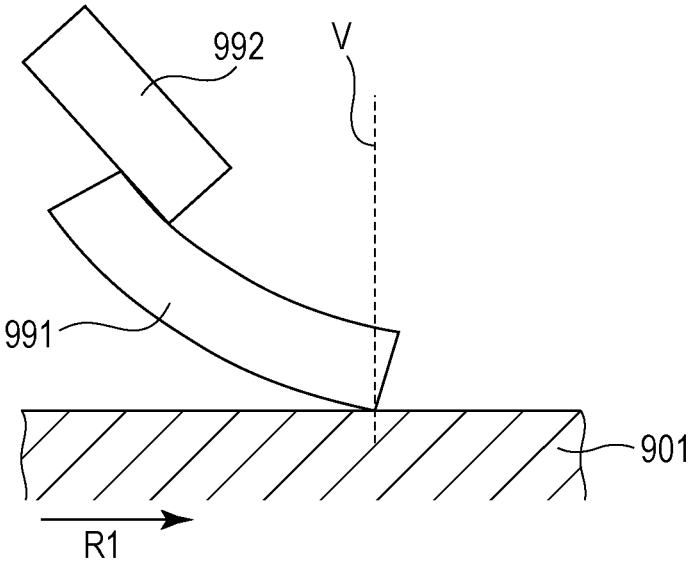

FIGS. 12A and 12B are schematic views of the contact state of a cleaning blade in the "counter" form and the "with" form, respectively.

In the "counter" form, as illustrated in FIG. 12A, a supporting member 992 for a cleaning blade is disposed on the downstream side of a contact portion in the movement direction of the surface of a member to be cleaned (hereinafter also referred to simply as the "downstream side"). In FIG. 12A, R1 denotes the movement direction of the surface of the member to be cleaned, and the dotted line V denotes a line perpendicular to the surface of the member to be cleaned at the contact portion. The supporting member 992 is disposed on the downstream side of the dotted line V.

In the "counter" form, a friction force between a cleaning blade and a member to be cleaned is exerted in a direction so as to compress the entire cleaning blade. This increases the pressure exerted on the tip of the cleaning blade, and the increased pressure further increases the friction force. An increase in friction force between the cleaning blade and the member to be cleaned results in an increase in contact force, which tends to cause a further increase in friction force. Thus, the contact force and the friction force tend to increase abnormally. In such a situation, the tip of the cleaning blade is drawn in the downstream direction and then returns to its original state. The cleaning blade tends to repeat such movements. The repeated movements sometimes make an abnormal noise. The abnormal noise is often made at the time of starting or stopping the member to be cleaned. While the cleaning blade is left making an abnormal noise, the tip of the cleaning blade may be turned over in the downstream direction.

Figure 13A:
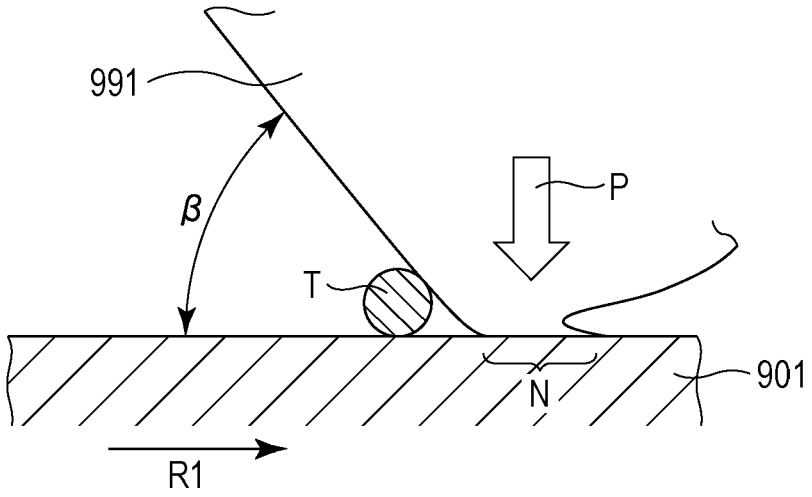
FIGS. 13A and 13B are schematic views of the state of the vicinity of a contact portion in the "counter" form and the "with" form, respectively.
Figure 13B:
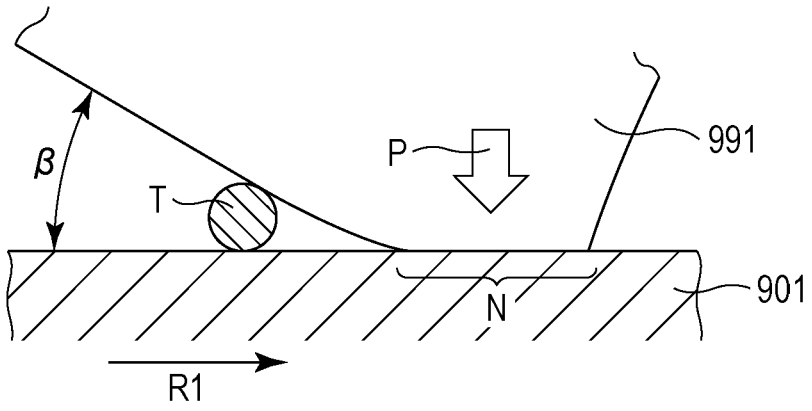

FIGS. 13A and 13B are schematic views of the state of the vicinity of a contact portion in the "counter" form and the "with" form.

FIG. 13A illustrates the vicinity of a contact portion in the "counter" form. In FIG. 13A, a cleaning blade 991 and a member to be cleaned 901 form an angle θ on the upstream side of the tip of the cleaning blade. To be more precise, a plane in contact with the surface of the member to be cleaned 901 at a center of a contact portion between the cleaning blade 991 and the member to be cleaned 901 in the rotation direction of the member to be cleaned 901 (the movement direction of the surface of the member to be cleaned 901) is referred to as a contact surface A. A surface of the cleaning blade 991 opposite the surface of the member to be cleaned 901 on the upstream side of the contact portion in the rotation direction (the movement direction) of the member to be cleaned 901 is referred to as a surface U. The angle between the contact surface A and the surface U is the angle β. The term "upstream side", as used herein, refers to the upstream side of a contact portion in the movement direction of the surface of a member to be cleaned. The same applies hereinafter. In FIGS. 13A and 13B, N denotes a contact portion between the cleaning blade 991 and the member to be cleaned 901, and T denotes a toner particle. The blockage of the toner particle T depends on the angle β and a pressure P exerted on the contact portion N. A higher pressure P results in the blockage of the toner particle T at a lower angle β. In the "counter" form, the tip of a cleaning blade is drawn in the downstream direction because of the friction force between the tip of the cleaning blade and a member to be cleaned. This increases the pressure P and thereby effectively prevents the passing of the toner particle T. Removal of a toner having a small particle size and a high degree of sphericity requires a high contact pressure. Thus, the "counter" form is also suitable for such cleaning. Furthermore, because of its high contact pressure, the tip of a cleaning blade in the "counter" form has good adaptability to concavities and convexities on the surface of a member to be cleaned with little space between the tip of the cleaning blade and the surface of the member to be cleaned.

However, the "counter" form having a high contact pressure tends to result in a high rotation torque of a member to be cleaned.

Cleaning in "with" Form

In the "with" form, as illustrated in FIG. 12B, the supporting member 992 for a cleaning blade is disposed on the upstream side. In FIG. 12B, R1 denotes the movement direction of the surface of a member to be cleaned, and the dotted line V denotes a line perpendicular to the surface of the member to be cleaned at a contact portion. The supporting member 992 is disposed on the upstream side of the dotted line V.

In the "with" form, a friction force between a cleaning blade and a member to be cleaned is exerted in a direction so as to stretch the entire cleaning blade. This tends to relieve the pressure at the tip of the cleaning blade. Thus, the contact pressure and the friction force are less likely to increase abnormally, as compared with the "counter" form. Thus, the "with" form is less likely to make an abnormal noise and is suitable to reduce the torque.

FIG. 13B illustrates the vicinity of a contact portion in the "with" form. In FIG. 13B, a cleaning blade 991 and a member to be cleaned 901 form an angle β on the upstream side of the tip of the cleaning blade. In FIGS. 13A and 13B, N denotes a contact portion between the cleaning blade 991 and the member to be cleaned 901, and T denotes a toner particle. In the "with" form, the tip of the cleaning blade 991 is likely to be drawn in the R1 direction (downstream direction) because of the friction force between the cleaning blade 991 and the member to be cleaned 901. Drawing the tip of the cleaning blade 991 in the R1 direction tends to reduce the angle β and makes it easy for the toner particle T to enter the contact portion N. The width of the contact portion N tends to increase as the tip of the cleaning blade 991 is drawn more strongly. A greater width of the contact portion N results in a smaller pressure P, making it easy for the toner particle T in the contact portion N to slip through the contact portion N in the downstream direction. When the cleaning blade 991 is more strongly pressed against the member to be cleaned 901 (a higher contact pressure), the tip of the cleaning blade is drawn more strongly in the downstream direction. This further reduces the angle β and increases the width of the contact portion N. Thus, the contact pressure is difficult to effectively increase. When the width of the contact portion N increases considerably, some type of cleaning blade may adhere strongly to the surface of the member to be cleaned. In such a case, the member to be cleaned may have a rotation torque as large as the rotation torque in the "counter" form.

Figure 16A:
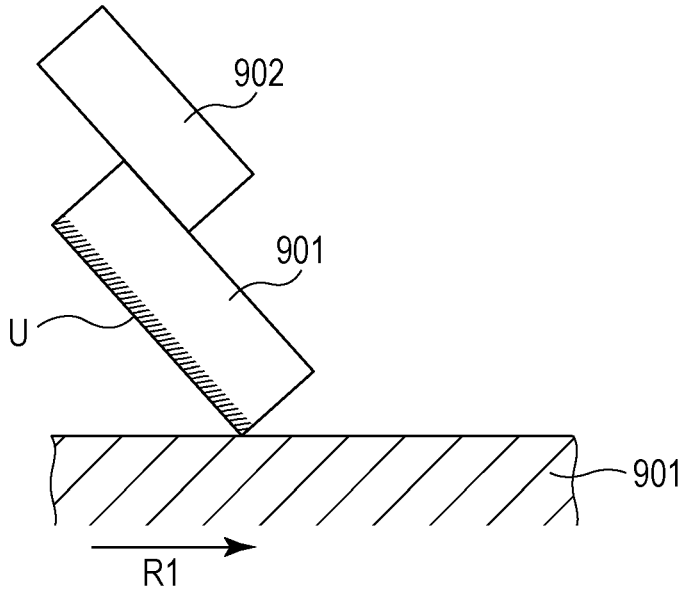
FIGS. 16A and 16B are schematic views of the contact state at the tip of a cleaning blade.
Figure 16B:
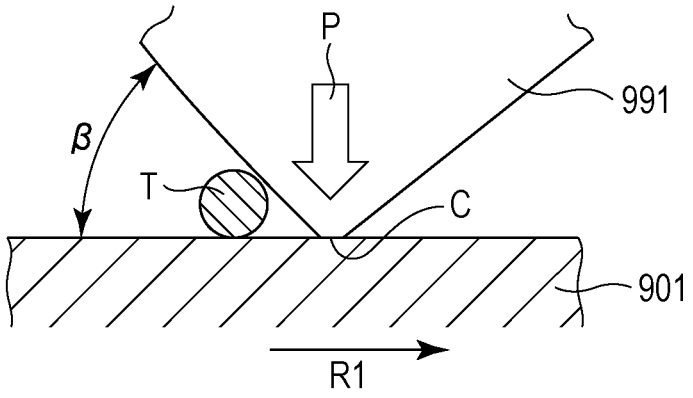

FIGS. 16A and 16B are schematic views of the contact state at the tip of a cleaning blade.

As illustrated in FIG. 16A, the Young's modulus ($Y_{UO}$) of a surface U of a cleaning blade in the "with" form opposite the surface of a member to be cleaned on the upstream side of a contact portion (hereinafter also referred to simply as a "surface U") may be 10 mgf/μm$^2$ or more. The surface U of the cleaning blade having a Young's modulus ($Y_{U0}$) of 10 mgf/μm$^2$ or more can resist the force that draws the tip of the cleaning blade in the R1 direction (downstream direction). Thus, the orientation of the cleaning blade can be appropriately maintained. As a result, the angle β is appropriately maintained. Such a surface U also reduces deformation at the tip of the cleaning blade and reduces the width of the contact portion N, making it easy to increase the contact pressure P. Thus, even a toner having a small particle size and a high degree of sphericity can be sufficiently removed. A high contact pressure P results in good adaptability to concavities and convexities on the member to be cleaned. A smaller width of the contact portion N results in lower adhesion between the cleaning blade and the member to be cleaned, making it easy to reduce the rotation torque of the member to be cleaned. A higher Young's modulus ($Y_{U0}$) makes it easier to increase the angle β and the contact pressure P and reduce the width of the contact portion N, thereby further improving cleaning performance. Thus, a cleaning blade in the "with" form may have a Young's modulus ($Y_{U0}$) of 40 mgf/μm$^2$ or more. The surface U does not necessarily have a Young's modulus ($Y_{U0}$) of 10 mgf/μm$^2$ or more over the entire surface thereof. In order to strongly resist the force that draws the tip of a cleaning blade in the R1 direction (downstream direction) and firmly maintain the orientation of the entire cleaning blade, the entire surface U may have a Young's modulus ($Y_{U0}$) of 10 mgf/μm$^2$ or more. In order to reduce deformation at the tip of a cleaning blade, the Young's modulus ($Y_{U0}$) in the vicinity of a contact portion may be increased. Although the angle β may be increased to remove a toner having a small particle size and a high degree of sphericity, the highest angle β is less than 90 degrees in the "with" form.

As described above, the surface C of a cleaning blade according to an embodiment of the present invention has a moderately high Young's modulus (10 mgf/μm$^2$ or more and 400 mgf/μm$^2$ or less), and the Young's modulus decreases from the surface C to the interior of the cleaning blade. More specifically, the ratio ($Y_{50}/Y_0$) of the Young's modulus ($Y_{50}$) of an internal portion of the cleaning blade 50 μm spaced apart from the surface of the contact portion of the cleaning blade to the Young's modulus ($Y_0$) is 0.5 or less (preferably 0.2 or less). The Young's modulus ($Y_0$) may be increased to prevent the tip of a cleaning blade from being drawn in the downstream direction and make it easy to maintain a high angle β. Even when the Young's modulus of the surface C increases to some extent, a ratio ($Y_{50}/Y_0$) of 0.5 or less results in good adaptability to concavities and convexities or foreign substances.

However, an excessively high Young's modulus ($Y_0$) and Young's modulus ($Y_{U0}$) tend to result in small deformation of a surface of a cleaning blade. This tends to result in poor adaptability to concavities and convexities on the surface of a member to be cleaned or damage to the surface of a member to be cleaned because of a very high local pressure exerted on the surface of the member to be cleaned. Thus, the Young's modulus ($Y_0$) and the Young's modulus ($Y_{U0}$) may be 400 mgf/μm$^2$ or less.

Method for Measuring Young's Modulus

The Young's modulus of a cleaning blade was measured with a microindentation hardness tester ENT-1100 (trade name) manufactured by Elionix Inc. A load-unload test is performed at an appropriate point between the surface of a contact portion to the interior of a cleaning blade under the following conditions. The Young's modulus is obtained as a calculation result in the tester.

Test mode: load-unload test
Load range: A
Test load: 100 [mgf]
Number of steps: 1000 [-]
Step intervals: 10 [ms]
Load holding time: 2 [s]

FIG. 7B is a schematic view of a portion where the Young's modulus of a cleaning blade is measured.

The cleaning blade was first divided into quarters in the longitudinal direction. The measurement and calculation described above were performed at any point in a contact portion 806 (a gray region in the lower figure in FIG. 7B) on three sections 805 except both end faces in a direction from the surface of the contact portion 806 to the interior of the cleaning blade (in the direction of an arrow in the lower figure in FIG. 7B). More specifically, the measurement and calculation described above were performed from the surface of the contact portion to the interior of the cleaning blade at intervals of 2 μm from the surface to a depth of 60 μm, at intervals of 10 μm from a depth of 60 μm to a depth of 100 μm, and at intervals of 20 μm from a depth of 100 μm to a depth of 300 μm. At each measuring point, the measured values in the three sections were averaged to obtain the Young's modulus at the corresponding point. In principle, the Young's modulus is more than zero.

Measurement of IR Spectrum using μATR Method

An IR spectrum was measured using a μATR method with a Fourier transform infrared spectrometer (trade name: Perkin Elmer Spectrum One/Spotlight 300) manufactured by PerkinElmer, Inc. (universal ATR using a diamond crystal).

A urethane rubber cleaning blade (urethane rubber) according to an embodiment of the present invention may have a hardness of 65 degrees or more and 90 degrees or less. A higher hardness of a urethane rubber cleaning blade (urethane rubber) results in a higher contact pressure when the urethane rubber cleaning blade comes into contact with a member to be cleaned. A lower hardness of a urethane rubber cleaning blade (urethane rubber) results in less damage to a member to be cleaned. The hardness (IRHD) of a urethane rubber cleaning blade (urethane rubber) is measured with a Wallace microhardness tester manufactured by H.W. WALLACE using an international rubber hardness test M method. The international rubber hardness test M method is defined in JIS K 6253-1997.

The tensile stress at an elongation of 100% (100% modulus) of a urethane rubber cleaning blade (urethane rubber) according to an embodiment of the present invention may be 2.5 MPa or more and 6.0 MPa or less. A higher tensile stress at an elongation of 100% of a urethane rubber cleaning blade (urethane rubber) results in a higher contact pressure when the urethane rubber cleaning blade comes into contact with a member to be cleaned. A lower tensile stress at an elongation of 100% (100% modulus) of a urethane rubber cleaning blade (urethane rubber) results in better adaptability to the surface of a member to be cleaned. In the measurement of tensile stress at an elongation of 100% (100% modulus) of a urethane rubber cleaning blade (urethane rubber), a JIS No. 3 dumbbell was first punched out from the cleaning blade. The tensile stress at an elongation of 100% (100% modulus) of the JIS No. 3 dumbbell was measured at a crosshead speed of 500 mm/min.

The peak temperature of tan δ of a urethane rubber that forms a cleaning blade according to an embodiment of the present invention (measured at a frequency of 10 Hz at a temperature of −50° C. or more and +130° C. or less; the same applies hereinafter) may be as low as possible, for example, 5° C. or less. The tan δ of a urethane rubber that forms a cleaning blade may have a gently curved line from low temperature to high temperature. More specifically, the tan δ may be 0.7 or less at 5° C. and 0.04 or more at 40° C. A lower peak temperature of tan δ of a urethane rubber that forms a cleaning blade results in higher elasticity of the cleaning blade in a low temperature environment. A more gently curved line of tan δ from low temperature to high temperature results in higher elasticity of the cleaning blade in a low temperature environment. Higher elasticity of a cleaning blade in a low temperature environment results in better cleaning performance in the low temperature environment. A lower peak temperature of tan δ of a urethane rubber that forms a cleaning blade tends to result in a higher viscosity. A more gently curved line of tan δ from low temperature to high temperature tends to result in a higher viscosity. A higher viscosity can prevent the cleaning blade from chattering or being turned over in a high-temperature environment. The tan δ of a urethane rubber is measured with a dynamic viscoelasticity measuring apparatus manufactured by Seiko Instruments Inc. (trade name: Exstar 6100DMS).

A greater compression set of a urethane rubber that forms a cleaning blade tends to result in a lower pressure contact force of an edge of the cleaning blade on the surface of a member to be cleaned. A greater compression set also tends to result in uneven contact between an edge of the cleaning blade and the surface of a member to be cleaned. Thus, the compression set may be as small as possible. In order to improve the wear resistance of a urethane rubber, the compression set of the urethane rubber may be as small as possible. More specifically, the compression set of a urethane rubber that forms a cleaning blade may be 5% or less. The compression set of a urethane rubber is measured in accordance with JIS K 6262-1997.

Method for Measuring Number-Average Molecular Weight

The number-average molecular weight was determined in accordance with a common procedure. A calibration curve was prepared from the peak count and the number-average molecular weight of monodisperse polystyrene for GPC using gel permeation chromatography (GPC). More specifically, a sample was dissolved in tetrahydrofuran (solvent), and the number-average molecular weight of a dissolved component was measured with the following apparatus under conditions described below.

GPC apparatus: HLC-8120 GPC (trade name) manufactured by Tosoh Corp.

Columns: TSK-GEL (trade name), G-5000HXL (trade name), G-4000HXL (trade name), G-3000HXL (trade name), and G-2000HXL (trade name) manufactured by Tosoh Corp.

Detector: differential refractometer

Solvent: tetrahydrofuran

Solvent concentration: 0.5% by mass

Flow rate: 1.0 ml/min

Method for Measuring Ten-Point Average Roughness (Rz) and Average Inclination Angle (θa)

Figure 11:
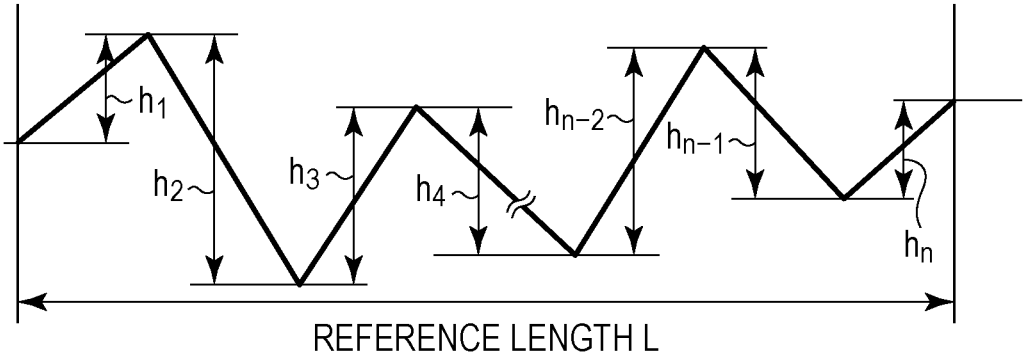

The ten-point average roughness (Rz) and the average inclination angle (θa) were measured with a Surfcorder (trade name: SE-3500) manufactured by Kosaka Laboratory Ltd. The ten-point average roughness (Rz) was measured in accordance with JIS B 0601-94. FIG. 11 illustrates a method for calculating an average inclination angle (θa). The measurement conditions are described below.

Cut-off: 0.8 mm

Measuring length: 2.5 mm

Measuring speed: 0.1 mm/s

Method for Measuring Dynamic Friction Coefficient

The dynamic friction coefficient was measured with a surface property tester (trade name: Heidon Type: 14FW) manufactured by Shinto Scientific Co., Ltd. A SiC ball (nominal size: ⅜ inch) manufactured by Sato Tekko Co., Ltd. was used as an indenter. A portion to be measured was a face opposite a member to be cleaned, including the contact portion 806 in FIG. 7B. The measurement conditions are described below.

Load: 100 mgf

Measuring length: 1 mm

Measuring speed: 1 mm/min

Data acquisition frequency: 1000 Hz 60000 data can be obtained under the measurement conditions described above. The dynamic friction coefficient was an average of the last 10000 data.

A cleaning blade according to an embodiment of the present invention can be used in the "counter" form or the "with" form in a process cartridge.

A process cartridge according to an embodiment of the present invention integrally supports a cleaning blade according to an embodiment of the present invention, and an electrophotographic photosensitive member, which is a member to be cleaned with the cleaning blade. The process cartridge can be detachably attached to a main body of an electrophotographic apparatus.

A cleaning blade according to an embodiment of the present invention can be used in the "counter" form or the "with" form in an electrophotographic apparatus.

An electrophotographic apparatus according to an embodiment of the present invention includes a cleaning blade according to an embodiment of the present invention, and an electrophotographic photosensitive member and/or intermediate transfer member, which is a member to be cleaned with the cleaning blade.

The present invention will be described in the following examples. The term "part" in the examples refers to "part by mass".

Example A1

Process for Producing First Composition 299 parts of 4,4'-diphenylmethane diisocyanate (hereinafter also referred to as "4,4'-MDI") and 767.5 parts of a butylene adipate polyester polyol having a number-average molecular weight of 2600 (hereinafter also referred to as "BA2600") were allowed to react at 80° C. for 3 hours, yielding a first composition (prepolymer). The NCO group content of the first composition was 7.2% by mass.

Process for Producing Second Composition 300 parts of a hexylene adipate polyester polyol having a number-average molecular weight of 2000 (hereinafter also referred to as "HA2000") and 0.25 parts of a urethane rubber synthesis catalyst N,N,N'-trimethylaminoethylethanolamine (hereinafter also referred to as "ETA") were mixed at 60° C. for 1 hour, yielding a second composition.

Process for Producing Mixture

The first composition heated to 80° C. was mixed with the second composition heated to 60° C., yielding a mixture of the first composition and the second composition. The number of moles of the polyols in the mixture was 17% of the number of moles of the polyisocyanate in the mixture. The ratio is hereinafter also referred to as "M(OH/NCO)". The M(OH/NCO) was 17% by mole in the present example.

Process for Producing Urethane Rubber Cleaning Blade 100 parts of ethanol was mixed with 100 parts of ETA to prepare a catalyst solution. The catalyst solution was sprayed on a portion of an inner surface of a die for use in the manufacture of a cleaning blade. The catalyst solution was spread over a portion of the inner surface of the die (a face corresponding to a contact portion of a cleaning blade) with a urethane rubber blade.

After the die was heated to 110° C., a release agent was applied to a portion of the inner surface of the die to which no catalyst solution had been applied. The die was heated again to 110° C. and was held at this temperature.

The mixture was then poured into the die (cavity). The mixture was then cured at 110° C. (molding temperature) for 30 minutes. The resulting urethane rubber plate was removed from the die. The urethane rubber plate was cut with a cutter to form an edge, thereby forming a urethane rubber cleaning blade. The cleaning blade had a thickness of 2 mm, a length of 20 mm, and a width of 345 mm.

Tables 1 and 2 show the manufacturing conditions and M(OH/NCO).

Figure 1B:
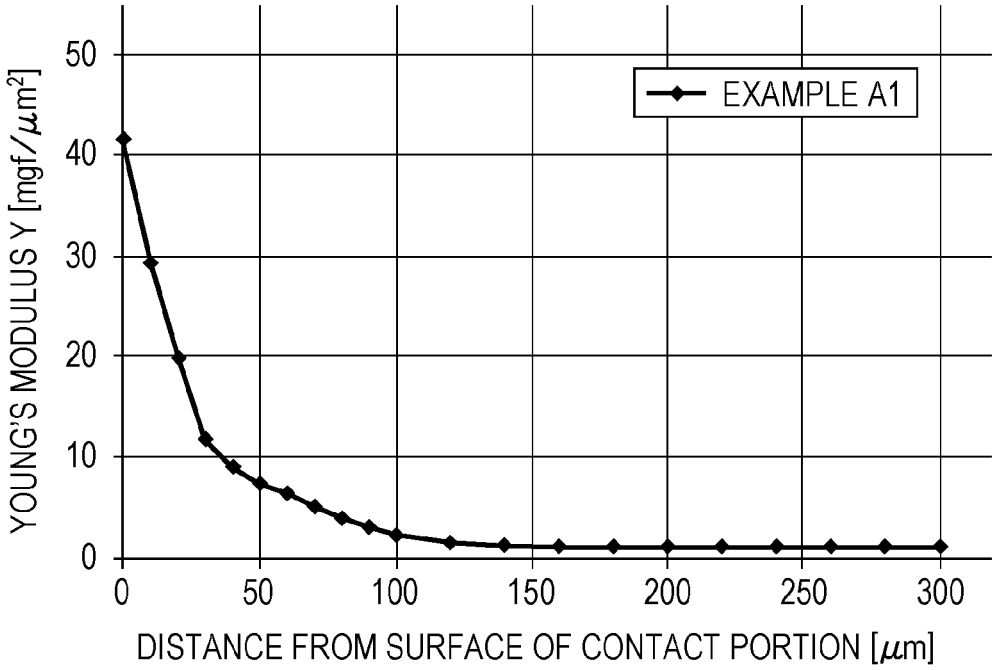

The cleaning blade was subjected to the analysis and the measurement of physical properties, as described above. FIGS. 1A and 1B and Table 3 show the results.

In FIG. 1A, L0-50 denotes a straight line between the Young's modulus ($Y_0$) and the Young's modulus ($Y_{50}$), $L_{0-20}$ denotes a straight line between the Young's modulus ($Y_0$) and the Young's modulus ($Y_{20}$), and $L_{20-50}$ denotes a straight line between the Young's modulus ($Y_{20}$) and the Young's modulus ($Y_{50}$).

Evaluation Method

A copying machine manufactured by CANON KABUSHIKI KAISHA (trade name: iR-ADV C5255) was used as a test machine. Three photosensitive drums were prepared: a photosensitive drum having depressed portions on the surface thereof, the depressed portions having a diameter of 40 μm and a depth of 2.5 μm and occupying 50% of the surface of the photosensitive drum (hereinafter also referred to as a "photosensitive drum having depressed portions on the surface thereof"); a photosensitive drum having circumferential grooves on the surface thereof, the streak having a Sm of 30 μm and a roughness height of 2 μm (hereinafter also referred to as a "photosensitive drum having circumferential grooves on the surface thereof"); and a photosensitive drum having a flat surface. These three photosensitive drums had the same dimensions as a drum-shaped photosensitive member for use in the copying machine (hereinafter also referred to as a "photosensitive drum"). Each of the three photosensitive drums was installed in the copying machine. The cleaning blade manufactured as described above was installed in the copying machine such that the contact surface (a face opposite the portion of the inner surface of the die to which the catalyst solution was applied) come into contact with the photosensitive drum. The cleaning blade was in the "counter" form with respect to the photosensitive drum, which was a member to be cleaned. The installation conditions included an installation angle of 22 degrees, a contact pressure of 28 gf/cm, and a free length of 8 mm. The cleaning blade was checked for an abnormal noise, chatter, and turning over in an endurance test in a high temperature and high humidity environment of 30° C./80% RH. In the endurance test, 10000 copies were printed at a discharge current of 100 μA without development.

After melamine resin particles (Optbeads (trade name) having a diameter of 3.5 μm, used as a substitute for toner) were dispersed on the surface of the photosensitive drum, the passing of the melamine resin particles was examined as cleaning performance in a low temperature and low humidity environment of 15° C./10% RH. The passing of a smaller number of melamine resin particles indicates better adaptability of the cleaning blade to concavities and convexities and melamine resin particles on the surface of the photosensitive drum. Table 4 shows the results.

The following are evaluation criteria.

Ratings for Abnormal Noise, Chatter, and Turning Over

A: No abnormal noise, chatter, and turning over of the cleaning blade.

B: An abnormal noise was sometimes made at the time of stopping or starting.

C: An abnormal noise was made at the time of stopping and starting or during operation.

D: An abnormal noise was made all the time, or the cleaning blade was turned over.

Passing

A: No passing of melamine resin particles.

B: Passing melamine resin particles were observed on a face of the cleaning blade on the downstream side (a face opposite the photosensitive member) (observation of the cleaning blade).

C: A streak of a passing melamine resin particle was partly observed in a visual inspection (observation of the surface of the photosensitive drum).

D: Passing of melamine resin particles was generally observed in a visual inspection (observation of the surface of the photosensitive drum).

The cleaning blade according to Example A1 had a Young's modulus ($Y_0$) of 41.8 mgf/μm$^2$, $Y_{50}/Y_0$ of 0.18, and $Y_{20}/Y_0$ of 0.48. $\Delta Y_{0-20} \geq \Delta Y_{20-50}$ was obvious from the slopes of $L_{0-20}$ and $L_{20-50}$. The Young's modulus ($Y_N$) was below $L_{0-50}$, and a change in Young's modulus from the surface of a contact portion to the interior of the cleaning blade formed a convex downward curve. The ratio $I_{SI}/I_{SE}$ was 0.50.

Example A2

Figure 2A:
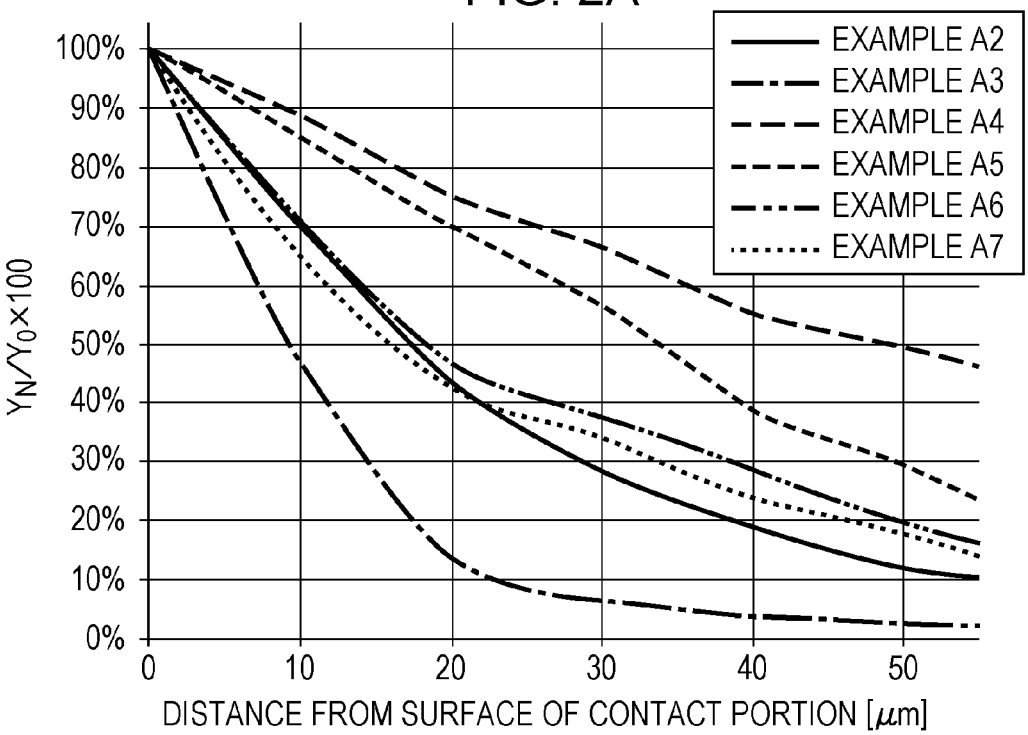
FIG. 2A is a graph showing the results for Examples A2 to A7.

A cleaning blade was manufactured and subjected to analysis and the measurement of physical properties in the same manner as in Example A1 except that 100 parts of ETA used in the preparation of the catalyst solution applied to the inner surface of the die was replaced by 100 parts of a compound having the following formula (D) (trade name: DABCO-TMR, manufactured by Sankyo Air Products Co., Ltd.), and the molding temperature was changed from 110° C. to 80° C. Tables 1 and 2 show the manufacturing conditions and M(OH/NCO). FIG. 2A and Tables 3 and 4 show the results of the analysis and the measurement of physical properties.

(D)

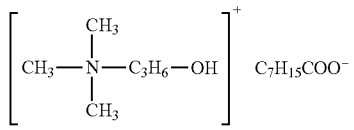

Example A3

A cleaning blade was manufactured and subjected to analysis and the measurement of physical properties in the same manner as in Example A1 except that 100 parts of ETA used in the preparation of the catalyst solution applied to the inner surface of the die was replaced by 100 parts of a particular amine (trade name: UCAT-18X, manufactured by San-Apro Ltd.), and the molding temperature was changed from 110° C. to 150° C. Tables 1 and 2 show the manufacturing conditions and M(OH/NCO). FIG. 2A and Tables 3 and 4 show the results of the analysis and the measurement of physical properties.

Example A4

A cleaning blade was manufactured and subjected to analysis and the measurement of physical properties in the same manner as in Example A1 except that the amount of HA2000 in the process for producing a second composition was changed from 300 parts to 360 parts, and 100 parts of ETA used in the preparation of the catalyst solution applied to the inner surface of the die was replaced by 100 parts of $CH_3COOK$ (trade name: Polycat 46, manufactured by Air Products and Chemicals, Inc.). Tables 1 and 2 show the manufacturing conditions and M(OH/NCO). FIG. 2A and Tables 3 and 4 show the results of the analysis and the measurement of physical properties.

Example A5

A cleaning blade was manufactured and subjected to analysis and the measurement of physical properties in the same manner as in Example A1 except that the amount of 4,4'-MDI in the process for producing a first composition was changed from 299 parts to 350 parts, the amount of BA2600 was changed from 767.5 parts to 860 parts, the amount of HA2000 in the process for producing a second composition was changed from 300 parts to 170 parts, 100 parts of ETA used in the preparation of the catalyst solution applied to the inner surface of the die was replaced by 100 parts of a 1:1 (mass ratio) mixture of UCAT-18X (trade name) and DABCO-TMR (trade name), and the molding temperature was changed from 110° C. to 90° C. Tables 1 and 2 show the manufacturing conditions and M(OH/NCO). FIG. 2A and Tables 3 and 4 show the results of the analysis and the measurement of physical properties.

Example A6

A cleaning blade was manufactured and subjected to analysis and the measurement of physical properties in the same manner as in Example A1 except that the amount of HA2000 in the process for producing a second composition was changed from 300 parts to 218.5 parts, 100 parts of ETA used in the preparation of the catalyst solution applied to the inner surface of the die was replaced by 100 parts of UCAT-18X (trade name), and the molding temperature was changed from 110° C. to 100° C. Tables 1 and 2 show the manufacturing conditions and M(OH/NCO). FIG. 2A and Tables 3 and 4 show the results of the analysis and the measurement of physical properties.

Example A7

A cleaning blade was manufactured and subjected to analysis and the measurement of physical properties in the same manner as in Example A1 except that the amount of HA2000 in the process for producing a second composition was changed from 300 parts to 218.5 parts, and 100 parts of ETA used in the preparation of the catalyst solution applied to the inner surface of the die was replaced by 100 parts of UCAT-18X (trade name). Tables 1 and 2 show the manufacturing conditions and M(OH/NCO). FIG. 2A and Tables 3 and 4 show the results of the analysis and the measurement of physical properties.

Comparative Example A1

Figure 2B:
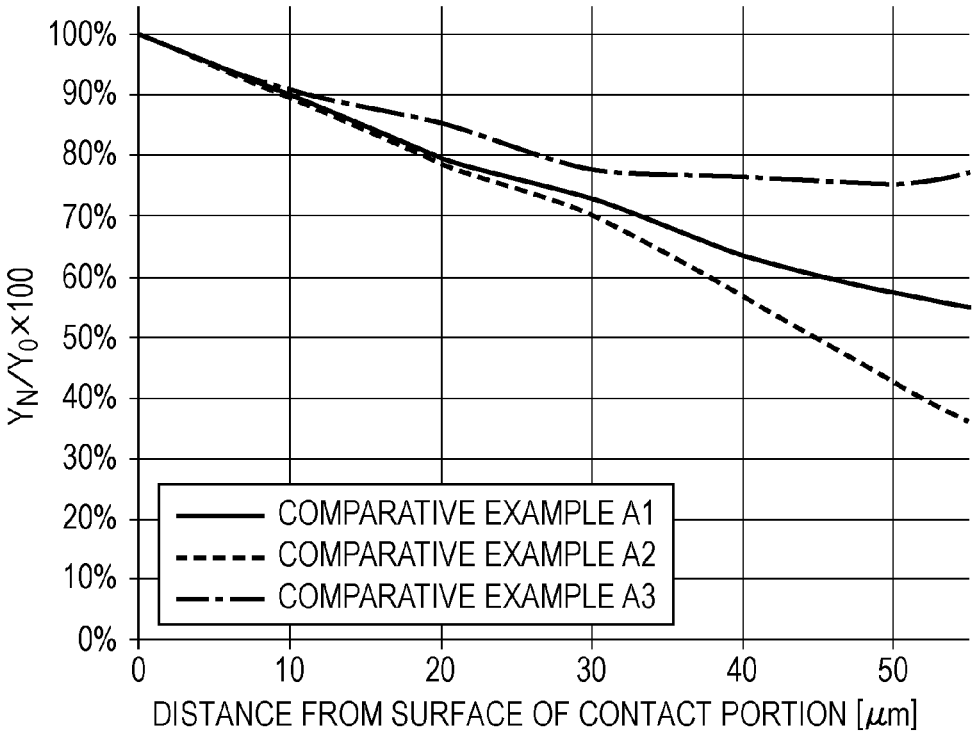
FIG. 2B is a graph showing the results for Comparative Examples A1 to A3.

A cleaning blade was manufactured and subjected to analysis and the measurement of physical properties in the same manner as in Example A1 except that the amount of HA2000 in the process for producing a second composition was changed from 300 parts to 500 parts, and the molding temperature was changed from 110° C. to 140° C. Tables 1 and 2 show the manufacturing conditions and M(OH/NCO). FIG. 2B and Tables 3 and 4 show the results of the analysis and the measurement of physical properties.

Comparative Example A2

A cleaning blade was manufactured and subjected to analysis and the measurement of physical properties in the same manner as in Example A1 except that the amount of 4,4'-MDI in the process for producing a first composition was changed from 299 parts to 350 parts, the amount of BA2600 was changed from 767.5 parts to 860 parts, the amount of HA2000 in the process for producing a second composition was changed from 300 parts to 150 parts, and 100 parts of ETA used in the preparation of the catalyst solution applied to the inner surface of the die was replaced by 100 parts of UCAT-18X (trade name). Tables 1 and 2 show the manufacturing conditions and M(OH/NCO). FIG. 2B and Tables 3 and 4 show the results of the analysis and the measurement of physical properties.

Comparative Example A3

A cleaning blade was manufactured in the same manner as in Example A1 except that no catalyst solution was applied to the inner surface of the die. The cleaning blade was dipped in 4,4'-MDI at 80° C. for 30 minutes. After that, 4,4'-MDI on the surface of the cleaning blade was removed using ethanol. The cleaning blade was then left stand in a high humidity environment of 25° C./90% RH for 2 days, thereby allowing 4,4'-MDI remaining in the surface of the cleaning blade to react with water. The resulting cleaning blade was used in Comparative Example A3. Tables 1 and 2 show the manufacturing conditions and M(OH/NCO). FIG. 2B and Tables 3 and 4 show the results of the analysis and the measurement of physical properties.

Comparative Example A4

Figure 3A:
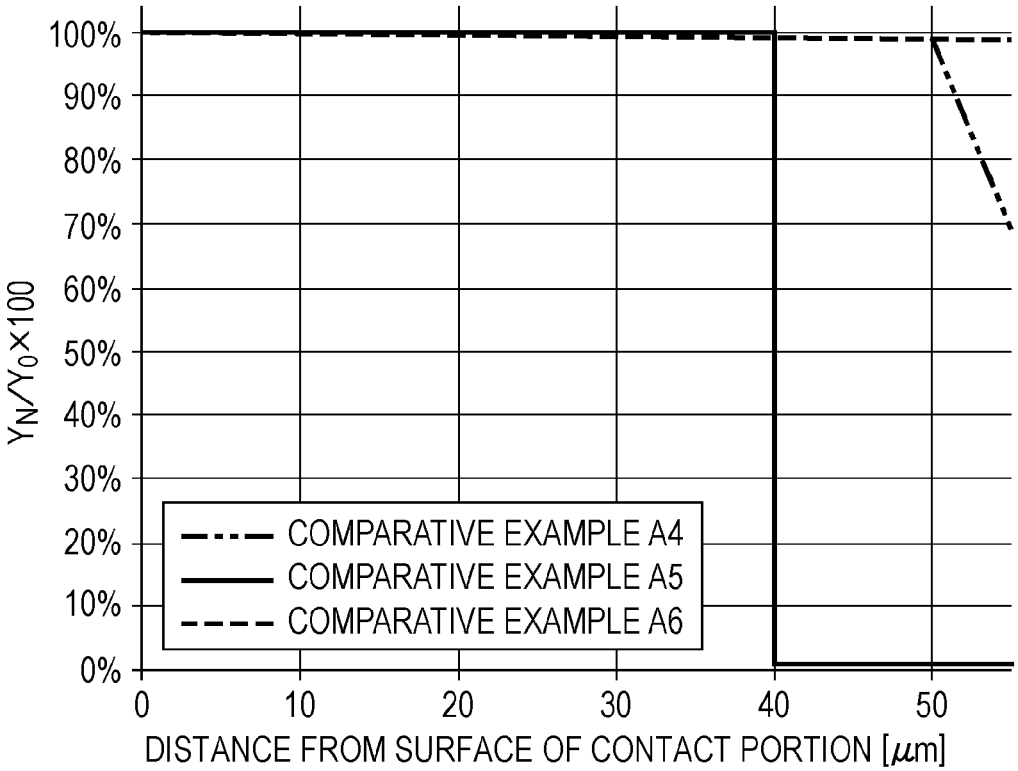
FIG. 3A is a graph showing the results for Comparative Examples A4 to A6.

A catalyst solution was prepared by adding 0.1 parts (corresponding to 1000 ppm) of DABCO-TMR (trade name) and then 200 parts of 4,4'-MDI to 100 parts of methyl isobutyl ketone (MIBK). The catalyst solution was sprayed on an inner surface of a die heated to 130° C. The catalyst solution formed a polyisocyanate film containing an isocyanurate and unreacted MDI and having a thickness of 50 μm on the inner surface of the die. A mixture of a first composition and a second composition produced in the same manner as in Example A1 was poured into the die (cavity). The mixture was then cured at 130° C. (molding temperature) for 30 minutes. The resulting urethane rubber plate was removed from the die. The urethane rubber plate was cut with a cutter to form an edge, thereby forming a urethane rubber cleaning blade. The cleaning blade had a thickness of 2 mm, a length of 20 mm, and a width of 345 mm. The cleaning blade was subjected to analysis and the measurement of physical properties in the same manner as in Example A1. Table 2 shows the manufacturing conditions. FIG. 3A and Tables 3 and 4 show the results of the analysis and the measurement of physical properties.

Comparative Example A5

A cleaning blade was manufactured in the same manner as in Example A1 except that no catalyst solution was applied to the inner surface of the die. A nylon coat having a thickness of 40 μm was applied to a contact portion of the cleaning blade. The resulting cleaning blade was used in Comparative Example A5. FIG. 3A and Tables 3 and 4 show the results of the analysis and the measurement of physical properties.

Comparative Example A6

A cleaning blade was manufactured and subjected to analysis and the measurement of physical properties in the same manner as in Example A1 except that the amount of BA2600 in the process for producing a first composition was changed from 767.5 parts to 800 parts, the amount of HA2000 in the process for producing a second composition was changed from 300 parts to 450 parts, the amount of ETA was changed from 0.25 parts to 0.28 parts, 100 parts of ETA used in the preparation of the catalyst solution applied to the inner surface of the die was replaced by 100 parts of 3:2 (mass ratio) mixture of Polycat 46 (trade name) and a quaternary ammonium salt (trade name: Toyocat-TRV, manufactured by Tosoh Corp.), and the molding temperature was changed from 110° C. to 100° C. Tables 1 and 2 show the manufacturing conditions and M(OH/NCO). FIG. 3A and Tables 3 and 4 show the results of the analysis and the measurement of physical properties.

Comparative Example A7

Figure 3B:
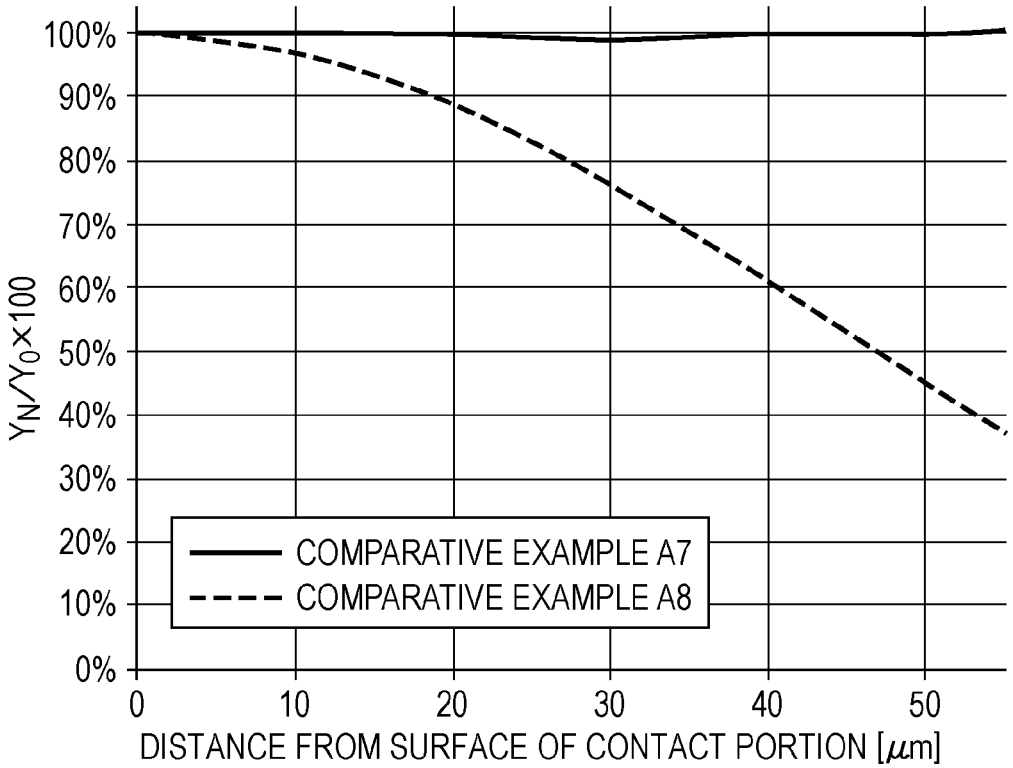
FIG. 3B is a graph showing the results for Comparative Examples A7 and A8.

A cleaning blade was manufactured and subjected to analysis and the measurement of physical properties in the same manner as in Example A1 except that ETA used in the preparation of the catalyst solution was replaced by a 1:1 (mass ratio) mixture of UCAT-18X (trade name) and DABCO-TMR (trade name), the mixture was not applied to the inner surface of the die, but 0.25 parts of the mixture was mixed with the second composition, and the molding temperature was changed from 110° C. to 90° C. Tables 1 and 2 show the manufacturing conditions and M(OH/NCO). FIG. 3B and Tables 3 and 4 show the results of the analysis and the measurement of physical properties.

Comparative Example A8

A cleaning blade was manufactured and subjected to analysis and the measurement of physical properties in the same manner as in Example A1 except that the amount of HA2000 in the process for producing a second composition was changed from 300 parts to 380 parts, 100 parts of ETA used in the preparation of the catalyst solution applied to the inner surface of the die was replaced by 100 parts of a 1:1 (mass ratio) mixture of Polycat 46 (trade name) and Toyocat-TRV (trade name), and the molding temperature was changed from 110° C. to 100° C. Tables 1 and 2 show the manufacturing conditions and M(OH/NCO). FIG. 3B and Table 3 show the results of the analysis and the measurement of physical properties.

TABLE 1

| Cleaning blade | (i) First composition: Polyisocyanate | | (i) First composition: Polyol | | (ii) Second composition: Polyol | | (ii) Second composition: Urethane rubber synthesis catalyst | | M(OH/NCO) in mixture of (i) and (ii) [mol %] |
|---|---|---|---|---|---|---|---|---|---|
| Example A1 | 4,4'-MDI | 299 parts | BA2600 | 767.5 parts | HA2000 | 300 parts | ETA | 0.25 parts | 17 |
| Example A2 | 4,4'-MDI | 299 parts | BA2600 | 767.5 parts | HA2000 | 300 parts | ETA | 0.25 parts | 17 |
| Example A3 | 4,4'-MDI | 299 parts | BA2600 | 767.5 parts | HA2000 | 300 parts | ETA | 0.25 parts | 17 |
| Example A4 | 4,4'-MDI | 299 parts | BA2600 | 767.5 parts | HA2000 | 360 parts | ETA | 0.25 parts | 20 |
| Example A5 | 4,4'-MDI | 350 parts | BA2600 | 860 parts | HA2000 | 170 parts | ETA | 0.25 parts | 8 |
| Example A6 | 4,4'-MDI | 299 parts | BA2600 | 767.5 parts | HA2000 | 218.5 parts | ETA | 0.25 parts | 12 |
| Example A7 | 4,4'-MDI | 299 parts | BA2600 | 767.5 parts | HA2000 | 218.5 parts | ETA | 0.25 parts | 12 |
| Comparative example A1 | 4,4'-MDI | 299 parts | BA2600 | 767.5 parts | HA2000 | 500 parts | ETA | 0.25 parts | 28 |
| Comparative example A2 | 4,4'-MDI | 350 parts | BA2600 | 860 parts | HA2000 | 150 parts | ETA | 0.25 parts | 7 |
| Comparative example A3 | 4,4'-MDI | 299 parts | BA2600 | 767.5 parts | HA2000 | 300 parts | ETA | 0.25 parts | 17 |
| Comparative example A4 | — | — | — | — | — | — | — | — | — |
| Comparative example A5 | 4,4'-MDI | 299 parts | BA2600 | 767.5 parts | HA2000 | 300 parts | ETA | 0.25 parts | 17 |
| Comparative example A6 | 4,4'-MDI | 299 parts | BA2600 | 800 parts | HA2000 | 450 parts | ETA | 0.28 parts | 25 |
| Comparative example A7 | 4,4'-MDI | 299 parts | BA2600 | 767.5 parts | HA2000 | 300 parts | ETA | 0.25 parts | 17 |
| Comparative example A8 | 4,4'-MDI | 299 parts | BA2600 | 767.5 parts | HA2000 | 380 parts | ETA | 0.25 parts | 21 |

TABLE 2

| Cleaning blade | Catalyst solution | | | Molding Temperature ° C. |
|---|---|---|---|---|
| Example A1 | Ethanol | 100 parts | Application to inner surface of die | 110 |
| | ETA | 100 parts | | |
| Example A2 | Ethanol | 100 parts | Application to inner surface of die | 80 |
| | DABCO-TMR | 100 parts | | |
| Example A3 | Ethanol | 100 parts | Application to inner surface of die | 150 |
| | UCAT-18X | 100 parts | | |
| Example A4 | Ethanol | 100 parts | Application to inner surface of die | 110 |
| | POLYCAT46 | 100 parts | | |
| Example A5 | Ethanol | 100 parts | Application to inner surface of die | 90 |
| | UCAT-18X | 50 parts | | |
| | DABCO-TMR | 50 parts | | |
| Example A6 | Ethanol | 100 parts | Application to inner surface of die | 100 |
| | UCAT-18X | 100 parts | | |

TABLE 2-continued

| Cleaning blade | Catalyst solution | | | Molding Temperature ° C. |
|---|---|---|---|---|
| Example A7 | Ethanol<br>UCAT-18X | 100 parts<br>100 parts | Application to inner surface of die | 110 |
| Comparative example A1 | Ethanol<br>ETA | 100 parts<br>100 parts | Application to inner surface of die | 140 |
| Comparative example A2 | Ethanol<br>UCAT-18X | 100 parts<br>100 parts | Application to inner surface of die | 110 |
| Comparative example A3 | — | — | — | 110 |
| Comparative example A4 | MIBK<br>DABCO-TMR<br>4,4'-MDI | 100 parts<br>0.1 parts<br>200 parts | Application to inner surface of die | 130 |
| Comparative example A5 | — | — | — | 110 |
| Comparative example A6 | Ethanol<br>POLYCAT46<br>TOYOCAT-TRV | 100 parts<br>60 parts<br>40 parts | Application to inner surface of die | 100 |
| Comparative example A7 | Ethanol<br>UCAT-18X<br>DABCO-TMR | 100 parts<br>50 parts<br>50 parts | Addition of 0.25 parts to second composition | 90 |
| Comparative example A8 | Ethanol<br>POLYCAT46<br>TOYOCAT-TRV | 100 parts<br>50 parts<br>50 parts | Application to inner surface of die | 100 |

TABLE 3

| | Young's modulus | | | | | | | | |
|---|---|---|---|---|---|---|---|---|---|
| | $Y_0$ [mgf/μm$^2$] | $Y_{20}$ [mgf/μm$^2$] | $Y_{50}$ [mgf/μm$^2$] | $Y_{50}/Y_0$ | $Y_{20}/Y_0$ | $\Delta Y_{0\text{-}20}$ | $\Delta Y_{20\text{-}50}$ | Is $Y_N$ below $L_{0\text{-}50}$? | $I_{SI}/I_{SE}$ |
| Example A1 | 42 | 20 | 8 | 0.2 | 0.5 | 0.03 | 0.01 | Yes | 0.50 |
| Example A2 | 250 | 110 | 31 | 0.1 | 0.4 | 0.03 | 0.01 | Yes | 1.20 |
| Example A3 | 158 | 22 | 5 | 0.0 | 0.1 | 0.04 | 0.00 | Yes | 0.91 |
| Example A4 | 10 | 8 | 5 | 0.5 | 0.8 | 0.01 | 0.01 | No | 0.61 |
| Example A5 | 161 | 113 | 48 | 0.3 | 0.7 | 0.01 | 0.01 | No | 0.85 |
| Example A6 | 400 | 189 | 78 | 0.2 | 0.5 | 0.03 | 0.01 | Yes | 1.55 |
| Example A7 | 344 | 148 | 61 | 0.2 | 0.4 | 0.03 | 0.01 | Yes | 1.35 |
| Comparative example A1 | 6 | 5 | 3 | 0.5 | 0.8 | 0.01 | 0.01 | No | 0.49 |
| Comparative example A2 | 457 | 360 | 194 | 0.4 | 0.8 | 0.01 | 0.01 | No | 1.90 |
| Comparative example A3 | 11 | 8.9 | 8 | 0.7 | 0.8 | 0.01 | 0.00 | No | 0.12 |
| Comparative example A4 | 886 | 886 | 880 | 1.0 | 1.0 | 0.00 | 0.00 | No | 4.80 |
| Comparative example A5 | 230 | 230 | 3 | 0.0 | 1.0 | 0.00 | 0.03 | No | 0.05 |
| Comparative example A6 | 14 | 14 | 14 | 1.0 | 1.0 | 0.00 | 0.00 | No | 0.14 |
| Comparative example A7 | 115 | 115 | 115 | 1.0 | 1.0 | 0.00 | 0.00 | — | 0.21 |
| Comparative example A8 | 79 | 70 | 36 | 0.5 | 0.9 | 0.01 | 0.01 | No | 0.84 |

TABLE 4

| | Photosensitive drum having depressed portions on surface thereof | | Photosensitive drum having circumferential grooves on surface thereof | | Photosensitive drum having flat surface | |
|---|---|---|---|---|---|---|
| | Passing of toner | Chatter and turning over | Passing of toner | Chatter and turning over | Passing of toner | Chatter and turning over |
| Example A1 | A | A | A | A | A | A |
| Example A2 | A | A | A | A | A | A |

TABLE 4-continued

| | Photosensitive drum having depressed portions on surface thereof | | Photosensitive drum having circumferential grooves on surface thereof | | Photosensitive drum having flat surface | |
|---|---|---|---|---|---|---|
| | Passing of toner | Chatter and turning over | Passing of toner | Chatter and turning over | Passing of toner | Chatter and turning over |
| Example A3 | A | A | A | A | A | A |
| Example A4 | B | B | A | B | A | A |
| Example A5 | B | B | B | A | A | A |
| Example A6 | B | A | B | A | A | A |
| Example A7 | A | A | B | A | A | A |
| Comparative example A1 | C | D | B | B | D | D |
| Comparative example A2 | D | B | D | B | B | B |
| Comparative example A3 | D | B | C | A | B | C |
| Comparative example A4 | D | A | D | A | C | C |
| Comparative example A5 | D | D | C | B | A | D |
| Comparative example A6 | A | C | A | C | C | D |
| Comparative example A7 | A | D | A | C | C | D |
| Comparative example A8 | D | A | C | A | B | A |

In Examples A1 to A7, in which $Y_0$ was 10 mgf/μm$^2$ or more and 400 mgf/μm$^2$ or less, $Y_{50}/Y_0$ was 0.5 or less, and $\Delta Y_{0-20}$ was greater than or equal to $\Delta Y_{20-50}$, a smaller number of particles passed between the cleaning blade and each of the photosensitive drums, and the cleaning blade was prevented from making an abnormal noise, chattering, and being turned over on each of the photosensitive drums.

Example B1

Process for Producing First Composition 299 parts of 4,4'-MDI and 767.5 parts of BA2600 were allowed to react at 80° C. for 3 hours, yielding a first composition (prepolymer). The NCO group content of the first composition was 7.2% by mass.

Process for Producing Second Composition 300 parts of HA2000 and 0.25 parts of a urethane rubber synthesis catalyst ETA were mixed at 60° C. for 1 hour, yielding a second composition.

Process for Producing Mixture

The first composition heated to 80° C. was mixed with the second composition heated to 60° C., yielding a mixture of the first composition and the second composition. The number of moles of the polyols in the mixture was 17% of the number of moles of the polyisocyanate in the mixture (M(OH/NCO)). The M(OH/NCO) was 17% by mole in the present example.

Process for Producing Urethane Rubber Cleaning Blade 100 parts of ethanol was mixed with 100 parts of ETA to prepare a catalyst solution. The catalyst solution was sprayed on a portion of an inner surface of a die for use in the manufacture of a cleaning blade. The catalyst solution was spread over a portion of the inner surface of the die (a face corresponding to a contact portion of a cleaning blade) with a urethane rubber blade. In the die used in the present example, a surface to which a catalyst was to be applied (hereinafter also referred to as a "catalyst coat face") had been blasted with glass beads and had an average inclination angle (θa) of 1.01 degrees and a ten-point average roughness (Rz) of 0.63 μm.

After the catalyst solution was spread over, the die was heated to 110° C. A release agent was then applied to a portion of the inner surface of the die to which no catalyst solution had been applied. The die was heated again to 110° C. and was held at this temperature.

The mixture was then poured into the die (cavity). The mixture was then cured at 110° C. (molding temperature) for 30 minutes. The resulting urethane rubber plate was removed from the die. A surface of the urethane rubber plate had concavities and convexities corresponding to the surface profile of the die. The urethane rubber plate was cut with a cutter to form an edge, thereby forming a urethane rubber cleaning blade. The cleaning blade had a thickness of 2 mm, a length of 20 mm, and a width of 345 mm.

Tables 5 and 6 show the manufacturing conditions and M(OH/NCO).

Figure 8A:
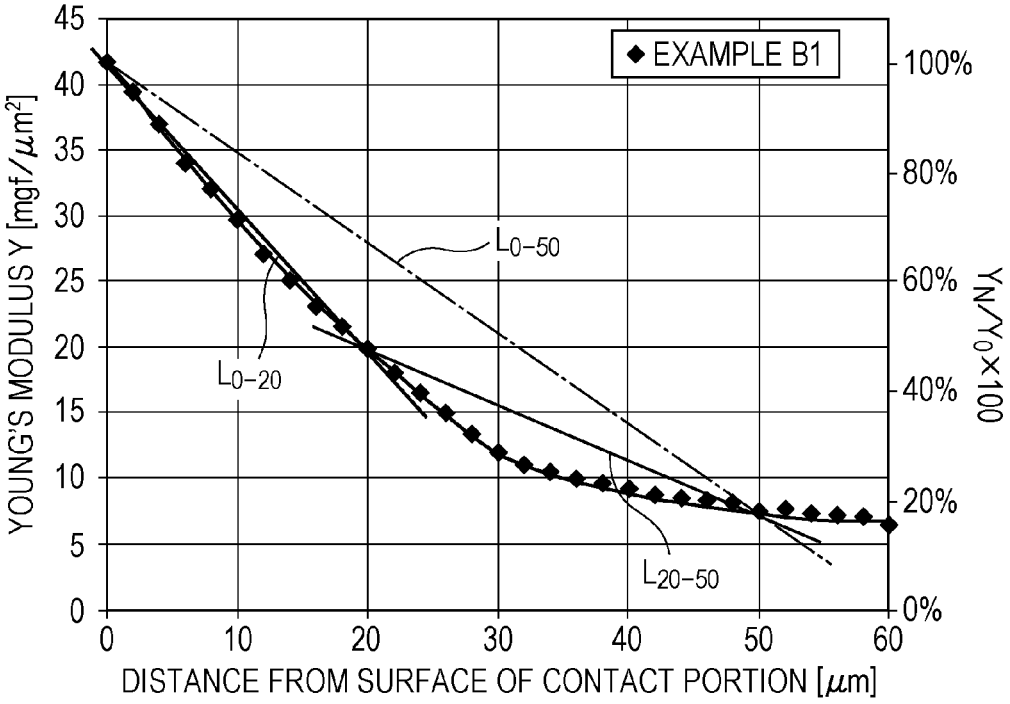
FIGS. 8A and 8B are graphs showing the results for Example B1.
Figure 8B:
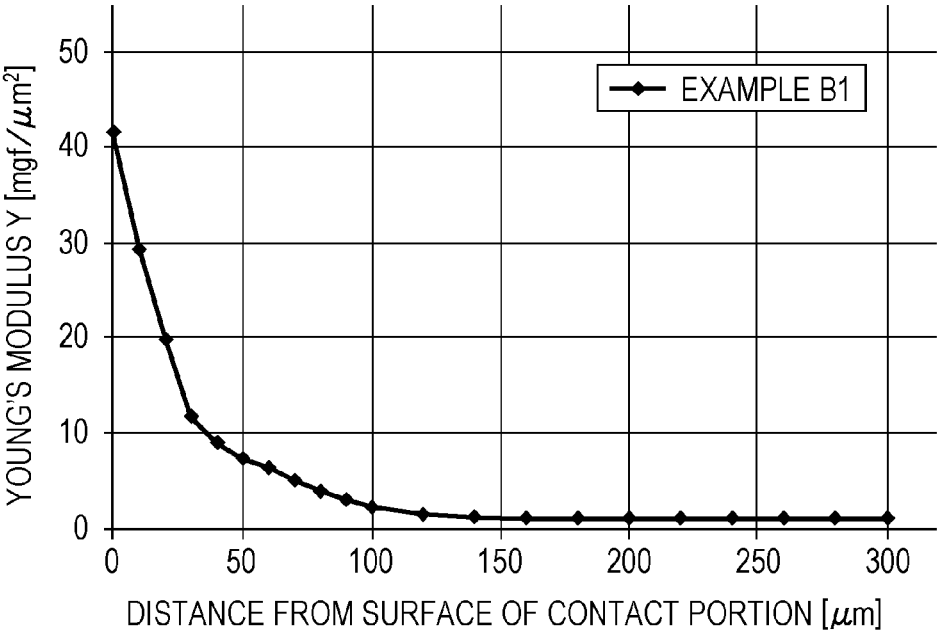

The cleaning blade was subjected to the analysis and the measurement of physical properties, as described above. FIGS. 8A and 8B and Table 7 show the results.

In FIG. 8A, L0-50 denotes a straight line between the Young's modulus ($Y_0$) and the Young's modulus ($Y_{50}$), $L_{0-20}$ denotes a straight line between the Young's modulus ($Y_0$) and the Young's modulus ($Y_{20}$), and $L_{20-50}$ denotes a straight line between the Young's modulus ($Y_{20}$) and the Young's modulus ($Y_{50}$).

Evaluation Method

A copying machine manufactured by CANON KABUSHIKI KAISHA (trade name: iR-ADV C5255) was used as a test machine. Two photosensitive drums were prepared: a photosensitive drum having depressed portions on the surface thereof, the depressed portions having a diameter of 40 μm and a depth of 2.5 μm and occupying 50% of the surface of the photosensitive drum (a photosensitive drum having depressed portions on the surface thereof); and a photosensitive drum having a flat surface. These two photosensitive drums had the same dimensions as a photosensitive drum for use in the copying machine. Each of the two photosensitive drums was installed in the copying machine. The cleaning blade manufactured as described above was installed in the copying machine such that the contact surface (a face opposite the portion of the inner surface of the die to which the catalyst solution was applied) come into contact with the photosensitive drum. The cleaning blade was in the "counter" form with respect to the photosensitive drum, which was a member to be cleaned. The installation conditions included an installation angle of 22 degrees, a contact pressure of 28 gf/cm, and a free length of 8 mm. The cleaning blade was checked for an abnormal noise, chatter, and turning over in an endurance test in a high temperature and high humidity environment of 30° C./80% RH. In the endurance test, 10000 copies were printed at a discharge current of 100 μA without development.

After spherical toner particles (having a diameter of 5.5 μm) were dispersed on the surface of the photosensitive drum, the passing of the spherical toner particles was examined as cleaning performance in a low temperature and low humidity environment of 15° C./10% RH. The passing of a smaller number of toner particles indicates better adaptability of the cleaning blade to concavities and convexities and toner particles on the surface of the photosensitive drum. Table 8 shows the results.

The following are evaluation criteria.

Ratings for Abnormal Noise, Chatter, and Turning Over

A: No abnormal noise, chatter, and turning over of the cleaning blade.

B: An abnormal noise was sometimes made at the time of stopping or starting.

C: An abnormal noise was made at the time of stopping and starting or during operation.

D: An abnormal noise was made all the time, or the cleaning blade was turned over.

Passing

A: No passing of toner particles.

B: Passing toner particles were observed on a face of the cleaning blade on the downstream side (a face opposite the surface of the photosensitive drum) (observation of the cleaning blade).

C: A streak of a passing toner particle was partly observed in a visual inspection (observation of the surface of the photosensitive drum).

D: Passing of toner particles was generally observed in a visual inspection (observation of the surface of the photosensitive drum).

The cleaning blade according to Example B1 had a Young's modulus ($Y_0$) of 42 mgf/μm$^2$, $Y_{50}/Y_0$ of 0.19, and $Y_{20}/Y_0$ of 0.48. $\Delta Y_{0-20} \geq \Delta Y_{20-50}$ was obvious from the slopes of $L_{0-20}$ and $L_{20-50}$. The Young's modulus ($Y_N$) was below L0-50, and a change in Young's modulus from the surface of a contact portion to the interior of the cleaning blade formed a convex downward curve. The ratio $I_{SI}/I_{SE}$ was 0.50. The average inclination angle θa was 1.26 degrees, and the 10-point roughness average Rz was 0.71 μm.

Example B2

Figure 9A:
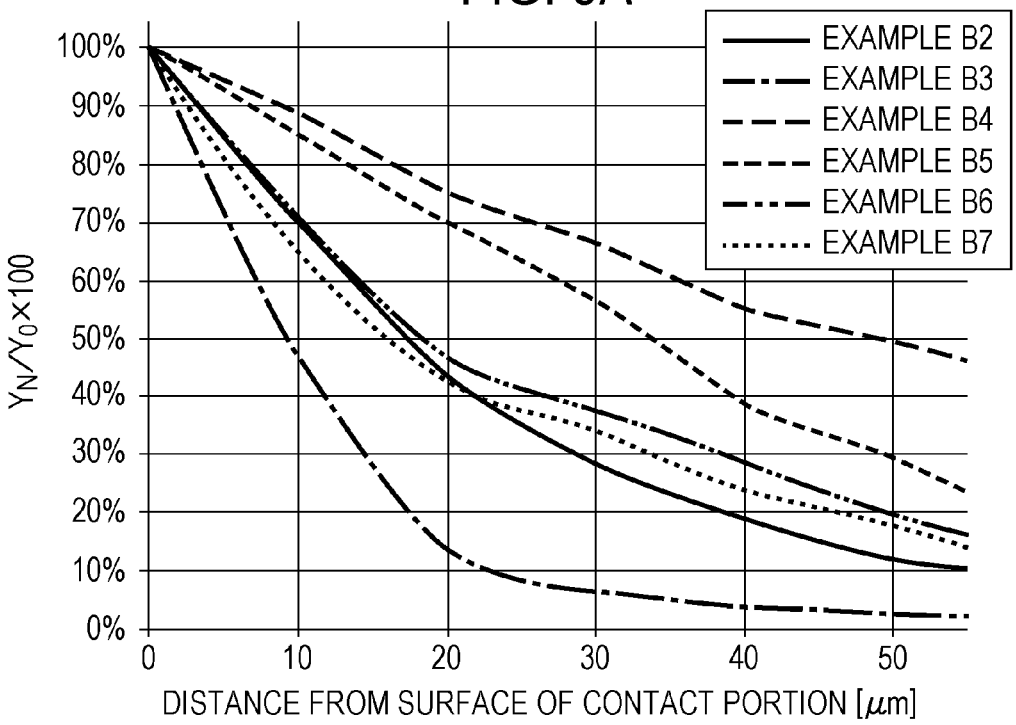
FIG. 9A is a graph showing the results for Examples B2 to B7.

A cleaning blade was manufactured and subjected to analysis and the measurement of physical properties in the same manner as in Example B1 except that 100 parts of ETA used in the preparation of the catalyst solution applied to the inner surface of the die was replaced by 100 parts of a compound having the formula (D) (trade name: DABCO-TMR, manufactured by Sankyo Air Products Co., Ltd.), and the molding temperature was changed from 110° C. to 80° C. Tables 5 and 6 show the manufacturing conditions and M(OH/NCO). FIG. 9A and Tables 7 and 8 show the results of the analysis and the measurement of physical properties.

Example B3

A cleaning blade was manufactured and subjected to analysis and the measurement of physical properties in the same manner as in Example B1 except that 100 parts of ETA used in the preparation of the catalyst solution applied to the inner surface of the die was replaced by 100 parts of a particular amine (trade name: UCAT-18X, manufactured by San-Apro Ltd.), and the molding temperature was changed from 110° C. to 150° C. Tables 5 and 6 show the manufacturing conditions and M(OH/NCO). FIG. 9A and Tables 7 and 8 show the results of the analysis and the measurement of physical properties.

Example B4

A cleaning blade was manufactured and subjected to analysis and the measurement of physical properties in the same manner as in Example B1 except that the amount of HA2000 in the process for producing a second composition was changed from 300 parts to 360 parts, and 100 parts of ETA used in the preparation of the catalyst solution applied to the inner surface of the die was replaced by 100 parts of $CH_3COOK$ (trade name: Polycat 46, manufactured by Air Products and Chemicals, Inc.). Tables 5 and 6 show the manufacturing conditions and M(OH/NCO). FIG. 9A and Tables 7 and 8 show the results of the analysis and the measurement of physical properties.

Example B5

A cleaning blade was manufactured and subjected to analysis and the measurement of physical properties in the same manner as in Example B1 except that the amount of 4,4'-MDI in the process for producing a first composition was changed from 299 parts to 350 parts, the amount of BA2600 was changed from 767.5 parts to 860 parts, the amount of HA2000 in the process for producing a second composition was changed from 300 parts to 170 parts, 100 parts of ETA used in the preparation of the catalyst solution applied to the inner surface of the die was replaced by 100 parts of a 1:1 (mass ratio) mixture of UCAT-18X (trade name) and DABCO-TMR (trade name), and the molding temperature was changed from 110° C. to 90° C. Tables 5 and 6 show the manufacturing conditions and M(OH/NCO). FIG. 9A and Tables 7 and 8 show the results of the analysis and the measurement of physical properties.

Example B6

A cleaning blade was manufactured and subjected to analysis and the measurement of physical properties in the same manner as in Example B1 except that the amount of HA2000 in the process for producing a second composition was changed from 300 parts to 218.5 parts, 100 parts of ETA used in the preparation of the catalyst solution applied to the inner surface of the die was replaced by 100 parts of UCAT-18X (trade name), and the molding temperature was changed from 110° C. to 100° C. Tables 5 and 6 show the manufacturing conditions and M(OH/NCO). FIG. 9A and Tables 7 and 8 show the results of the analysis and the measurement of physical properties.

Example B7

A cleaning blade was manufactured and subjected to analysis and the measurement of physical properties in the same manner as in Example B1 except that the amount of HA2000 in the process for producing a second composition was changed from 300 parts to 218.5 parts, and 100 parts of ETA used in the preparation of the catalyst solution applied to the inner surface of the die was replaced by 100 parts of UCAT-18X (trade name). Tables 5 and 6 show the manufacturing conditions and M(OH/NCO). FIG. 9A and Tables 7 and 8 show the results of the analysis and the measurement of physical properties.

Example B8

A cleaning blade was manufactured and subjected to analysis and the measurement of physical properties in the same manner as in Example B1 except that the catalyst coat face of the die had an average inclination angle θa of 15.1 degrees and a 10-point roughness average Rz of 9.2 μm. Tables 5 and 6 show the manufacturing conditions and M(OH/NCO). The manufacturing conditions other than the surface profile of the die in the present example were the same as those in Example B1. A change in Young's modulus in the depth direction was substantially the same as that in Example B1. Tables 7 and 8 show the results of the analysis and the measurement of physical properties.

Example B9

A cleaning blade was manufactured and subjected to analysis and the measurement of physical properties in the same manner as in Example B6 except that the catalyst coat face of the die had an average inclination angle θa of 15.1 degrees and a 10-point roughness average Rz of 9.2 μm. Tables 5 and 6 show the manufacturing conditions and M(OH/NCO). The manufacturing conditions other than the surface profile of the die in the present example were the same as those in Example B6. A change in Young's modulus in the depth direction was substantially the same as that in Example B6. Tables 7 and 8 show the results of the analysis and the measurement of physical properties.

Example B10

A cleaning blade manufactured in the same manner as in Example B9 was used together with a belt-shaped intermediate transfer member (hereinafter also referred to as an "intermediate transfer belt"). As in Example B1, the copying machine manufactured by CANON KABUSHIKI KAISHA (trade name: iR-ADV C5255) was used as a test machine. An unused intermediate transfer belt in the copying machine was used (an intermediate transfer belt having a flat surface). The installation angle was 25 degrees, and the contact pressure was 35 gf/cm. The cleaning blade was checked for an abnormal noise, chatter, and turning over in an endurance test in a high temperature and high humidity environment of 30° C./80% RH. In the endurance test, 10000 copies were printed at a primary transfer electric current of 40 μA and a secondary transfer electric current of 80 μA without the formation of an image. A solid image having a width of 50 mm was transferred to the intermediate transfer belt along its entire circumference in a low temperature and low humidity environment of 15° C./10% RH. The cleaning performance for the solid image was evaluated. No transfer bias was applied to a secondary transfer portion so that as much toner as possible on the surface of the intermediate transfer belt could reach a cleaning section. The type of toner, the amount of deposited toner, and the amount of electrical charge were the same as those in Example B1. Tables 7 and 8 show the results.

Comparative Example B1

Figure 9B:
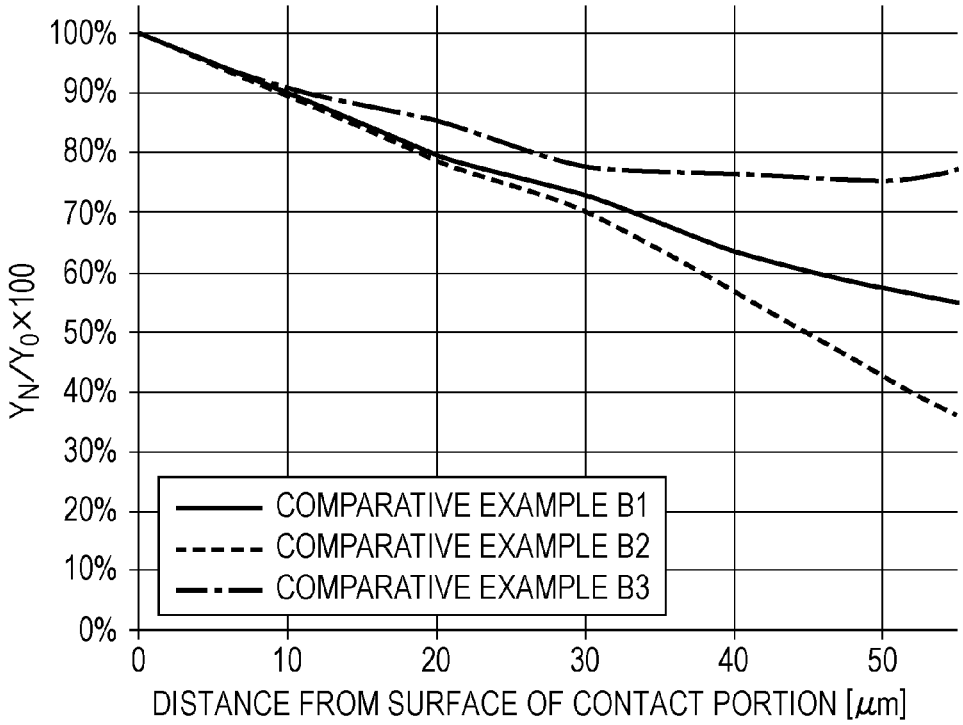
FIG. 9B is a graph showing the results for Comparative Examples B1 to B3.

A cleaning blade was manufactured and subjected to analysis and the measurement of physical properties in the same manner as in Example B1 except that the amount of HA2000 in the process for producing a second composition was changed from 300 parts to 500 parts, and the molding temperature was changed from 110° C. to 140° C. Tables 5 and 6 show the manufacturing conditions and M(OH/NCO). FIG. 9B and Tables 7 and 8 show the results of the analysis and the measurement of physical properties.

Comparative Example B2

A cleaning blade was manufactured and subjected to analysis and the measurement of physical properties in the same manner as in Example B1 except that the amount of 4,4'-MDI in the process for producing a first composition was changed from 299 parts to 350 parts, the amount of BA2600 was changed from 767.5 parts to 860 parts, the amount of HA2000 in the process for producing a second composition was changed from 300 parts to 150 parts, and 100 parts of ETA used in the preparation of the catalyst solution applied to the inner surface of the die was replaced by 100 parts of UCAT-18X (trade name). Tables 5 and 6 show the manufacturing conditions and M(OH/NCO). FIG. 9B and Tables 7 and 8 show the results of the analysis and the measurement of physical properties.

Comparative Example B3

A cleaning blade was manufactured in the same manner as in Example B1 except that no catalyst solution was applied to the inner surface of the die. The cleaning blade was dipped in 4,4'-MDI at 80° C. for 30 minutes. After that, 4,4'-MDI on the surface of the cleaning blade was removed using ethanol. The cleaning blade was then left stand in a high humidity environment of 25° C./90% RH for 2 days, thereby allowing 4,4'-MDI remaining in the surface of the cleaning blade to react with water. The resulting cleaning blade was used in Comparative Example B3. Tables 5 and 6 show the manufacturing conditions and M(OH/NCO). FIG. 9B and Tables 7 and 8 show the results of the analysis and the measurement of physical properties.

Comparative Example B4

Figure 10A:
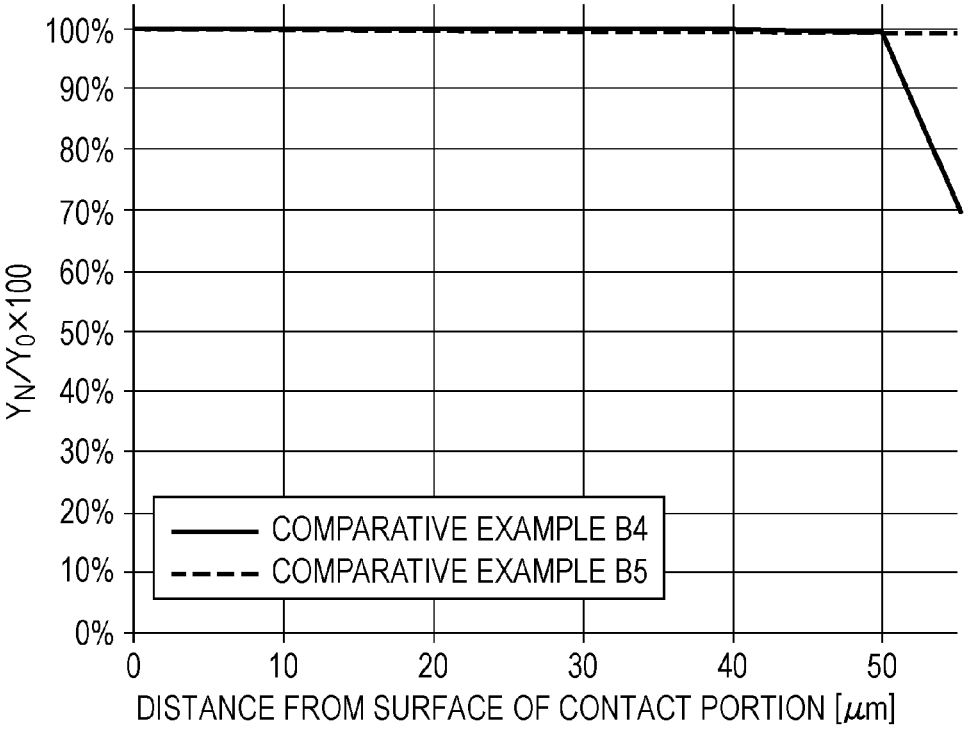
FIG. 10A is a graph showing the results for Comparative Examples B4 and B5.

A catalyst solution was prepared by adding 0.1 parts (corresponding to 1000 ppm) of DABCO-TMR (trade name) and then 200 parts of 4,4'-MDI to 100 parts of methyl isobutyl ketone (MIBK). The catalyst solution was sprayed on an inner surface of a die heated to 130° C. The catalyst solution formed a polyisocyanate film containing an isocyanurate and unreacted MDI and having a thickness of 50 μm on the inner surface of the die. A mixture of a first composition and a second composition produced in the same manner as in Example B1 was poured into the die (cavity). The mixture was then cured at 130° C. (molding temperature) for 30 minutes. The resulting urethane rubber plate was removed from the die. The urethane rubber plate was cut with a cutter to form an edge, thereby forming a urethane rubber cleaning blade. The cleaning blade had a thickness of 2 mm, a length of 20 mm, and a width of 345 mm. The cleaning blade was subjected to analysis and the measurement of physical properties in the same manner as in Example B1. Table 6 shows the manufacturing conditions. FIG. 10A and Tables 7 and 8 show the results of the analysis and the measurement of physical properties.

Comparative Example B5

A cleaning blade was manufactured and subjected to analysis and the measurement of physical properties in the same manner as in Example B1 except that the amount of BA2600 in the process for producing a first composition was changed from 767.5 parts to 800 parts, the amount of HA2000 in the process for producing a second composition was changed from 300 parts to 450 parts, the amount of ETA was changed from 0.25 parts to 0.28 parts, 100 parts of ETA used in the preparation of the catalyst solution applied to the inner surface of the die was replaced by 100 parts of 3:2 (mass ratio) mixture of Polycat 46 (trade name) and a quaternary ammonium salt (trade name: Toyocat-TRV, manufactured by Tosoh Corp.), and the molding temperature was changed from 110° C. to 100° C. Tables 5 and 6 show the manufacturing conditions and M(OH/NCO). FIG. 10A and Tables 7 and 8 show the results of the analysis and the measurement of physical properties.

Comparative Example B6

Figure 10B:
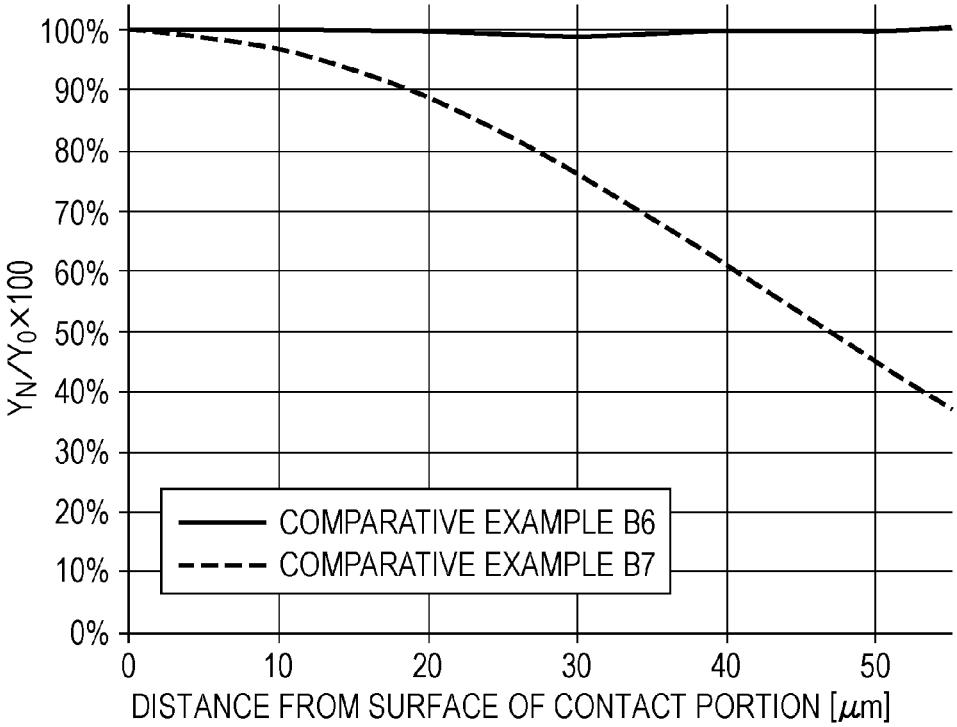
FIG. 10B is a graph showing the results for Comparative Examples B6 and B7.

A cleaning blade was manufactured and subjected to analysis and the measurement of physical properties in the same manner as in Example B1 except that ETA used in the preparation of the catalyst solution was replaced by a 1:1 (mass ratio) mixture of UCAT-18X (trade name) and DABCO-TMR (trade name), the mixture was not applied to the inner surface of the die, but 0.25 parts of the mixture was mixed with the second composition, and the molding temperature was changed from 110° C. to 90° C. Tables 5 and 6 show the manufacturing conditions and M(OH/NCO). FIG. 10B and Tables 7 and 8 show the results of the analysis and the measurement of physical properties.

Comparative Example B7

A cleaning blade was manufactured and subjected to analysis and the measurement of physical properties in the same manner as in Example B1 except that the amount of HA2000 in the process for producing a second composition was changed from 300 parts to 380 parts, 100 parts of ETA used in the preparation of the catalyst solution applied to the inner surface of the die was replaced by 100 parts of a 1:1 (mass ratio) mixture of Polycat 46 (trade name) and Toyocat-TRV (trade name), and the molding temperature was changed from 110° C. to 100° C. Tables 5 and 6 show the manufacturing conditions and M(OH/NCO). FIG. 10B and Tables 7 and 8 show the results of the analysis and the measurement of physical properties.

Comparative Example B8

A cleaning blade was manufactured and subjected to analysis and the measurement of physical properties in the same manner as in Example B1 except that the catalyst coat face of the die had an average inclination angle θa of 0.36 degrees and a 10-point roughness average Rz of 0.17 μm. Tables 5 and 6 show the manufacturing conditions and M(OH/NCO). The manufacturing conditions other than the surface profile of the die in the present example were the same as those in Example B1. A change in Young's modulus in the depth direction was substantially the same as that in Example B1. Tables 7 and 8 show the results of the analysis and the measurement of physical properties.

Comparative Example B9

A cleaning blade was manufactured and subjected to analysis and the measurement of physical properties in the same manner as in Example B1 except that the catalyst coat face of the die had an average inclination angle θa of 19.8 degrees and a 10-point roughness average Rz of 10.3 μm. Tables 5 and 6 show the manufacturing conditions and M(OH/NCO). The manufacturing conditions other than the surface profile of the die in the present example were the same as those in Example B1. A change in Young's modulus in the depth direction was substantially the same as that in Example B1. Tables 7 and 8 show the results of the analysis and the measurement of physical properties.

Comparative Example B10

A cleaning blade was manufactured and subjected to analysis and the measurement of physical properties in the same manner as in Example B6 except that the catalyst coat face of the die had an average inclination angle θa of 0.36 degrees and a 10-point roughness average Rz of 0.17%. Tables 5 and 6 show the manufacturing conditions and M(OH/NCO). The manufacturing conditions other than the surface profile of the die in the present example were the same as those in Example B6. A change in Young's modulus in the depth direction was substantially the same as that in Example B6. Tables 7 and 8 show the results of the analysis and the measurement of physical properties.

Comparative Example B11

A cleaning blade was manufactured and subjected to analysis and the measurement of physical properties in the same manner as in Example B6 except that the catalyst coat face of the die had an average inclination angle θa of 19.8 degrees and a 10-point roughness average Rz of 10.3 μm. Tables 5 and 6 show the manufacturing conditions and M(OH/NCO). Tables 7 and 8 show the results of the analysis and the measurement of physical properties.

TABLE 5

| Cleaning blade | (i) First composition | | | | (ii) Second composition | | | | M(OH/NCO) in mixture of (i) and (ii) [mol %] |
|---|---|---|---|---|---|---|---|---|---|
| | Polyisocyanate | | Polyol | | Polyol | | Urethane rubber synthesis catalyst | | |
| Example B1 | 4,4'-MDI | 299 parts | BA2600 | 767.5 parts | HA2000 | 300 parts | ETA | 0.25 parts | 17 |
| Example B2 | 4,4'-MDI | 299 parts | BA2600 | 767.5 parts | HA2000 | 300 parts | ETA | 0.25 parts | 17 |
| Example B3 | 4,4'-MDI | 299 parts | BA2600 | 767.5 parts | HA2000 | 300 parts | ETA | 0.25 parts | 17 |
| Example B4 | 4,4'-MDI | 299 parts | BA2600 | 767.5 parts | HA2000 | 360 parts | ETA | 0.25 parts | 20 |
| Example B5 | 4,4'-MDI | 350 parts | BA2600 | 860 parts | HA2000 | 170 parts | ETA | 0.25 parts | 8 |
| Example B6 | 4,4'-MDI | 299 parts | BA2600 | 767.5 parts | HA2000 | 218.5 parts | ETA | 0.25 parts | 12 |
| Example B7 | 4,4'-MDI | 299 parts | BA2600 | 767.5 parts | HA2000 | 218.5 parts | ETA | 0.25 parts | 12 |
| Example B8 | 4,4'-MDI | 299 parts | BA2600 | 767.5 parts | HA2000 | 300 parts | ETA | 0.25 parts | 17 |
| Example B9 | 4,4'-MDI | 299 parts | BA2600 | 767.5 parts | HA2000 | 218.5 parts | ETA | 0.25 parts | 12 |
| Example B10 | 4,4'-MDI | 299 parts | BA2600 | 767.5 parts | HA2000 | 218.5 parts | ETA | 0.25 parts | 12 |
| Comparative example B1 | 4,4'-MDI | 299 parts | BA2600 | 767.5 parts | HA2000 | 500 parts | ETA | 0.25 parts | 28 |

TABLE 5-continued

| Cleaning blade | (i) First composition Polyisocyanate | | Polyol | | (ii) Second composition Polyol | | Urethane rubber synthesis catalyst | | M(OH/NCO) in mixture of (i) and (ii) [mol %] |
|---|---|---|---|---|---|---|---|---|---|
| Comparative example B2 | 4,4'-MDI | 350 parts | BA2600 | 860 parts | HA2000 | 150 parts | ETA | 0.25 parts | 7 |
| Comparative example B3 | 4,4'-MDI | 299 parts | BA2600 | 767.5 parts | HA2000 | 300 parts | ETA | 0.25 parts | 17 |
| Comparative example B4 | — | — | — | — | — | — | — | — | — |
| Comparative example B5 | 4,4'-MDI | 299 parts | BA2600 | 800 parts | HA2000 | 450 parts | ETA | 0.28 parts | 25 |
| Comparative example B6 | 4,4'-MDI | 299 parts | BA2600 | 767.5 parts | HA2000 | 300 parts | ETA | 0.25 parts | 17 |
| Comparative example B7 | 4,4'-MDI | 299 parts | BA2600 | 767.5 parts | HA2000 | 380 parts | ETA | 0.25 parts | 21 |
| Comparative example B8 | 4,4'-MDI | 299 parts | BA2600 | 767.5 parts | HA2000 | 300 parts | ETA | 0.25 parts | 17 |
| Comparative example B9 | 4,4'-MDI | 299 parts | BA2600 | 767.5 parts | HA2000 | 300 parts | ETA | 0.25 parts | 17 |
| Comparative example B10 | 4,4'-MDI | 299 parts | BA2600 | 767.5 parts | HA2000 | 218.5 parts | ETA | 0.25 parts | 12 |
| Comparative example B11 | 4,4'-MDI | 299 parts | BA2600 | 767.5 parts | HA2000 | 218.5 parts | ETA | 0.25 parts | 12 |

TABLE 6

| Cleaning blade | Catalyst solution | | | Molding temperature ° C. |
|---|---|---|---|---|
| Example B1 | Ethanol<br>ETA | 100 parts<br>100 parts | Application to inner surface of die | 110 |
| Example B2 | Ethanol<br>DABCO-TMR | 100 parts<br>100 parts | Application to inner surface of die | 80 |
| Example B3 | Ethanol<br>UCAT-18X | 100 parts<br>100 parts | Application to inner surface of die | 150 |
| Example B4 | Ethanol<br>POLYCAT46 | 100 parts<br>100 parts | Application to inner surface of die | 110 |
| Example B5 | Ethanol<br>UCAT-18X<br>DABCO-TMR | 100 parts<br>50 parts<br>50 parts | Application to inner surface of die | 90<br>100 |
| Example B6 | Ethanol<br>UCAT-18X | 100 parts<br>100 parts | | |
| Example B7 | Ethanol<br>UCAT-18X | 100 parts<br>100 parts | Application to inner surface of die | 110 |
| Example B8 | Ethanol<br>ETA | 100 parts<br>100 parts | Application to inner surface of die | 110 |
| Example B9 | Ethanol<br>UCAT-18X | 100 parts<br>100 parts | Application to inner surface of die | 100 |
| Example B10 | Ethanol<br>UCAT-18X | 100 parts<br>100 parts | Application to inner surface of die | 100 |
| Comparative example B1 | Ethanol<br>ETA | 100 parts<br>100 parts | Application to inner surface of die | 140 |
| Comparative example B2 | Ethanol<br>UCAT-18X | 100 parts<br>100 parts | Application to inner surface of die | 110 |
| Comparative example B3 | — | — | — | 110 |
| Comparative example B4 | MIBK<br>DABCO-TMR<br>4,4'-MDI | 100 parts<br>0.1 parts<br>200 parts | Application to inner surface of die | 130 |
| Comparative example B5 | Ethanol<br>POLYCAT46<br>TOYOCAT-TRV | 100 parts<br>60 parts<br>40 parts | Application to inner surface of die | 100 |
| Comparative example B6 | Ethanol<br>UCAT-18X<br>DABCO-TMR | 100 parts<br>50 parts<br>50 parts | Addition of 0.25 parts to second composition | 90 |
| Comparative example B7 | Ethanol<br>POLYCAT46<br>TOYOCAT-TRV | 100 parts<br>50 parts<br>50 parts | Application to inner surface of die | 100 |
| Comparative example B8 | Ethanol<br>ETA | 100 parts<br>100 parts | Application to inner surface of die | 110 |

TABLE 6-continued

| Cleaning blade | Catalyst solution | | | Molding temperature ° C. |
|---|---|---|---|---|
| Comparative example B9 | Ethanol<br>ETA | 100 parts<br>100 parts | Application to inner surface of die | 110 |
| Comparative example B10 | Ethanol<br>UCAT-18X | 100 parts<br>100 parts | Application to inner surface of die | 100 |
| Comparative example B11 | Ethanol<br>UCAT-18X | 100 parts<br>100 parts | Application to inner surface of die | 100 |

TABLE 7

| | Young's modulus | | | | | | | | | Average | 10-point | Dynamic friction |
|---|---|---|---|---|---|---|---|---|---|---|---|---|
| | $Y_0$ [mgf/μm$^2$] | $Y_{20}$ [mgf/μm$^2$] | $Y_{50}$ [mgf/μm$^2$] | $Y_{50}/Y_0$ | $Y_{20}/Y_0$ | $\Delta Y_{0\text{-}20}$ | $\Delta Y_{20\text{-}50}$ | Is $Y_N$ below $L_{0\text{-}50}$? | $I_{SI}/I_{SE}$ | inclination angle θa [°] | roughness average Rz [μm] | coefficient of contact portion |
| Example B1 | 42 | 20 | 8 | 0.19 | 0.48 | 0.03 | 0.01 | Yes | 0.50 | 1.26 | 0.71 | 0.5 |
| Example B2 | 250 | 110 | 31 | 0.12 | 0.44 | 0.03 | 0.01 | Yes | 1.20 | 1.18 | 0.67 | 0.4 |
| Example B3 | 158 | 22 | 5 | 0.03 | 0.14 | 0.04 | 0.00 | Yes | 0.91 | 1.20 | 0.67 | 0.4 |
| Example B4 | 10 | 8 | 5 | 0.50 | 0.80 | 0.01 | 0.01 | No | 0.61 | 1.35 | 0.76 | 0.6 |
| Example B5 | 161 | 113 | 48 | 0.30 | 0.70 | 0.01 | 0.01 | No | 0.85 | 1.19 | 0.69 | 0.4 |
| Example B6 | 400 | 189 | 78 | 0.20 | 0.47 | 0.03 | 0.01 | Yes | 1.55 | 1.02 | 0.63 | 0.3 |
| Example B7 | 344 | 148 | 61 | 0.18 | 0.43 | 0.03 | 0.01 | Yes | 1.35 | 1.12 | 0.68 | 0.3 |
| Example B8 | 42 | 19 | 7 | 0.17 | 0.45 | 0.03 | 0.01 | Yes | 0.49 | 17.20 | 9.80 | 0.2 |
| Example B9 | 389 | 187 | 73 | 0.17 | 0.45 | 0.03 | 0.01 | Yes | 1.51 | 12.00 | 8.10 | 0.2 |
| Example B10 | 398 | 188 | 73 | 0.18 | 0.47 | 0.03 | 0.01 | Yes | 1.56 | 12.50 | 8.90 | 0.2 |
| Comparative example B1 | 6 | 5 | 3 | 0.50 | 0.83 | 0.01 | 0.01 | No | 0.49 | 1.44 | 0.81 | 1.2 |
| Comparative example B2 | 457 | 360 | 194 | 0.42 | 0.79 | 0.01 | 0.01 | No | 1.90 | 1.01 | 0.64 | 0.3 |
| Comparative example B3 | 11 | 8.9 | 8 | 0.73 | 0.81 | 0.01 | 0.00 | No | 0.12 | 1.78 | 1.50 | 0.6 |
| Comparative example B4 | 886 | 886 | 880 | 0.99 | 1.00 | 0.00 | 0.00 | No | 4.80 | 1.00 | 0.61 | 0.2 |
| Comparative example B5 | 14 | 14 | 14 | 1.00 | 1.00 | 0.00 | 0.00 | No | 0.14 | 1.37 | 0.89 | 0.6 |
| Comparative example B6 | 115 | 115 | 115 | 1.00 | 1.00 | 0.00 | 0.00 | — | 0.21 | 1.17 | 0.66 | 0.5 |
| Comparative example B7 | 79 | 70 | 36 | 0.46 | 0.89 | 0.01 | 0.01 | No | 0.84 | 1.11 | 0.69 | 0.5 |
| Comparative example B8 | 50 | 23 | 9 | 0.18 | 0.46 | 0.03 | 0.01 | Yes | 0.52 | 0.48 | 0.36 | 1.6 |
| Comparative example B9 | 44 | 25 | 10 | 0.23 | 0.57 | 0.02 | 0.01 | Yes | 0.51 | 20.60 | 12.50 | 0.2 |
| Comparative example B10 | 410 | 191 | 85 | 0.21 | 0.47 | 0.03 | 0.01 | Yes | 1.58 | 0.38 | 0.18 | 1.1 |
| Comparative example B11 | 422 | 198 | 87 | 0.21 | 0.47 | 0.03 | 0.01 | Yes | 1.6 | 19.90 | 10.40 | 0.2 |

TABLE 8

| | Photosensitive drum having depressed portions on surface thereof | | Photosensitive drum having circumferential grooves on surface thereof | | Photosensitive drum having flat surface | |
|---|---|---|---|---|---|---|
| | Passing of toner | Chatter and turning over | Passing of toner | Chatter and turning over | Passing of toner | Chatter and turning over |
| Example B1 | A | A | A | A | A | A |
| Example B2 | A | A | A | A | A | A |
| Example B3 | A | A | A | A | A | A |
| Example B4 | B | B | A | B | A | A |
| Example B5 | B | B | B | A | A | A |
| Example B6 | B | A | B | A | A | A |
| Example B7 | A | A | B | A | A | A |
| Example B8 | A | A | — | — | A | A |

TABLE 8-continued

| | Photosensitive drum having depressed portions on surface thereof | | Photosensitive drum having circumferential grooves on surface thereof | | Photosensitive drum having flat surface | |
|---|---|---|---|---|---|---|
| | Passing of toner | Chatter and turning over | Passing of toner | Chatter and turning over | Passing of toner | Chatter and turning over |
| Example B9 | B | A | — | — | A | A |
| Example B10 | — | — | — | — | A | A |
| Comparative example B1 | C | D | B | B | C | D |
| Comparative example B2 | D | B | D | B | B | B |
| Comparative example B3 | C | B | C | A | A | C |
| Comparative example B4 | D | A | D | A | B | C |
| Comparative example B5 | A | C | A | C | A | D |
| Comparative example B6 | A | D | A | C | B | D |
| Comparative example B7 | C | A | C | A | A | A |
| Comparative example B8 | B | B | — | — | B | B |
| Comparative example B9 | C | A | — | — | C | A |
| Comparative example B10 | B | B | — | — | B | B |
| Comparative example B11 | D | A | — | — | D | A |

In Examples B1 to B10, $Y_0$ was 10 mgf/μm$^2$ or more and 400 mgf/μm$^2$ or less, $Y_{50}/Y_0$ was 0.5 or less, $\Delta Y_{0\text{-}20}$ was greater than or equal to $\Delta Y_{20\text{-}50}$, θa was 1 degree or more, and Rz was 10 μm or less. In Examples B1 to B10, the cleaning blade had a lower-friction contact portion, a smaller number of particles passed between the cleaning blade and each of the photosensitive drums and the intermediate transfer belt, and the cleaning blade was prevented from making an abnormal noise, chattering, and being turned over on each of the photosensitive drums and the intermediate transfer belt.

Example C1

Process for Producing First Composition 299 parts of 4,4'-MDI and 767.5 parts of BA2600 were allowed to react at 80° C. for 3 hours, yielding a first composition (prepolymer). The NCO group content of the first composition was 7.2% by mass.

Process for Producing Second Composition 300 parts of HA2000 and 0.25 parts of a urethane rubber synthesis catalyst ETA were mixed at 60° C. for 1 hour, yielding a second composition.

Process for Producing Mixture

The first composition heated to 80° C. was mixed with the second composition heated to 60° C., yielding a mixture of the first composition and the second composition. The number of moles of the polyols in the mixture was 17% of the number of moles of the polyisocyanate in the mixture (M(OH/NCO)). The M(OH/NCO) was 17% by mole in the present example.

Process for Producing Urethane Rubber Cleaning Blade 100 parts of ethanol was mixed with 100 parts of ETA to prepare a catalyst solution. The catalyst solution was sprayed on a portion of an inner surface of a die for use in the manufacture of a cleaning blade. The catalyst solution was spread over a portion of the inner surface of the die (a face corresponding to a contact portion of a cleaning blade) with a urethane rubber blade.

After the die was heated to 110° C., a release agent was applied to a portion of the inner surface of the die to which no catalyst solution had been applied. The die was heated again to 110° C. and was held at this temperature.

The mixture was then poured into the die (cavity). The mixture was then cured at 110° C. (molding temperature) for 30 minutes. The resulting urethane rubber plate was removed from the die. The urethane rubber plate was cut with a cutter to form an edge, thereby forming a urethane rubber cleaning blade. The cleaning blade had a thickness of 2 mm, a length of 20 mm, and a width of 345 mm.

Tables 9 and 10 show the manufacturing conditions and M(OH/NCO).

Figure 14A:
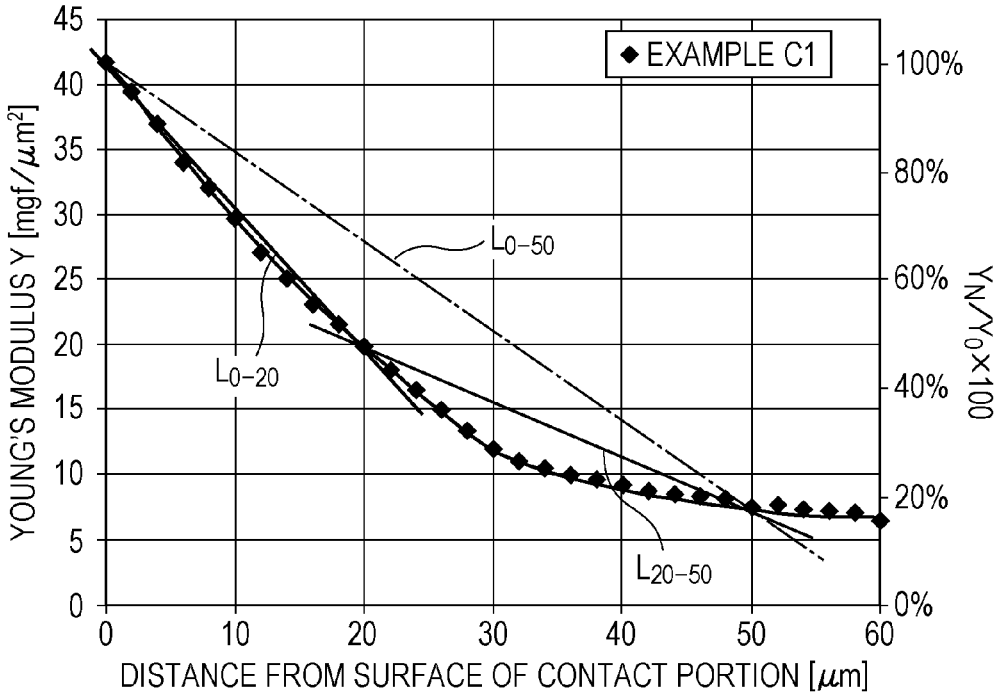
FIGS. 14A and 14B are graphs showing the relationship between the distance from a surface of a contact portion of a cleaning blade and Young's modulus in Example C1.
Figure 14B:
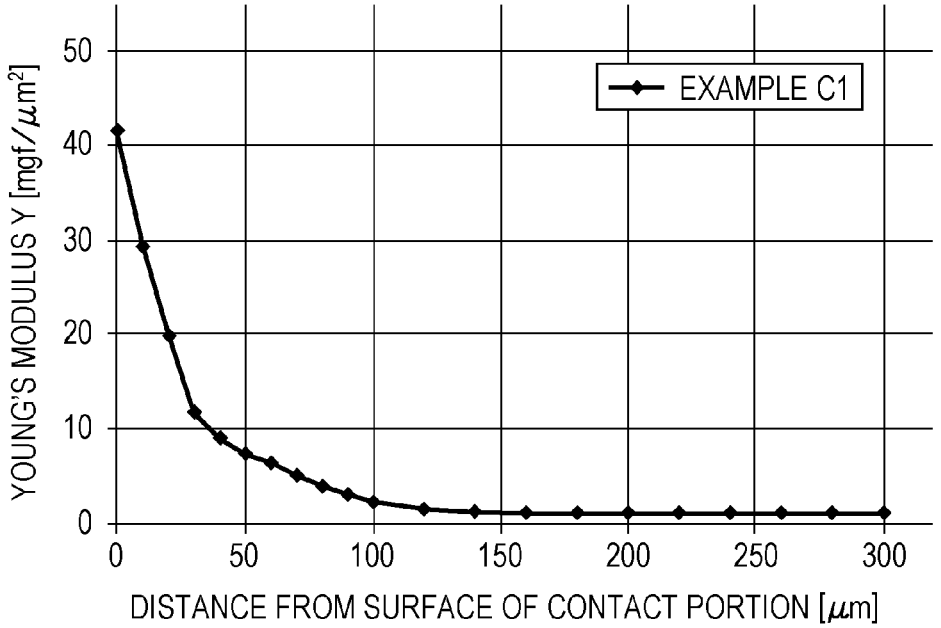

The cleaning blade was subjected to the analysis and the measurement of physical properties, as described above. FIGS. 14A and 14B and Table 11 show the results.

In FIG. 14A, L0-50 denotes a straight line between the Young's modulus ($Y_0$) and the Young's modulus ($Y_{50}$), $L_{0\text{-}20}$ denotes a straight line between the Young's modulus ($Y_0$) and the Young's modulus ($Y_{20}$), and $L_{20\text{-}50}$ denotes a straight line between the Young's modulus ($Y_{20}$) and the Young's modulus ($Y_{50}$).

Electrophotographic Apparatus

The cleaning performance of the cleaning blade was evaluated in the following electrophotographic apparatus. The rotation torque of a photosensitive drum was also measured.

Figure 17:
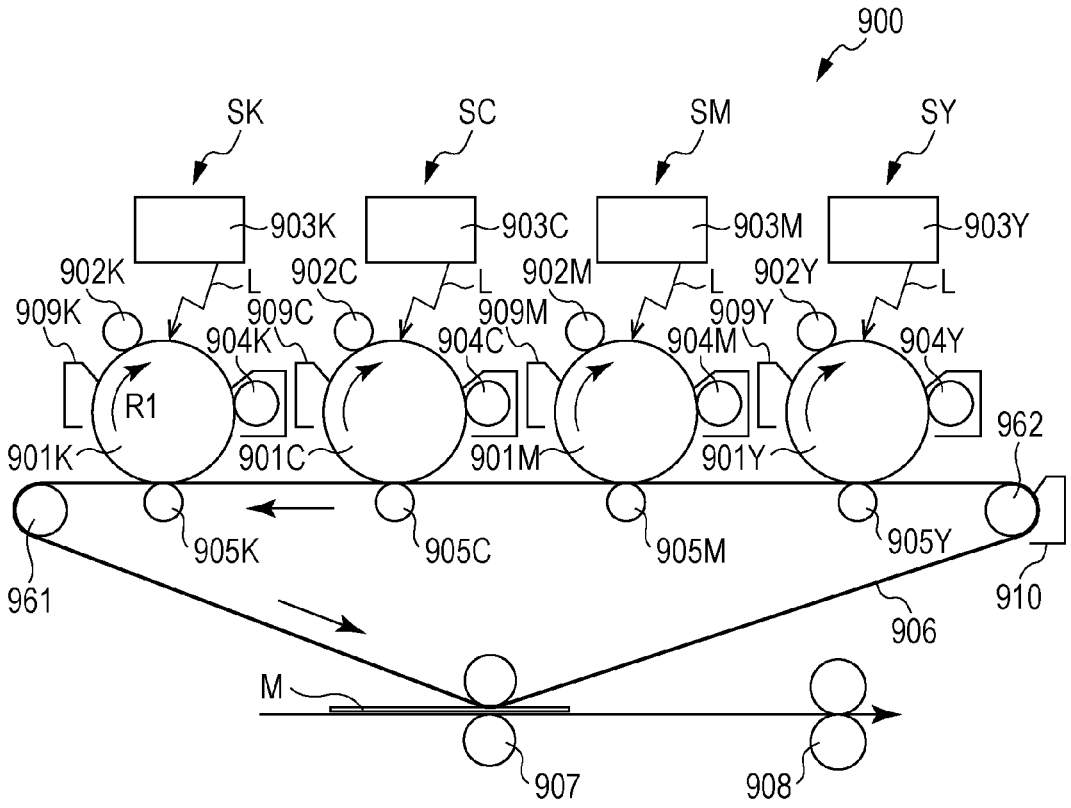
FIG. 17 is a schematic view of an electrophotographic apparatus.

FIG. 17 illustrates an electrophotographic apparatus 900 used for the evaluation. The electrophotographic apparatus 900 is a tandem-type electrophotographic laser-beam printer.

The electrophotographic apparatus 900 includes first, second, third, and fourth image-forming sections (stations) SY, SM, SC, and SK. The first, second, third, and fourth image-forming sections SY, SM, SC, and SK can form a yellow (Y), magenta (M), cyan (C), and black (K) images, respectively.

The structure and operation of the image-forming sections SY, SM, SC, and SK are substantially the same except for the use of toners of different colors. Thus, unless it is necessary, the subscripts that represent colors (Y, M, C, and K) are omitted in the following description.

Each of the image-forming sections S includes a photosensitive drum 901. The photosensitive drum 901 is rotated in the direction of an arrow R1 (clockwise) in FIG. 17. The electrophotographic apparatus 900 also includes a contact charging member (charging roller) 902, a laser beam scanner 903 for image exposure, a developing apparatus 904, and a cleaning apparatus 909, around the photosensitive drum 901. The electrophotographic apparatus 900 also includes an intermediate transfer belt 906 between the photosensitive drum 901 of each of the image-forming sections S and a primary transfer roller 905.

The image forming operation (image forming method) of a full-color image will be described below by way of example.

First, the surface of the photosensitive drum 901 is evenly charged to a predetermined potential with a predetermined polarity (negative polarity in the present example) using a charging roller 902. The photosensitive drum 901 is rotated in the direction of the arrow R1 at a circumferential velocity (surficial moving speed) of 300 mm/s. The circumferential velocity of the photosensitive drum 901 corresponds to the process speed of the electrophotographic apparatus 900.

The charged surface of the photosensitive drum 901 is scanned with a laser beam L modulated with the laser beam scanner (image exposure apparatus) 903 in response to the corresponding image signals. A portion of the electric charges on the surface of the photosensitive drum 901 irradiated with the laser beam is cancelled, and thereby an electrostatic latent image is formed on the surface of the photosensitive drum 901.

The electrostatic latent image formed on the surface of the photosensitive drum 901 is developed with toner contained in the developing apparatus 904 and forms a toner image. In the present example, the electrostatic latent image on the surface of the photosensitive drum 901 is developed using a reversal development method with the developing apparatus 904.

The toner images of different colors formed on the surfaces of the photosensitive drums 901 are successively transferred (primary transfer) to the intermediate transfer belt 906 in a primary transfer portion in which the primary transfer roller 905 and the photosensitive drum 901 are disposed on opposite sides of the intermediate transfer belt 906. At this time, a primary transfer voltage is applied to the primary transfer roller 905. The primary transfer voltage is opposite in polarity to the normal charge polarity of the toner.

The intermediate transfer belt 906 is rotated with a driving roller 961. The superimposed toner images of four colors on the intermediate transfer belt 906 are electrostatically and collectively transferred to a transfer medium M, such as a paper sheet, in a secondary transfer portion 907.

The transfer medium M to which the toner images have been transferred is separated from the intermediate transfer belt 906 and is transported to a fixing unit (heat roller fixing unit) 908. The unfixed toner image on the transfer medium M is heated and pressurized with the fixing unit 908 and is fixed on the transfer medium M.

Toner that is not transferred to the intermediate transfer belt 906 and remains on the surface of the photosensitive drum 901 after the primary transferring step (primary-transfer remaining toner) is removed from the surface of the photosensitive drum 901 and is collected with the cleaning apparatus 909. The specific structure of the cleaning apparatus will be described below in the examples and comparative examples. The photosensitive drum 901 from which the primary-transfer remaining toner has been removed is used again for image forming.

Finally, toner that is not transferred to the transfer medium M and remains on the surface of the intermediate transfer belt 906 after the secondary transferring step (secondary-transfer remaining toner) is removed from the surface of the intermediate transfer belt 906 and is collected with an intermediate transfer belt cleaner 910.

Structure of Cleaning Apparatus

Figure 15A:
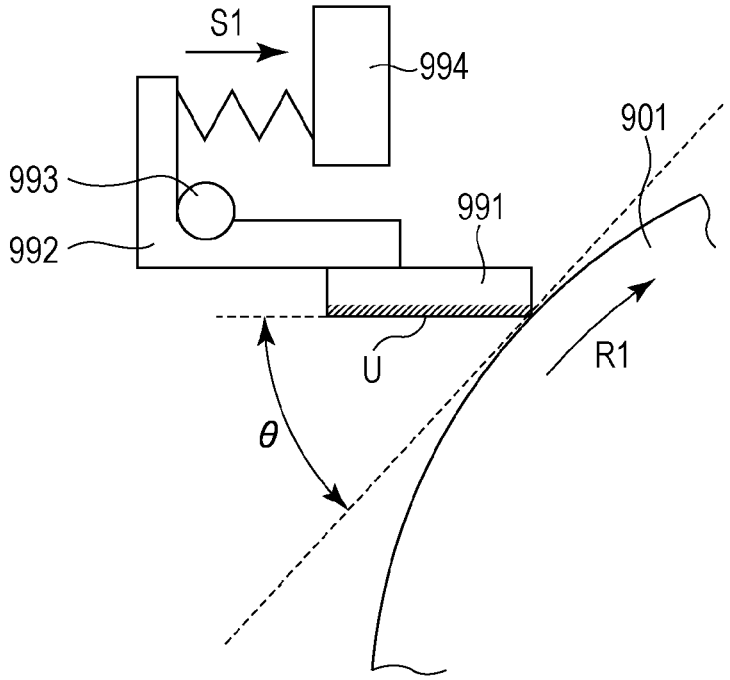
FIGS. 15A and 15B are schematic views of a cleaning apparatus in the "with" form and the "counter" form, respectively.

FIG. 15A illustrates the structure of a cleaning apparatus in the "with" form. A cleaning blade 991 is in contact with a photosensitive drum 901 in the "with" direction such that a surface U to which a catalyst is applied is in contact with the photosensitive drum 901. Components of a cleaning apparatus 909 are disposed such that the angle θ between the surface U and the contact surface between the cleaning blade 991 and the photosensitive drum 901 is 35 degrees. A supporting member 992 includes a rotation center 993 and can be freely rotated on the rotation center 993. A fixing member 994 is fixed to a frame (not shown) of an electrophotographic apparatus 900 and is coupled to the supporting member 992 with a spring S1. The spring S1 draws the supporting member 992 to the fixing member 994. Thus, the cleaning blade 991 is pressed against the surface of the photosensitive drum 901 at a constant load (a linear pressure of 28 gf/cm). The free length of the cleaning blade (the length of a protrusion of the cleaning blade from the supporting member 992) was 8 mm.

A jig that allows a cleaning blade to come into contact with a raw material pipe having the same diameter as the photosensitive drum 901 in the same contact state as the cleaning apparatus 909 and can observe the contact state at the tip thereof in a cross-sectional direction of the cleaning blade was used to estimate the angle β in FIG. 16B. The raw material pipe is made of aluminum. In the measurement, a cross-sectional image of a cleaning blade was taken with a CCD camera while the raw material pipe was rotated. The angle β was measured when a spherical particle having a diameter of 6 μm was in contact with both the surface U of the cleaning blade and the surface of the photosensitive drum. Although the installation angle θ was 35 degrees, the cleaning blade slightly bent toward the photosensitive drum 901, and the angle β was 28 degrees.

Evaluation Method

Three photosensitive drums having the same size as the photosensitive drum 901 of the electrophotographic apparatus 900 were prepared. The three photosensitive drums were a photosensitive drum having depressed portions on the surface thereof, the depressed portions having a diameter of 40 μm and a depth of 2.5 μm and occupying 50% of the surface of the photosensitive drum (a photosensitive drum having depressed portions on the surface thereof), a photosensitive drum having circumferential grooves on the surface thereof, the streak having a Sm of 30 μm and a roughness height of 2 μm (a photosensitive drum having circumferential grooves on the surface thereof), and a photosensitive drum having a flat surface. Each of the three photosensitive drums was evaluated in a black station of the electrophotographic apparatus 900. For each of the three photosensitive drums, a cleaning apparatus was installed in the "with" form, as illustrated in FIG. 15A. The cleaning blade was checked for an abnormal noise, chatter, and turning over in an endurance test in a high temperature and high humidity environment of 30° C./80% RH. In the endurance test, 10000 copies were printed at a discharge current of −100 μA without development. When no abnormal noise was made, the drive motor current for rotating the photosensitive drum was monitored. The rotation torque of the photosensitive drum was estimated from the drive motor current.

Toner cleaning performance was evaluated after a solid image having a width of 50 mm was developed along the entire circumference of the photosensitive drum in the black station in a low temperature and low humidity environment of 15° C./10% RH. No transfer bias was applied in the black station. Thus, almost all the developing toner reached a contact portion between the photosensitive drum and the cleaning blade. A two-component color developing agent was used as a developing agent. The toner was a spherical toner having a median particle diameter of approximately 6 μm manufactured by a suspension polymerization method. One part of silica particles having a primary particle size of 20 nm was added to 100 parts of the toner. The amount of toner deposited on the surface of the photosensitive drum and the amount of electrical charge in the development of the entire solid image were 0.55 mg/cm2 and −40 μC/g, respectively, as measured using a blow-off method. After the entire solid image was developed and the toner on the surface of the photosensitive drum reached the contact portion, the photosensitive drum was rotated once. After the photosensitive drum was stopped, cleaning performance was evaluated by observing the surface of the photosensitive drum and the cleaning blade. When the cleaning blade had a high angle β, a high contact pressure, and good adaptability to concavities and convexities on the surface of the photosensitive drum, the cleaning blade had high cleaning performance. Table 12 shows the results.

The following are evaluation criteria.

Ratings for Abnormal Noise, Chatter, and Turning Over

AA: No abnormal noise, chatter, and turning over of the cleaning blade. The drive motor current (torque) for rotating the photosensitive drum was very low.

A: No abnormal noise, chatter, and turning over of the cleaning blade.

B: An abnormal noise was sometimes made at the time of stopping or starting.

C: An abnormal noise was made at the time of stopping and starting or during operation.

D: An abnormal noise was made all the time, or the cleaning blade was turned over.

Passing Test

A: No passing of toner.

B: Passing toner particles were observed on a face of the cleaning blade on the downstream side (a face opposite the surface of the photosensitive drum) (observation of the cleaning blade).

C: A streak of a passing toner particle was partly observed in a visual inspection (observation of the surface of the photosensitive drum).

D: Passing of toner particles was generally observed in a visual inspection (observation of the surface of the photosensitive drum).

The cleaning blade according to Example C1 had a Young's modulus ($Y_0$) of 41.8 mgf/μm$^2$, $Y_{50}/Y_0$ of 0.18, and $Y_{20}/Y_0$ of 0.48. $\Delta Y_{0\text{-}20} \geq \Delta Y_{20\text{-}50}$ was obvious from the slopes of $L_{0\text{-}20}$ and $L_{20\text{-}50}$. The Young's modulus ($Y_N$) was below $L_{0\text{-}50}$, and a change in Young's modulus from the surface of a contact portion to the interior of the cleaning blade formed a convex downward curve. The ratio $I_{SI}/I_{SE}$ was 0.50.

Example C2

Figure 18A:
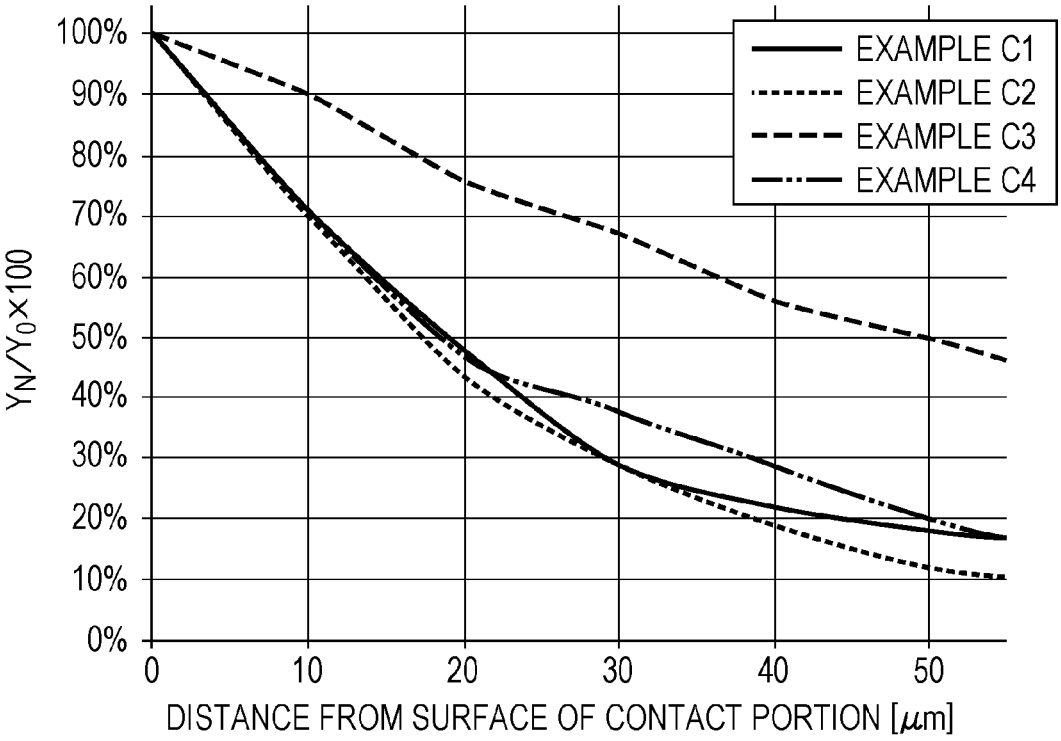
FIG. 18A is a graph showing the relationship between the distance from a surface of a contact portion of a cleaning blade and Young's modulus in Examples C1 to C4.

A cleaning blade was manufactured and subjected to analysis and the measurement of physical properties in the same manner as in Example C1 except that 100 parts of ETA used in the preparation of the catalyst solution applied to the inner surface of the die was replaced by 100 parts of a compound having the formula (D) (trade name: DABCO-TMR, manufactured by Sankyo Air Products Co., Ltd.), and the molding temperature was changed from 110° C. to 80° C. Tables 9 and 10 show the manufacturing conditions and M(OH/NCO). FIG. 18A and Tables 11 and 12 show the results of the analysis and the measurement of physical properties.

Example C3

A cleaning blade was manufactured and subjected to analysis and the measurement of physical properties in the same manner as in Example C1 except that the amount of HA2000 in the process for producing a second composition was changed from 300 parts to 360 parts, and 100 parts of ETA used in the preparation of the catalyst solution applied to the inner surface of the die was replaced by 100 parts of $CH_3COOK$ (trade name: Polycat 46, manufactured by Air Products and Chemicals, Inc.). Tables 9 and 10 show the manufacturing conditions and M(OH/NCO). FIG. 18A and Tables 11 and 12 show the results of the analysis and the measurement of physical properties.

Example C4

A cleaning blade was manufactured and subjected to analysis and the measurement of physical properties in the same manner as in Example C1 except that the amount of HA2000 in the process for producing a second composition was changed from 300 parts to 218.5 parts, 100 parts of ETA used in the preparation of the catalyst solution applied to the inner surface of the die was replaced by 100 parts of UCAT-18X (trade name), and the molding temperature was changed from 110° C. to 100° C. Tables 9 and 10 show the manufacturing conditions and M(OH/NCO). FIG. 18A and Tables 11 and 12 show the results of the analysis and the measurement of physical properties.

Example C5

The evaluation described in Example C1 was performed after components of a cleaning apparatus were adjusted such that the installation angle θ of the cleaning blade was 50 degrees.

Examples C6 to C9

The cleaning blades according to Examples C1 to C4 were tested in the same manner as in Example C1 after components of a cleaning apparatus were adjusted such that the installation angle θ of the cleaning blade was 75 degrees.

Examples C10 to C13

Figure 15B:
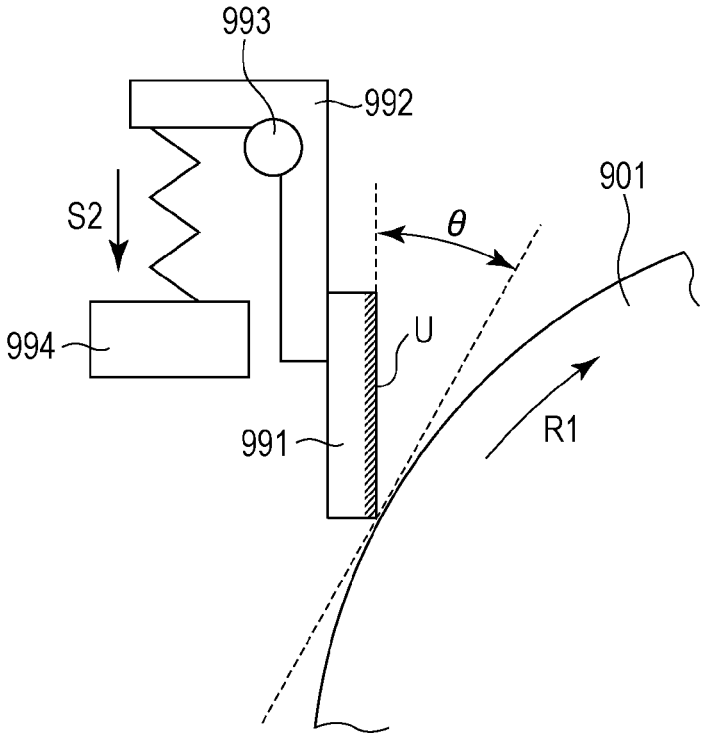

The cleaning blades according to Examples C1 to C4 in the "counter" form were tested in the same manner as in Example C1. FIG. 15B illustrates the structure of a cleaning apparatus in the "counter" form. A cleaning blade 991 is in contact with a photosensitive drum 901 in the "counter" direction such that a surface U is in contact with the photosensitive drum 901. The angle θ between the surface U and a tangent line at a contact point between the cleaning blade and the photosensitive drum 901 was 22 degrees. A supporting member 992 includes a rotation center 993 and can be freely rotated on the rotation center 993. A fixing member 994 is fixed to a frame (not shown) of an electrophotographic apparatus 900 and is coupled to the supporting member 992 with a spring S2. The spring S2 draws the supporting member 992 to the fixing member 994. Thus, the cleaning blade 991 is pressed against the surface of the photosensitive drum 901 at a constant load (a linear pressure of 28 gf/cm). The cleaning blade had a free length of 8 mm.

Comparative Example C1

A cleaning blade was manufactured and subjected to analysis and the measurement of physical properties in the same manner as in Example C1 except that the amount of HA2000 in the process for producing a second composition was changed from 300 parts to 500 parts, and the molding temperature was changed from 110° C. to 140° C. Tables 9 and 10 show the manufacturing conditions and M(OH/NCO).

Figure 18B:
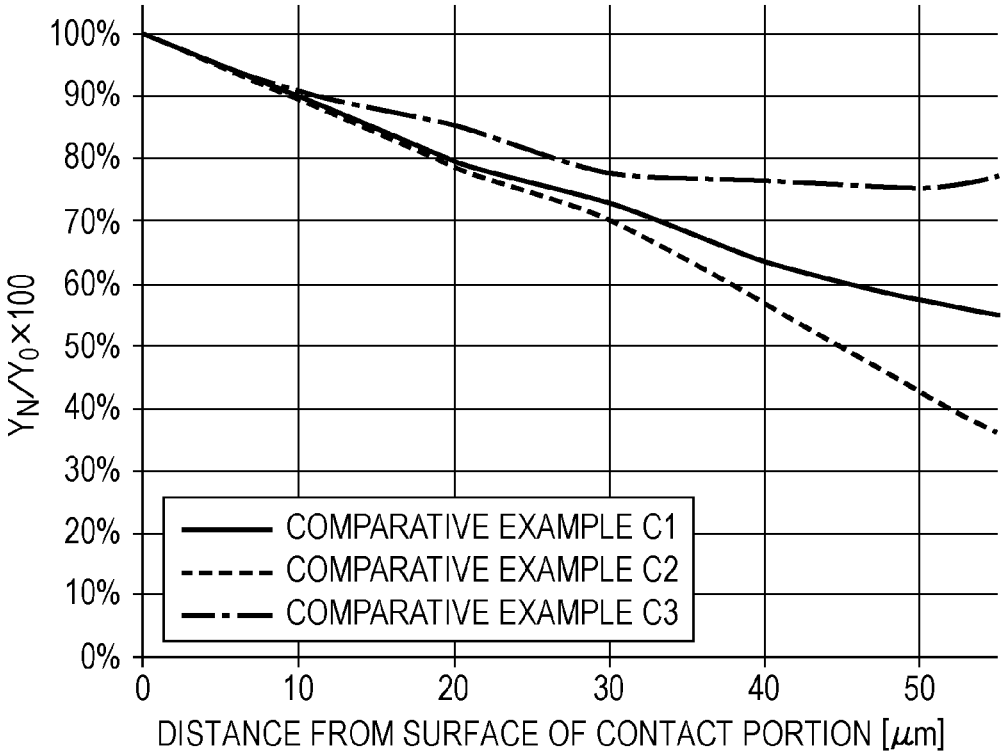
FIG. 18B is a graph showing the relationship between the distance from a surface of a contact portion of a cleaning blade and Young's modulus in Comparative Examples C1 to C3.

FIG. 18B and Tables 11 and 12 show the results of the analysis and the measurement of physical properties.

Comparative Example C2

A cleaning blade was manufactured and subjected to analysis and the measurement of physical properties in the same manner as in Example C1 except that the amount of 4,4'-MDI in the process for producing a first composition was changed from 299 parts to 350 parts, the amount of BA2600 was changed from 767.5 parts to 860 parts, the amount of HA2000 in the process for producing a second composition was changed from 300 parts to 150 parts, and 100 parts of ETA used in the preparation of the catalyst solution applied to the inner surface of the die was replaced by 100 parts of UCAT-18X (trade name). Tables 9 and 10 show the manufacturing conditions and M(OH/NCO). FIG. 18B and Tables 11 and 12 show the results of the analysis and the measurement of physical properties.

Comparative Example C3

A cleaning blade was manufactured in the same manner as in Example C1 except that no catalyst solution was applied to the inner surface of the die. The cleaning blade was dipped in 4,4'-MDI at 80° C. for 30 minutes. After that, 4,4'-MDI on the surface of the cleaning blade was removed using ethanol. The cleaning blade was then left stand in a high humidity environment of 25° C./90% RH for 2 days, thereby allowing 4,4'-MDI remaining in the surface of the cleaning blade to react with water. The resulting cleaning blade was used in Comparative Example C3. Tables 9 and 10 show the manufacturing conditions and M(OH/NCO). FIG. 18B and Tables 11 and 12 show the results of the analysis and the measurement of physical properties.

Comparative Examples C4 to C6

The cleaning blades according to Comparative Examples C1 to C3 were tested in the same manner as in Examples C6 to C9 after components of a cleaning apparatus were adjusted such that the installation angle θ of the cleaning blade was 75 degrees.

In Examples C1 to C9, in which the cleaning blades according to Examples C1 to C4 having $Y_0$ of 10 mgf/μm$^2$ or more and 400 mgf/μm$^2$ or less, $Y_{50}/Y_0$ of 0.5 or less, and $\Delta Y_{0-20}$ greater than or equal to $\Delta Y_{20-50}$ were used in the "with" form, each of the photosensitive drums was rotated at a low torque, and the number of passing particles was reduced. In particular, the cleaning blades according to Examples C1, C2, and C4, which had $Y_0$ of 40 mgf/μm$^2$ or more and 400 mgf/μm$^2$ or less, had satisfactory results. When the angle β was 40 degrees or more (40 degrees or more and less than 90 degrees), the results were further improved. As described above, a higher angle β results in a smaller number of passing spherical toner particles. In the "with" form in which the surface C comes into contact with the photosensitive drum 901, in consideration of the precision with which the contact position is controlled and the bending of the blade, the installation angle θ may be 75 degrees or less, and the angle β may be 70 degrees or less. At an angle β of 70 degrees or less, in FIG. 15A, the cleaning blade 991 is prevented from sliding on the surface of the photosensitive drum 901, being rotated clockwise on the rotation center 993, and separating from the photosensitive drum 901.

TABLE 9

| Cleaning blade | (i) First composition: Polyisocyanate | | Polyol | | (ii) Second composition: Polyol | | Urethane rubber synthesis catalyst | | M(OH/NCO) in mixture of (i) and (ii) [mol %] |
|---|---|---|---|---|---|---|---|---|---|
| Example C1 | 4,4'-MDI | 299 parts | BA2600 | 767.5 parts | HA2000 | 300 parts | ETA | 0.25 parts | 17 |
| Example C2 | 4,4'-MDI | 299 parts | BA2600 | 767.5 parts | HA2000 | 300 parts | ETA | 0.25 parts | 17 |
| Example C3 | 4,4'-MDI | 299 parts | BA2600 | 767.5 parts | HA2000 | 360 parts | ETA | 0.25 parts | 20 |
| Example C4 | 4,4'-MDI | 299 parts | BA2600 | 767.5 parts | HA2000 | 218.5 parts | ETA | 0.25 parts | 12 |
| Comparative example C1 | 4,4'-MDI | 299 parts | BA2600 | 767.5 parts | HA2000 | 500 parts | ETA | 0.25 parts | 28 |
| Comparative example C2 | 4,4'-MDI | 350 parts | BA2600 | 860 parts | HA2000 | 150 parts | ETA | 0.25 parts | 7 |
| Comparative example C3 | 4,4'-MDI | 299 parts | BA2600 | 767.5 parts | HA2000 | 300 parts | ETA | 0.25 parts | 17 |

TABLE 10

| Cleaning blade | Catalyst solution | | | Molding temperature (° C.) |
|---|---|---|---|---|
| Example C1 | Ethanol<br>ETA | 100 parts<br>100 parts | Application to inner surface of die | 110 |
| Example C2 | Ethanol<br>DABCO-TMR | 100 parts<br>100 parts | Application to inner surface of die | 80 |
| Example C3 | Ethanol<br>POLYCAT46 | 100 parts<br>100 parts | Application to inner surface of die | 110 |
| Example C4 | Ethanol<br>UCAT-18X | 100 parts<br>100 parts | Application to inner surface of die | 100 |
| Comparative example C1 | Ethanol<br>ETA | 100 parts<br>100 parts | Application to inner surface of die | 140 |

TABLE 10-continued

| Cleaning blade | Catalyst solution | | | Molding temperature (° C.) |
|---|---|---|---|---|
| Comparative example C2 | Ethanol<br>UCAT-18X | 100 parts<br>100 parts | Application to inner surface of die | 110 |
| Comparative example C3 | — | — | — | 110 |

TABLE 11

| Cleaning blade | Young's modulus | | | | | | | | |
|---|---|---|---|---|---|---|---|---|---|
| | $Y_0$ [mgf/μm$^2$] | $Y_{20}$ [mgf/μm$^2$] | $Y_{50}$ [mgf/μm$^2$] | $Y_{50}/Y_0$ | $Y_{20}/Y_0$ | $\Delta Y_{0-20}$ | $\Delta Y_{20-50}$ | Is $Y_N$ below $L_{0-50}$? | $I_{SI}/I_{SE}$ |
| Example C1 | 42 | 20 | 8 | 0.2 | 0.5 | 0.03 | 0.01 | Yes | 0.5 |
| Example C2 | 250 | 110 | 31 | 0.1 | 0.4 | 0.03 | 0.01 | Yes | 1.2 |
| Example C3 | 10 | 8 | 5 | 0.5 | 0.8 | 0.01 | 0.01 | No | 0.61 |
| Example C4 | 400 | 189 | 78 | 0.2 | 0.5 | 0.03 | 0.01 | Yes | 1.55 |
| Comparative example C1 | 6 | 5 | 3 | 0.5 | 0.8 | 0.01 | 0.01 | No | 0.49 |
| Comparative example C2 | 457 | 360 | 194 | 0.4 | 0.8 | 0.01 | 0.01 | No | 1.9 |
| Comparative example C3 | 11 | 8.9 | 8 | 0.7 | 0.8 | 0.01 | 0 | No | 0.12 |

TABLE 12

| | | | | | Photosensitive drum having depressed portions on surface thereof | | Photosensitive drum having circumferential grooves on surface thereof | | Photosensitive drum having flat surface | |
|---|---|---|---|---|---|---|---|---|---|---|
| | Cleaning blade | Contact direction | Installation angle [° C.] | Angle β [° C.] | Passing of toner | Chatter and turning over | Passing of toner | Chatter and turning over | Passing of toner | Chatter of turning over |
| Example C1 | Example C1 | With | 35 | 28 | B | AA | B | AA | B | AA |
| Example C2 | Example C2 | | 35 | 30 | B | AA | A | AA | A | AA |
| Example C3 | Example C3 | | 35 | 25 | B | A | B | A | B | A |
| Example C4 | Example C4 | | 35 | 31 | B | AA | A | AA | A | AA |
| Example C5 | Example C1 | | 50 | 43 | A | AA | A | AA | A | AA |
| Example C6 | Example C1 | | 75 | 68 | A | AA | A | AA | A | AA |
| Example C7 | Example C2 | | 75 | 70 | A | AA | A | AA | A | AA |
| Example C8 | Example C3 | | 75 | 64 | B | A | B | AA | A | AA |
| Example C9 | Example C4 | | 75 | 70 | A | AA | A | AA | A | AA |
| Example C10 | Example C1 | Counter | 22 | — | A | A | A | A | A | A |
| Example C11 | Example C2 | | 22 | — | A | A | A | A | A | A |
| Example C12 | Example C3 | | 22 | — | A | B | A | B | A | A |
| Example C13 | Example C4 | | 22 | — | A | A | A | A | A | A |
| Comparative example C1 | Comparative example C1 | With | 35 | 5 | D | B | D | B | D | B |
| Comparative example C2 | Comparative example C2 | | 35 | 32 | C | AA | B | AA | B | AA |
| Comparative example C3 | Comparative example C3 | | 35 | 15 | D | B | D | A | C | A |
| Comparative example C4 | Comparative example C1 | | 75 | 43 | D | B | C | A | C | A |
| Comparative example C5 | Comparative example C2 | | 75 | 72 | C | AA | B | AA | A | AA |
| Comparative example C6 | Comparative example C3 | | 75 | 57 | C | A | C | A | B | A |

Although a constant-load cleaning apparatus including a spring was used in the present example, a constant-displacement cleaning apparatus without a spring also have the advantages of the present invention. In the constant-displacement cleaning apparatus, the relative position between the supporting member 992 and the photosensitive drum 901 is fixed. Constant-displacement cleaning apparatuses require a smaller footprint than constant-load cleaning apparatuses. In constant-displacement cleaning apparatuses, the installation angle θ and the angle β can be increased because the separating rarely occurs. However, variations in contact load of a cleaning blade due to the decentering of a photosensitive drum or the bending of a frame are smaller in constant-load cleaning apparatuses than in constant-displacement cleaning apparatuses.

Toner scraped from the surface of a photosensitive drum and collected on the upstream side of a contact portion between the photosensitive drum and a cleaning blade may be removed with an accessory unit. For example, an electrically conductive fur brush or sponge roller may be brought into light contact with a photosensitive drum and may be rotated in synchronism with the rotation of the photosensitive drum.

Example C14

A toner cleaning test on the cleaning blade according to Example C1 was performed on a surface of an intermediate transfer belt.

Two types of polyimide intermediate transfer belts were prepared for the evaluation of cleaning performance. They were an intermediate transfer belt having circumferential grooves on the surface thereof, the streak having a Sm of 30 μm and a roughness height of 2 μm (hereinafter also referred to as an "intermediate transfer belt having circumferential grooves on the surface thereof") and an intermediate transfer belt having a flat surface. Each of the intermediate transfer belts was installed in an electrophotographic apparatus 900. Each of the intermediate transfer belts was equipped with an intermediate transfer belt cleaner 910. The structure of the intermediate transfer belt cleaner 910 was the same as the structure in Example C1 (illustrated in FIG. 15A) except a component for installing the intermediate transfer belt cleaner 910 on the intermediate transfer belt. The installation angle θ was 30 degrees. The tip of a cleaning blade was in contact with a portion of the front surface of an intermediate transfer belt. The opposite portion on the back surface of the intermediate transfer belt (a face bearing no toner image) was in contact with a facing roller 962. An endurance test of 10000 copies was performed in a high temperature and high humidity environment of 30° C./80% RH without the formation of an image at a primary transfer electric current (an electric current flowing through a transfer roller 905) of 40 μA and a secondary transfer electric current (an electric current flowing through a secondary transfer portion 907) of 80 μA. The cleaning blade was checked for an abnormal noise, chatter, and turning over in the endurance test. When no abnormal noise was made, the drive motor current of a driving roller 961 for rotating the intermediate transfer belt was monitored. The rotation torque of the intermediate transfer belt was estimated from the drive motor current.

A solid image having a width of 50 mm was transferred to the intermediate transfer belt along its entire circumference in a low temperature and low humidity environment of 15° C./10% RH. The cleaning performance of removing the solid image with the intermediate transfer belt cleaner 910 was evaluated. No transfer bias was applied to the secondary transfer portion so that as much toner as possible on the surface of the intermediate transfer belt could reach a contact portion between the intermediate transfer belt and the cleaning blade. The type of toner, the amount of deposited toner, and the amount of electrical charge were the same as Example C1. After toner on the surface of the intermediate transfer belt reached the intermediate transfer belt cleaner 910, the intermediate transfer belt was rotated 180 degrees. After the intermediate transfer belt was stopped, cleaning performance was evaluated by observing the surface of the intermediate transfer belt and the cleaning blade. When the cleaning blade had a high angle β, a high contact pressure, and good adaptability to concavities and convexities on the surface of the intermediate transfer belt, the cleaning blade had high cleaning performance. Table 13 shows the results. The evaluation criteria were described in Example C1.

Examples C15 to C17

The cleaning blades according to Examples C2, C3, and C4 were tested in the same manner as in Example C14.

Example C18

The evaluation described in Example C14 was performed after components of a cleaning apparatus were adjusted such that the installation angle θ of the cleaning blade was 50 degrees.

Examples C19 to C22

The cleaning blades according to Examples C1 to C4 were tested in the same manner as in Example C14 after components of a cleaning apparatus were adjusted such that the installation angle θ of the cleaning blade was 75 degrees.

Examples C23 to C26

The cleaning blades according to Examples C1 to C4 in the "counter" form were tested in the same manner as in Example C14. The structure of the intermediate transfer belt cleaner 910 in the "counter" form was the same as the structure in Example C10 (illustrated in FIG. 15B).

Comparative Examples C7 to C9

The cleaning blades according to Comparative Examples C1 to C3 were tested in the same manner as in Example C14.

Comparative Examples C10 to C12

The cleaning blades according to Comparative Examples C1 to C3 were tested in the same manner as in Example C14 at an installation angle θ of 75 degrees.

In Examples C14 to C22, in which the cleaning blades C1 to C4 were used in the "with" form, each of the intermediate transfer belts was rotated at a low torque, and the number of passing particles was reduced. In particular, the cleaning blades C1, C2, and C4, which had $Y_0$ of 40 mgf/μm$^2$ or more and 400 mgf/μm$^2$ or less, had better results, and an angle β of 40 degrees or more resulted in much better results.

TABLE 13

| | | | Installation | | Intermediate transfer belt having circumferential grooves on surface there of | | Intermediate transfer belt having flat surface | |
|---|---|---|---|---|---|---|---|---|
| | Cleaning blade | Contact direction | angle [° C.] | Angle β [° C.] | Passing of toner | Chatter and turning over | Passing of of toner | Chatter and turning over |
| Example C14 | Example C1 | With | 30 | 28 | B | AA | B | AA |
| Example C15 | Example C2 | | 30 | 30 | B | AA | A | AA |
| Example C16 | Example C3 | | 30 | 25 | B | A | B | A |

TABLE 13-continued

| | Cleaning blade | Contact direction | Installation angle [° C.] | Angle β [° C.] | Intermediate transfer belt having circumferential grooves on surface there of: Passing of toner | Intermediate transfer belt having circumferential grooves on surface there of: Chatter and turning over | Intermediate transfer belt having flat surface: Passing of toner | Intermediate transfer belt having flat surface: Chatter and turning over |
|---|---|---|---|---|---|---|---|---|
| Example C17 | Example C4 | | 30 | 31 | B | AA | B | AA |
| Example C18 | Example C1 | | 50 | 43 | A | AA | A | AA |
| Example C19 | Example C1 | | 75 | 68 | A | AA | A | AA |
| Example C20 | Example C2 | | 75 | 70 | A | AA | A | AA |
| Example C21 | Example C3 | | 75 | 64 | B | A | B | A |
| Example C22 | Example C4 | | 75 | 70 | A | AA | A | AA |
| Example C23 | Example C1 | Counter | 22 | — | A | A | A | A |
| Example C24 | Example C2 | | 22 | — | A | A | A | A |
| Example C25 | Example C3 | | 22 | — | A | B | A | A |
| Example C26 | Example C4 | | 22 | — | A | A | A | A |
| Comparative example C7 | Comparative example C1 | With | 30 | 5 | D | B | D | B |
| Comparative example C8 | Comparative example C2 | | 30 | 32 | C | AA | B | AA |
| Comparative example C9 | Comparative example C3 | | 30 | 15 | D | B | C | A |
| Comparative example C10 | Comparative example C1 | | 75 | 43 | D | B | C | A |
| Comparative example C11 | Comparative example C2 | | 75 | 72 | C | AA | A | AA |
| Comparative example C12 | Comparative example C3 | | 75 | 57 | C | A | C | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-096019 filed Apr. 30, 2013, and No. 2014-082052 filed Apr. 11, 2014, which are hereby incorporated by reference herein in their entirety.

What is claimed is:

1. A urethane rubber cleaning blade configured to come into contact with a member to be cleaned and clean a surface of the member to be cleaned, wherein a surface C of a contact portion of the cleaning blade that comes into contact with the member to be cleaned has a Young's modulus ($Y_0$) of 10 mgf/μm$^2$ or more and 400 mgf/μm$^2$ or less, the ratio ($Y_{50}/Y_0$) of the Young's modulus ($Y_{50}$) of an internal portion of the cleaning blade 50 μm spaced apart from the surface C to the Young's modulus ($Y_0$) is 0.5 or less, the Young's modulus decreases from the surface of the contact portion to an interior of the cleaning blade, and the average rate of change in Young's modulus [$\{(Y_0-Y_{20})/Y_0\}/(20-0)$] from the surface C to an internal portion of the cleaning blade 20 μm spaced apart from the surface C is greater than or equal to the average rate of change in Young's modulus [$\{(Y_{20}-Y_{50})/Y_0\}/(50-20)$] from the internal portion of the cleaning blade 20 μm spaced apart from the surface C to the internal portion of the cleaning blade 50 μm spaced apart from the surface C, wherein $Y_0$ denotes the Young's modulus of the surface C, and $Y_{20}$ and $Y_{50}$ denote the Young's modulus of the internal portion of the cleaning blade 20 and 50 μm spaced apart from the surface C, respectively.

2. The cleaning blade according to claim 1, wherein the Young's modulus ($Y_0$) is 10 mgf/μm$^2$ or more and 250 mgf/μm$^2$ or less.

3. The cleaning blade according to claim 1, wherein the urethane rubber has an isocyanurate group.

4. The cleaning blade according to claim 1, wherein the Young's modulus ($Y_0$) is 10 mgf/μm$^2$ or more and 250 mgf/μm$^2$ or less, and the urethane rubber has an isocyanurate group.

5. The cleaning blade according to claim 1, wherein the urethane rubber is a polyester urethane rubber having an isocyanurate group, and the ratio ($I_{SI}/I_{SE}$) of the C—N peak (1411 cm$^{-1}$) intensity ($I_{SI}$) of the isocyanurate group of the polyester urethane rubber to the C=O peak (1726 cm$^{-1}$) intensity ($I_{SE}$) of an ester group of the polyester urethane rubber in an IR spectrum of a surface of the contact portion of the polyester urethane rubber measured using a μATR method is 0.50 or more and 1.55 or less.

6. The cleaning blade according to claim 1, wherein on a plane defined by a horizontal axis representing the distance from the surface C (the surface C is taken as the distance of 0 μm) and a vertical axis representing Young's modulus, Young's modulus ($Y_N$) ($0<N<50$ [μm]) at a position between the surface C and the internal portion of the cleaning blade 50 μm spaced apart from the surface C (a position N [μm] spaced apart from the surface C) is lower than a straight line between the Young's modulus ($Y_0$) and the Young's modulus ($Y_{50}$).

7. The cleaning blade according to claim 1, wherein the ratio ($Y_{20}/Y_0$) of the Young's modulus ($Y_{20}$) to the Young's modulus ($Y_0$) is 0.5 or less.

8. The cleaning blade according to claim 1, wherein the surface C has an average inclination angle θa of 1 degree or more, and the surface C has a 10-point roughness average Rz of 10 μm or less.

9. A process cartridge detachably attached to a main body of an electrophotographic apparatus, the process cartridge being configured to integrally support the cleaning blade according to claim 1 and an electrophotographic photosensitive member, which is a member to be cleaned with the cleaning blade.

10. The process cartridge according to claim 9, wherein the cleaning blade is disposed in a "width" direction where a supporting member of the cleaning blade is disposed on the upstream side of the contact portion with respect to the rotation direction of the electrophotographic photosensitive member in an image-forming period and comes into contact with the electrophotographic photosensitive member and thereby forms a contact portion, and the Young's modulus ($Y_{U0}$) of a surface U of the cleaning blade facing an upstream surface of the electrophotographic photosensitive member in the rotation direction with respect to the contact portion is 10 mgf/μm$^2$ or more and 400 mgf/μm$^2$ or less.

11. The process cartridge according to claim 10, wherein the angle between a contact surface A and the surface U is 40 degrees or more and less than 90 degrees, the contact surface A being a plane in contact with a surface of the electrophotographic photosensitive member at a center of the contact portion in the rotation direction.

12. An electrophotographic apparatus, comprising: the cleaning blade according to claim 1; and an electrophotographic photosensitive member, which is a member to be cleaned with the cleaning blade.

13. The electrophotographic apparatus according to claim 12, wherein the cleaning blade is disposed in a "width" direction where a supporting member of the cleaning blade is disposed on the upstream side of the contact portion with respect to the rotation direction of the electrophotographic photosensitive member in an image-forming period and comes into contact with the electrophotographic photosensitive member and thereby forms a contact portion, and the Young's modulus ($Y_{U0}$) of a surface U of the cleaning blade facing an upstream surface of the electrophotographic photosensitive member in the rotation direction with respect to the contact portion is 10 mgf/μm$^2$ or more and 400 mgf/μm$^2$ or less.

14. The electrophotographic apparatus according to claim 13, wherein the angle between a contact surface A and the surface U is 40 degrees or more and less than 90 degrees, the contact surface A being a plane in contact with a surface of the electrophotographic photosensitive member at a center of the contact portion in the rotation direction.

15. An electrophotographic apparatus, comprising: the cleaning blade according to claim 1; and an intermediate transfer member, which is a member to be cleaned with the cleaning blade.

16. The electrophotographic apparatus according to claim 15, wherein the cleaning blade is disposed in a width direction where a supporting member of the cleaning blade is disposed on the upstream side of the contact portion with respect to the rotation direction of the intermediate transfer member in an image-forming period and comes into contact with the intermediate transfer member and thereby forms a contact portion, and the Young's modulus ($Y_{U0}$) of a surface U of the cleaning blade facing an upstream surface of the intermediate transfer member in the rotation direction with respect to the contact portion is 10 m gf/μm$^2$ or more and 400 mgf/μm$^2$ or less.

17. The electrophotographic apparatus according to claim 16, wherein the angle between a contact surface A and the surface U is 40 degrees or more and less than 90 degrees, the contact surface A being a plane in contact with a surface of the intermediate transfer member at a center of the contact portion in the rotation direction.

18. A method for manufacturing the cleaning blade according to claim 1, wherein the urethane rubber is a polyester urethane rubber having an isocyanurate group, the method comprising (a) mixing a polyisocyanate, an aliphatic polyester polyol, and a urethane-forming catalyst to produce a mixture, the number of moles of the aliphatic polyester polyol being 30% or more and 40% or less of the number of moles of the polyisocyanate, (b) applying an isocyanurating catalyst to an inner surface of a die, and (c) charging the mixture produced in (a) into the die coated with the isocyanurating catalyst in (b) and heating the die.

19. The method for manufacturing a cleaning blade according to claim 18, wherein the heating temperature of the die in (c) is 80° C. or more and 150° C. or less.

20. The method for manufacturing a cleaning blade according to claim 18, wherein the isocyanurating catalyst is N,N,N'-trimethylaminoethylethanolamine.

* * * * *